US011586150B2

(12) United States Patent
Surmely et al.

(10) Patent No.: US 11,586,150 B2
(45) Date of Patent: Feb. 21, 2023

(54) TIMEPIECE PROVIDED WITH A MECHANICAL MOVEMENT AND A DEVICE FOR CORRECTING A DISPLAYED TIME

(71) Applicant: The Swatch Group Research and Development Ltd, Marin (CH)

(72) Inventors: Gérard Surmely, Villars-Epeney (CH); Matthias Imboden, St-Blaise (CH); Lionel Tombez, Bevaix (CH)

(73) Assignee: The Swatch Group Research and Development Ltd, Marin (CH)

( * ) Notice: Subject to any disclaimer, the term of this patent is extended or adjusted under 35 U.S.C. 154(b) by 321 days.

(21) Appl. No.: 17/111,799

(22) Filed: Dec. 4, 2020

(65) Prior Publication Data

US 2021/0191334 A1 Jun. 24, 2021

(30) Foreign Application Priority Data

Dec. 24, 2019 (EP) ..... 19219678

(51) Int. Cl.
*G04C 3/06* (2006.01)
*G04B 27/00* (2006.01)
(Continued)

(52) U.S. Cl.
CPC ..... *G04B 27/007* (2013.01); *G04R 20/02* (2013.01); *G04R 20/26* (2013.01); *G04R 60/14* (2013.01)

(58) Field of Classification Search
CPC ..... G04B 27/007; G04B 27/00; G04R 20/02; G04R 20/26; G04R 60/14; G04C 3/06; G04C 3/061
See application file for complete search history.

(56) References Cited

U.S. PATENT DOCUMENTS 2,903,881 A * 9/1959 Frolow ..... G04D 7/1221 968/772
7,306,364 B2 * 12/2007 Born ..... G04C 11/084 368/204

(Continued)

FOREIGN PATENT DOCUMENTS

EP 3 339 982 A1 6/2018
EP 3 379 347 A1 9/2018
WO 2018/177779 A1 10/2018

OTHER PUBLICATIONS

European Search Report 19 21 9678 dated May 15, 2020.

*Primary Examiner* — Sean Kayes
(74) *Attorney, Agent, or Firm* — Sughrue Mion, PLLC

(57) ABSTRACT

A watch formed by a mechanical movement incorporating a mechanical resonator, including a display displaying the actual time, a correction device formed by a device for detecting the passage of at least one hand through at least one reference time position and by an electronic correction circuit allowing an overall time error for the display to be determined, and a device for braking the mechanical resonator. The correction device is arranged such that it can correct the actual time displayed as a function of the overall time error (loss or gain) previously determined. For this purpose, the correction device is arranged such that the braking device can act on the mechanical resonator during a correction period to vary the running of the drive mechanism of the display, in order to correct the actual time displayed.

45 Claims, 19 Drawing Sheets

(51) Int. Cl.

| | |
|---|---|
| ***G04R 20/02*** | (2013.01) |
| ***G04R 20/26*** | (2013.01) |
| ***G04R 60/14*** | (2013.01) |

(56) References Cited

U.S. PATENT DOCUMENTS

| | | | | |
|---|---|---|---|---|
| 11,480,925 | B2 * | 10/2022 | Tombez | G04B 17/26 |
| 2005/0036405 | A1 | 2/2005 | Born et al. | |
| 2017/0045861 | A1 * | 2/2017 | Winkler | G04D 7/10 |
| 2020/0103827 | A1 * | 4/2020 | Tombez | G04C 3/047 |

* cited by examiner

TIMEPIECE PROVIDED WITH A MECHANICAL MOVEMENT AND A DEVICE FOR CORRECTING A DISPLAYED TIME

CROSS-REFERENCE TO RELATED APPLICATION

This application claims priority to European Patent Application No. 19219678.0 filed Dec. 24, 2019, the entire contents of which are incorporated herein by reference.

TECHNICAL FIELD

The present invention relates, in general, to a timepiece comprising a mechanical movement, a display for displaying an actual time, which is driven by this mechanical movement, and a device for correcting this displayed actual time.

TECHNOLOGICAL BACKGROUND

In the field of mechanical watches, the conventional manner for correcting the actual time indicated by the display thereof is to use the conventional stem-crown which is generally arranged to act, in the protruding position, on a wheel set for driving the hours indicator and the minutes indicator, thanks to friction provided in the kinematic chain between these indicators and the escape wheel. Thus, in order to set a mechanical watch to the actual time, the user or a robot must generally pull out the stem-crown and actuate same such that it rotates to bring the hours and minutes indicators into the desired respective positions, in particular by visual comparison with a reference clock, as can be found, for example, in train stations, or with a digital time provided, for example, by a computer.

SUMMARY OF THE INVENTION

It can thus be seen that, in the field of timepieces provided with a mechanical movement, in addition to ensuring precise running of this mechanical movement, there is a real need for an effective system for correcting the actual time displayed by these timepieces comprising a mechanical movement. In particular, the purpose of the present invention is to be able to set a timepiece to the actual time, said timepiece comprising a mechanical movement and a time display, with a precision corresponding at least to that of an electronic watch, preferably to be able to set this timepiece substantially to the precise actual time given by an external system arranged to provide same (in particular a system connected to an atomic clock), without requiring a user or a robot to actuate a stem-crown or other external control member of the timepiece to personally carry out the hand-setting operation on the display. Within the scope of the invention, the precision of the setting of a timepiece provided with a mechanical movement to the actual time does not depend on a visual assessment by the user required to estimate when the various indicators concerned are in correct respective positions.

The term 'actual time' is understood to mean the legal time of a given location generally in which the timepiece and the user thereof are located. The actual time is generally displayed in hours, in minutes and optionally in seconds. The actual time can be indicated with a certain error by a timepiece, in particular a timepiece of the mechanical type. The actual time will be simply referred to as the 'time', in particular with regard to the actual time displayed by a timepiece. In order to indicate the legal time given with high precision in particular by/via a GPS system, a telephone network, a long-distance transmitting antenna or a mobile device/computer in particular connected to an Internet network server receiving the actual time from a high-precision clock, the expression 'precise actual time' will be used herein.

In order to satisfy the aforementioned needs which have been present in the horological field for many years, the present invention proposes a timepiece comprising:

- a display displaying an actual time formed by a set of indicators comprising an indicator relating to a given time unit of the actual time and which indicates the corresponding current time unit,
- a mechanical movement formed by a mechanism for driving the display and a mechanical resonator which is coupled to the drive mechanism such that the oscillation thereof times the running of this drive mechanism, and
- a device for correcting the actual time indicated by the display; wherein the device for correcting the actual time displayed comprises:
  - a detection device arranged to allow for the detection, in a direct or indirect manner, of the passage of said indicator of the display through at least one reference time position of this display which relates to said time unit of the actual time;
  - an electronic correction circuit; and
  - a device for braking the mechanical resonator;

wherein the electronic correction circuit comprises:

- a control unit arranged such that it can control the detection device such that this detection device carries out, during a detection phase, a plurality of successive measurements and provides a plurality of corresponding measurement values;
- a processing unit arranged such that it can receive, from the detection device, said plurality of measurement values and process same; and
- an internal time base comprising a clock circuit and generating a reference actual time at least formed by a reference current time unit corresponding to said current time unit of the actual time displayed.

Furthermore, according to the invention, the electronic correction circuit is arranged and the duration of the detection phase is provided to allow the detection device to detect, when the drive mechanism is running and timed by the oscillating mechanical resonator, at least a passage of said indicator through any reference time position from said at least one reference time position. The electronic correction circuit is arranged such that it can determine at least one moment at which said indicator passes through said any reference time position on the basis of at least one measurement value from the plurality of measurement values, this moment of passage being determined by the internal time base and formed by at least the value of said reference current time unit at said moment of passage. Said electronic correction circuit is further arranged such that it can determine a time error of said indicator, by comparing said at least one moment of passage with said reference time position, and an overall time error for the display (i.e. for the set of indicators) as a function of at least said time error of said indicator.

Moreover, according to the invention, the control unit is arranged such that it can control the braking device as a function of the overall time error determined. The device for correcting the actual time displayed is arranged such that, when a non-zero overall time error has been determined by the electronic correction circuit, the braking device can act, during a correction period, on the mechanical resonator, as a function of the overall time error, to vary the running of the drive mechanism of the display so as to correct at least part of this overall time error, advantageously to correct a large part of this overall time error and preferably to correct substantially all thereof.

The term 'braking device' is understood to mean, in general, any device capable of braking and/or halting an oscillating mechanical resonator and/or momentarily keeping such a resonator at a halt (i.e. blocking same). The braking device can be formed by one or more braking units (one or more actuators). In the case where the braking device is formed by a plurality of braking units, in particular two braking units, each braking unit is selected to act on the mechanical resonator in a specific situation relative to the required correction, in particular a first braking unit to correct a loss and a second braking unit to correct a gain (the second braking unit being advantageously arranged such that it can halt and momentarily block the resonator). The phrase 'time the running of a drive mechanism of a display' is understood to mean setting the pace of the motion of wheel sets of this mechanism when in operation, in particular determining the rotational speeds of these wheel sets and thus of at least one indicator of the display. In the description below, when the term 'resonator' is used without any specific qualifier, it denotes a mechanical resonator. An oscillating resonator is used to describe a resonator that is considered to be in its activated state, wherein it oscillates and is sustained, via an escapement, by a mechanical energy source.

Although the indicators used to display the actual time all concern the same physical magnitude, the time, in this description, the hour, the minute and the second are considered to be three different time units given that they are respectively associated with three separate indicators. The actual time displayed by a display is formed by a current hour, a current minute and a current second, which will sometimes be qualified as 'displayed'. The current second displayed has an integer part in seconds and optionally one or more decimals (dial generally without decimal graduations, however the decimal part is present in an analogue display where the near-continuous advancing of the hand normally takes place in steps timed by the escapement at double the frequency of the oscillating resonator). The current minute displayed has an integer part in minutes (minute integer) and generally a fractional part (sexagesimal part) in seconds (always the case for an analogue display displaying the actual time). The current hour displayed comprises an integer part (and only this integer part with a 'jumping' hour change). The reference actual time provided by an internal time base of the electronic type is formed by a reference current hour, a reference current minute and a reference current second. These three components are integers. Moreover, the internal time base can optionally provide fractions of a second. In general, the internal time base, which is of the electronic type, provides a reference actual time which can be formed by fewer time units than the actual time, and in particular only contain the reference current minute and the reference current second, optionally in addition to a current fraction of a second generated by a clock circuit forming this internal time base.

In one main embodiment of the invention, the display comprises an hours indicator giving the current hour, a minutes indicator giving the current minute and a seconds indicator giving the current second of the actual time displayed, and the reference actual time generated by the internal time base is formed by at least a reference current second and a reference current minute. The detection device is arranged such that it can detect the passage of the seconds indicator through at least a first reference time position of the display and the passage of the minutes indicator through at least a second reference time position of this display. The electronic correction circuit is arranged and the duration of the detection phase is provided to allow the detection device to detect, during this detection phase, when said drive mechanism is running and timed by the oscillating mechanical resonator, at least a passage of the seconds indicator through a first reference time position from said at least one first reference position and at least a passage of the minutes indicator through a second reference time position from said at least one second reference time position.

Furthermore, the electronic correction circuit is arranged such that it can determine, in conjunction with the internal time base and on the basis of measurement values from the plurality of measurement values, at least one first moment of passage of the seconds indicator through said first reference time position, this first moment of passage being determined by the reference actual time and formed at least by the value of the reference current second at said first moment of passage, and at least one second moment of passage of the minutes indicator through said second reference time position, this second moment of passage also being determined by the reference actual time and formed at least by the value of the reference current minute at said second moment of passage. Moreover, the processing unit or the control unit is arranged such that it can determine a first time error for the seconds indicator, by comparing said at least one first moment of passage with the first reference time position, and a second time error for the minutes indicator by comparing said at least one second moment of passage with the second reference time position. The processing unit or the control unit is further arranged such that it can determine an overall time error of the display as a function of the first time error and of the second time error, as well as at least one predetermined processing criterion for these first and second time errors.

In a specific alternative embodiment, during the detection phase, the detection device is activated so as to carry out the plurality of successive measurements at at least one measurement frequency determined by the clock circuit of the internal time base, this clock circuit providing a periodic digital signal at the measurement frequency directly to the detection device or indirectly to this detection device via the control unit.

In one advantageous embodiment, the detection device is arranged in the timepiece such that it can directly detect the passage of an indicator of the display through at least one corresponding reference time position, this indicator being arranged such that it can be detected by the detection device.

In another embodiment, the detection device is arranged in the timepiece such that it can indirectly detect the passage of an indicator of the display through at least one corresponding reference time position, the detection device being arranged such that it can detect at least one respective angular position of a wheel integral with the indicator or a detection wheel, forming the drive mechanism or complementing same, which drives or which is driven by the wheel integral with the indicator, the detection wheel being selected or configured to have a rotational speed that is less than that of the wheel integral with the indicator and a gear ratio R that is equal to a positive integer.

In an advantageous alternative embodiment of the preceding embodiment, the indicator considered is a minutes indicator and the detection wheel is formed by a minute wheel which is driven in rotation by a cannon-pinion bearing this minutes indicator. The detection device comprises at least one detection unit associated with the minutes indicator and arranged to detect at least a first series of R periodic angular positions of the minute wheel, two adjacent angular positions of the first series having a central angle equal to 360°/R therebetween.

In a preferred embodiment, the braking device is formed by an electromechanical actuator, arranged such that it can apply braking pulses to the mechanical resonator, and the control unit comprises a device for generating at least one frequency which is arranged such that it can generate a periodic digital signal at a frequency $F_{SUP}$. The control unit is arranged to provide the braking device, when the overall time error previously determined by the electronic correction circuit corresponds to a displayed time loss that is to be corrected, with a control signal derived from the periodic digital signal, during a correction period, to activate the braking device such that the latter generates a series of periodic braking pulses that are applied to the mechanical resonator at the frequency $F_{SUP}$. The (duration of the) correction period and thus the number of periodic braking pulses in the series are determined by the loss to be corrected. The frequency $F_{SUP}$ is provided and the braking device is arranged such that the series of periodic braking pulses at the frequency $F_{SUP}$ can, during the correction period, result in a synchronous phase wherein the oscillation of the mechanical resonator is synchronised to a correction frequency $FS_{Cor}$ which is greater than a setpoint frequency F0c provided for the mechanical resonator.

According to an advantageous alternative embodiment, wherein the horological movement comprises an escapement associated with the resonator, the frequency $F_{SUP}$ and the duration of the braking pulses of the series of periodic braking pulses are selected such that, during said synchronous phase, each of the braking pulses of said series occurs outside a coupling zone of the oscillating resonator with the escapement.

In one specific embodiment, the timepiece comprises a device for blocking the mechanical resonator. Furthermore, the control unit is arranged such that it can provide the blocking device, when the overall time error determined by the electronic correction circuit corresponds to a displayed time gain that is to be corrected, with a control signal which activates the blocking device such that it blocks the oscillation of the mechanical resonator during a correction period which is determined by the gain to be corrected, in order to stop the running of the drive mechanism during this correction period.

BRIEF DESCRIPTION OF THE FIGURES

The invention will be described in more detail hereinafter using the accompanying drawings, given by way of examples that are in no way limiting, wherein.

DETAILED DESCRIPTION OF THE INVENTION

Figure 1:
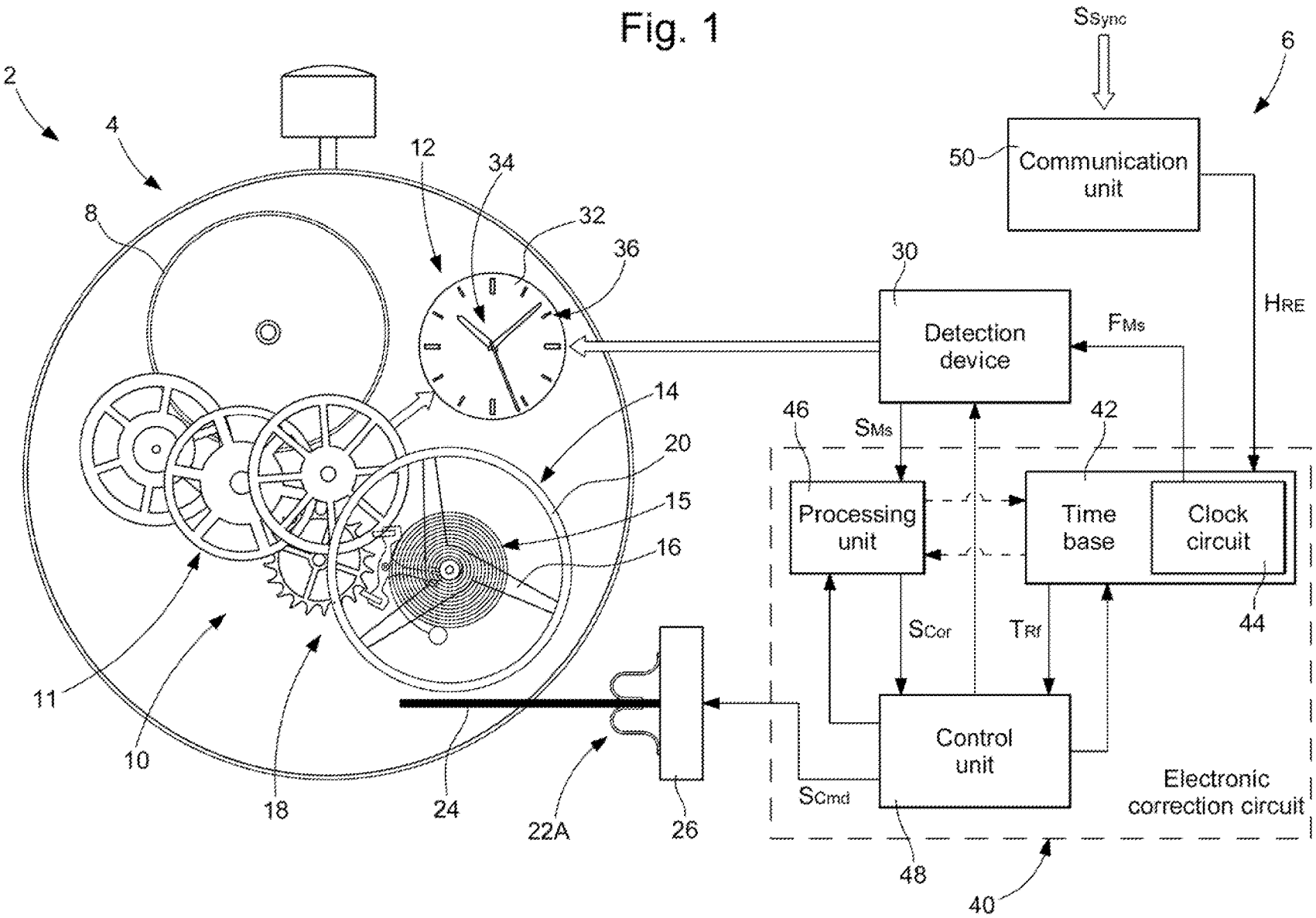
FIG. 1 shows a partially schematic view of a first embodiment of a timepiece according to the invention provided with a mechanical movement, a time display, a detection device for the display, and a device for correcting the displayed time.

With reference to FIG. 1 to 7, the description hereinbelow will describe a first embodiment of a timepiece according to the invention, which incorporates a first embodiment of a detection device for the display.

The timepiece 2 comprises a mechanical movement 4, an analogue time display 12, a drive mechanism 10 for driving this display and a device 6 for correcting the actual time indicated by the display. The timepiece is a wristwatch conventionally comprising a case 220 and a crown 52 forming an external control member for enabling the hands of the display to be manually set via an internal control stem integral with the crown. Generally, during manual setting of the hands using the stem-crown, the mechanical time correction system acts on a minute wheel directly engaged with a cannon-pinion bearing the minutes hand and an hours wheel bearing the hours hand. Thus, the hours and minutes hands always retain a kinematic link, even during hand-setting operations. Only an impact could potentially cause an angular displacement of one of these two hands relative to the other, by a sliding of one hand along the axis thereof. However, when setting the hands using the stem-crown, the cannon-pinion is subjected to friction with a wheel set or a wheel of the drive mechanism and thus undergoes an angular displacement relative to the wheel sets of this drive mechanism situated upstream thereof, and thus to the seconds wheel (also named 'fourth wheel') bearing the seconds hand. Through the design of the usual mechanical movements, the seconds hand does not have any given phase relationship with the minutes hand once a hand-setting operation has been carried out via the stem-crown, i.e. in general, there is no determined time/angle relationship between the indication of the current minute and the indication of the current second. When the indicator is precisely aligned with a graduation of the minutes (which is generally also used as a graduation of the seconds when the minutes hand and the seconds hand are coaxial), the seconds indicator takes a time/angular position that is arbitrary (any undetermined position). This in particular concerns timepieces provided with a mechanical movement driving an analogue time display.

The mechanical movement comprises a barrel 8 forming a mechanical energy source for the drive mechanism 10 which is formed by a gear train 11, kinematically linked to the display, a mechanical resonator 14, formed by a balance 16 associated with a balance-spring 15, and an escapement 18 coupling this resonator to the drive mechanism such that the oscillation of the mechanical resonator times the running of this drive mechanism. The analogue display 12 is formed by a dial 32 comprising indexes 36 forming a graduation for the display of the actual time, and by hands 34 comprising an hours hand 34H giving the current hour, a minutes hand 34M giving the current minute, and a seconds hand 34S giving the current second of the actual time displayed. The hands generally have different shapes, in particular different lengths and/or widths.

The correction device 6 comprises a detection device 30 for the analogue display 12, an electronic correction circuit 40, a communication unit 50 and a device 22, 22A for braking the mechanical resonator 14. The electronic correction circuit 40 comprises:

- a control unit 48 arranged such that it can control the detection device such that this detection device carries out, during a detection phase, a plurality of successive measurements and provides a plurality of corresponding measurement values,
- a processing unit 46 arranged such that it can receive, from the detection device, said plurality of measurement values, via a measurement signal SMs, and process same,
- an internal time base 42 comprising a clock circuit 44, this internal time base generating a reference actual time TRf at least formed by a reference current second and a reference current minute.

It should be noted that the present invention is not limited to an analogue display of the actual time, but can also concern other displays displaying the actual time, for example a display with a 'jumping hour change' and/or in particular a 'jumping minute change'. The display is thus not limited to a system with hands advancing in a near-continuous manner. The invention can thus further apply in particular to a system with discs or rings and in particular a display provided through at least one aperture machined in the dial.

The timepiece 2 is arranged so as to allow the actual time indicated by the display thereof to be corrected as a function of an overall time error for this display, which is determined inside the timepiece by the electronic correction circuit 40 associated with the detection device 30, which is arranged such that it can detect the passage of the seconds hand 34S through at least a first reference time position of the display and the passage of the minutes indicator 34M through at least a second reference time position of this display. In order to correct the actual time displayed, the correction device generally comprises a device for braking the mechanical resonator. In a main alternative embodiment, the braking device is formed by an electromechanical actuator, for example an actuator of the piezoelectric type 22A. Furthermore, the braking device is controlled by a control unit 48 which transmits a control signal $S_{Cmd}$ thereto in order to control the power supply circuit thereof so as to manage the timing of the application of a mechanical braking force on the mechanical resonator 14. In general, the correction device is arranged such that the braking device can act, whenever an overall time error has been determined by the electronic correction circuit, on the mechanical resonator during a correction period to vary the running of the drive mechanism so as to correct, at least in part, this overall time error.

In the alternative embodiment shown, the actuator 22A comprises a braking member formed by a flexible strip 24, which has, on two opposing surfaces (perpendicular to the plane in FIG. 1), respectively two piezoelectric layers, each of which is coated in a metal layer forming an electrode. The piezoelectric actuator comprises a power supply circuit 26 allowing a certain voltage to be applied between the two electrodes so as to apply an electric field through the two piezoelectric layers, which are arranged so as to curve the strip 24 towards the felloe 20 of the balance 14, when a voltage is applied between the two electrodes, so that the end part of the strip, forming a moving brake pad, can be pressed against the outer circular surface of the felloe and thus exert a mechanical braking force on the mechanical resonator. It should be noted that the voltage can be variable, in order to vary the mechanical braking force and thus the mechanical braking torque applied to the balance. As regards the braking device, reference can be made to the international patent document WO 2018/177779 for various alternative arrangements of such a braking device in a mechanical clock movement. In a specific alternative embodiment, the braking device is formed by a strip actuated by a magnet-coil system. In another specific alternative embodiment, the balance comprises a central staff defining or bearing a part in addition to the felloe of the balance, for example a disc, defining a circular braking surface. In the case above, a pad of the braking member is arranged so as to apply a pressure against this circular braking surface upon the momentary application of a mechanical braking force.

The first embodiment of the timepiece incorporates a first embodiment of the detection device, described hereinbelow with reference to FIG. 2 to 6, which is different in that it allows for direct detection of the passage of at least one indicator of the analogue display 12, relative to a time unit of the actual time, through at least one reference time position of this display which is relative to said time unit, this indicator being arranged such that it can be detected by the detection device. The description of the first embodiment of the timepiece 2 will be essentially provided within the scope of the main embodiment, wherein the detection device is arranged such that it can detect the passage of the seconds indicator through at least a first reference time position of the display and the passage of the minutes indicator through at least a second reference time position of this display, and wherein the measurements for these two indicators are exploited in each correction cycle to correct the current minute and the current second of the actual time displayed.

Figure 2:
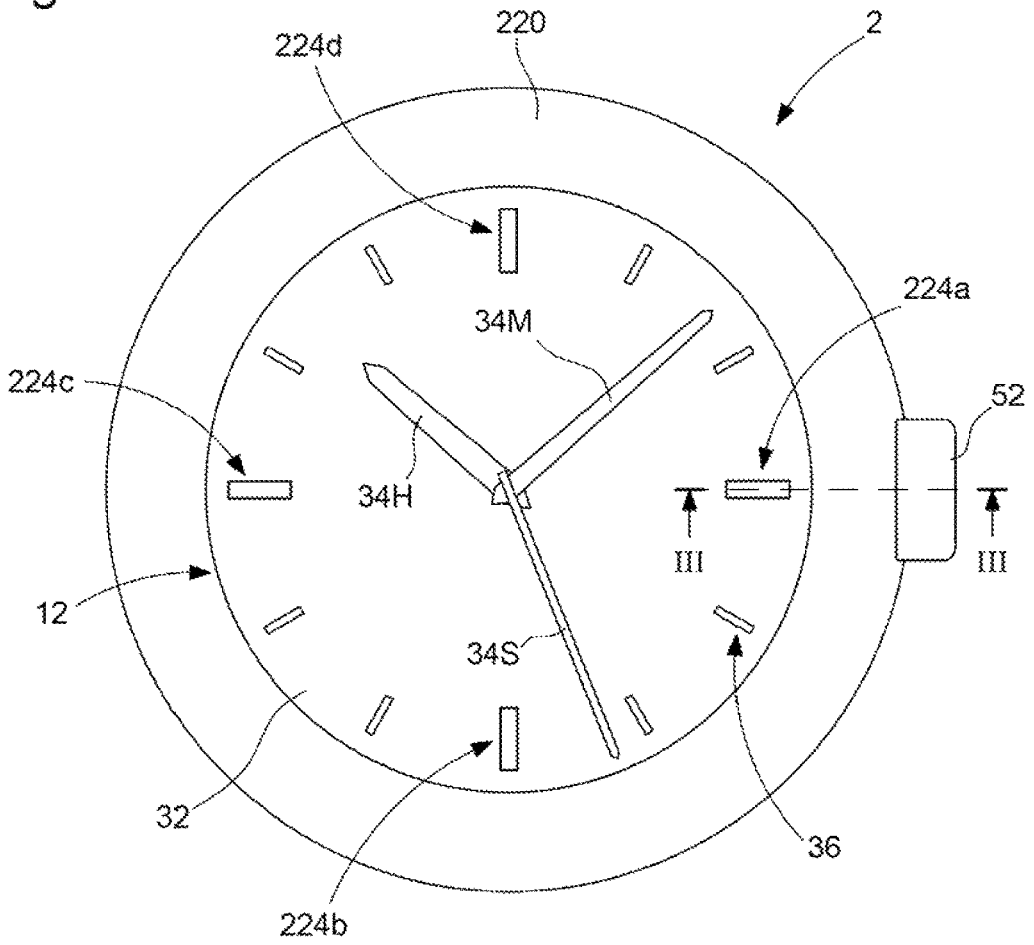
FIG. 2 is a top view of the timepiece in FIG. 1.

In the advantageous alternative embodiment shown in FIG. 2, the detection device 30 is of the optical type and comprises four detection units 224*a*, 224*b*, 224*c* and 224*d* which respectively define four reference time positions for the seconds hand 34S (15 s, 30 s, 45 s and 60 s=0 s) and respectively four reference time positions for the minutes hand 34M (15 min, 30 min, 45 min and 60 min=0 min). It should be noted that in another alternative embodiment, only one detection unit is provided or two diametrically-opposed detection units are provided. It should also be noted that the alternative embodiment shown advantageously provides for the same detection units to detect the passages of the seconds hand and of the minutes hand. However, in another alternative embodiment, different detection units can be provided for the two hands.

In general, the optical detection device comprises at least one light source, each capable of emitting a light beam, and at least one photodetector, each capable of detecting the light emitted by a light source from said at least one light source. The seconds indicator and the minutes indicator each have a reflecting surface which passes through the one or more light beams emitted by at least one light source during passages of the indicator considered through at least one reference time position corresponding to this indicator and defined by the detection device, in particular opposite at least one detection unit of this detection device. The detection device and the reflecting surface are configured such that this reflecting surface can reflect, upon a passage of the indicator considered through any reference time position from said at least one corresponding reference time position, the incident light, provided by a light source from said at least one light source, at least partially in the direction of a photodetector from said at least one photodetector which is associated with said any reference time position. In a preferred alternative embodiment, the reflecting surface of each indicator considered is formed by a bottom surface of this indicator, and said at least one light source and said at least one photodetector are supported by a dial of the timepiece or housed at least partially in the dial, or situated beneath the dial which is thus arranged to allow the one or more light beams to pass therethrough. In an advantageous alternative embodiment, the light emitted by said at least one light source is not visible to the human eye. The light source in particular emits light in the infrared range.

Figure 3:
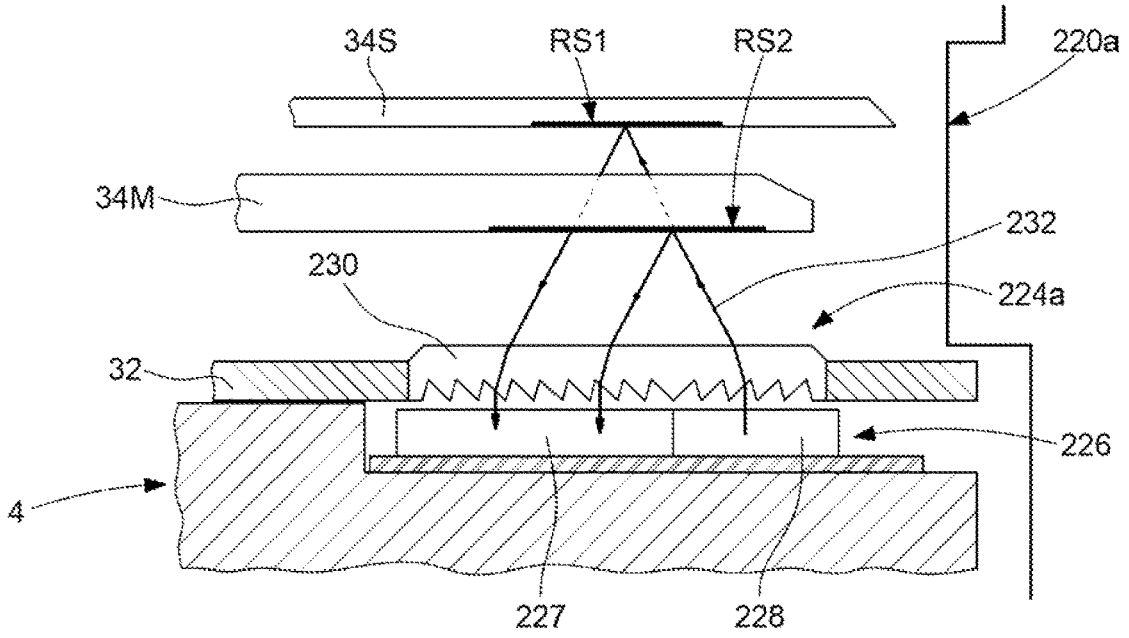
FIG. 3 is a partial cross-sectional view of the timepiece in FIGS. 1 and 2, according to a first alternative embodiment of a first embodiment of the detection device.
Figure 4A:
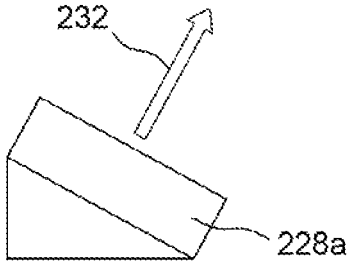
FIG. 4A to 4D are schematic cross-sectional views of various alternative embodiments for a light source forming the detection device according to the first embodiment.
Figure 4B:
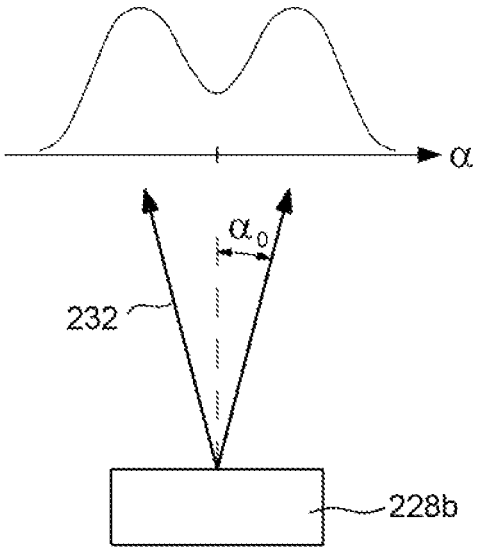
Figure 4C:
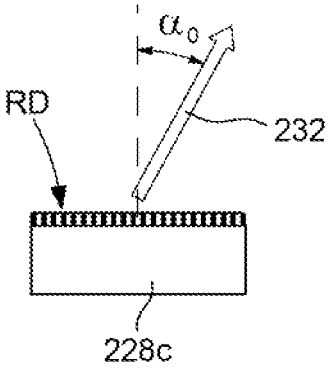
Figure 4D:
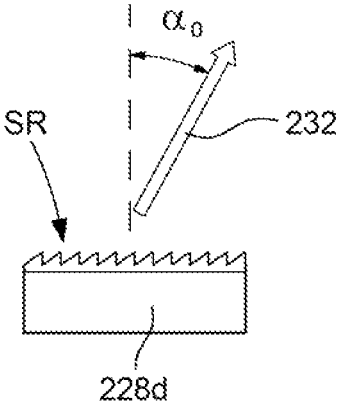

FIG. 3 is a partial cross-section of the watch in FIG. 2, made through the detection unit 224*a* of the optical detection device 30. It can be seen that the four detection units are similar. The case of the watch is shown via the internal profile 220*a* thereof. The detection unit 224*a* comprises an optical sensor 226 formed by a light source 228, which emits a light beam 232, and a photodetector 227 capable of detecting the light emitted by the light source, the source and the detector being aligned in a radial direction relative to the central axis of the watch about which the seconds hand and the minutes hand turn. The optical sensor 226 is arranged beneath the dial 32 and is supported by the plate of the mechanical movement 4. The dial has an opening in which a small glass plate 230 is arranged, having, at the bottom surface thereof, a saw-tooth profile forming two refraction gratings (series of oblique parallel planes) intended to respectively refract the light emitted by the source 228 and the incident light on the detector 227 after reflection by either of the two hands 34M and 34S. The small plate can be made of another substance that has a sufficient level of transparency for the light emitted by the source 228, in particular for infrared light where appropriate. It should be noted that the small plate can also form a top element of the sensor 226 and thus be inserted into the opening of the dial when assembling the optical sensor with the dial.

The optical detection unit 224*a* is noteworthy in that the electronic units forming the light source and the photodetector are arranged on a common substrate in a general plane parallel to the dial 32 with the light emitted having a main direction (optic axis) that is perpendicular to this general plane, however the light beam 232 is oblique. A layer of air between the small plate and the sensor 226 is an advantage for obtaining a relatively high angle of deflection of the light relative to the vertical direction, i.e. perpendicular to the dial. Thanks to such an arrangement, although the light emitted by the source 228 has a vertical optic axis, the reflective zones RS1 and RS2 defined respectively by the two bottom surfaces of the seconds hand 34S and of the minutes hand 34M are planar and horizontal. Thus, given that the bottom surfaces of conventional hands are planar and parallel to the dial, the detection device requires little intervention on the hands, or no intervention at all for metal or metal-coated hands. A polished surface in the zones RS1 and RS2 is an advantage. It should be noted that the two hands 34M and 34S are shown, in FIG. 3, one above the other to facilitate understanding of the operation of the optical detection unit for each of the two hands; however, detection of the seconds hand is provided for in the absence of the minutes hand above the detection unit.

Given that the photodetectors are often adapted to receive light having an oblique incidence (up to a certain angle of incidence), the issue concerning the desire for planar and horizontal reflecting surfaces for the hands primarily concerns the light source. FIG. 4A to 4D show four specific alternative embodiments for the light source of the optical detection units. In the first simple alternative embodiment, the light source 228*a*, for example a diode of the LED (Light-Emitting Diode) type or a laser diode of the VCSEL (Vertical-Cavity Surface-Emitting Laser) type is arranged obliquely on a support. This first alternative embodiment has the drawback of increasing the height of the device to a certain extent. The second alternative embodiment involves the use of a feature of non-collimated conventional laser diodes of the VCSEL type naturally having a light intensity profile, shown in FIG. 4B, with a maximum having an angular deflection relative to the perpendicular direction. The light beam 232, in a plane passing through the central axis thereof, thus has two symmetrical main directions with an angular deflection $\alpha_0$. A laser diode having a relatively high angular deflection will be selected. In the third alternative embodiment, the light source 228*c* has, at the emitting surface thereof, a diffraction structure RD which diffracts the light beam mainly in a given oblique direction. Finally, the fourth alternative embodiment is similar to the alternative embodiment shown in FIG. 3. The light source 228*d* has, on the emitting surface thereof, a transparent structure whose top surface has a saw-tooth profile which forms a refraction grating RD (series of oblique parallel planes) intended to refract the light emitted by the source 228*d*. Whereas the inclined planes in FIG. 3 have an angle of about 45°, the inclined planes of the refraction grating RD have a smaller angle relative to the horizontal direction (for example 35°), so as to have an angle of refraction for the light beam 232 that allows it to pass through the transparent structure.

Figure 5A:
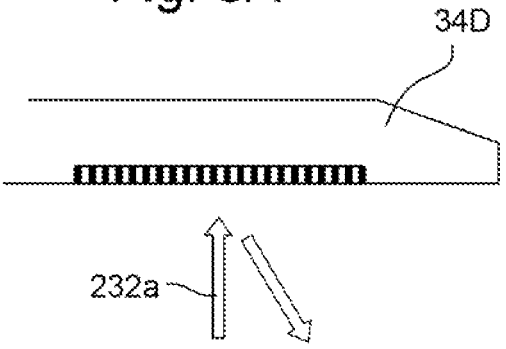
FIGS. 5A and 5B are partial schematic cross-sectional views of two alternative configurations for a hand, the passage whereof over at least one photodetector forming the detection device of the timepiece in FIGS. 1 and 2 is to be detected.
Figure 5B:
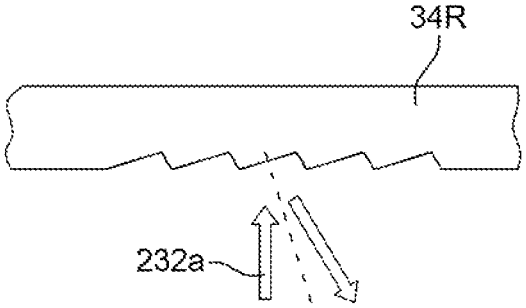

FIGS. 5A and 5B show two alternative embodiments, wherein a specific treatment of the bottom surfaces of the hands concerned is accepted. It should be noted that these two alternative embodiments can complement the alternative embodiments described hereinabove. In FIG. 5A, the hand 34D has a reflecting diffraction grating in a zone of the bottom surface thereof that passes through the incident beam 232*a* (beam having a normal direction) during the passage thereof over an optical detection unit. In FIG. 5B, the hand 34R has a reflection grating in a zone of the bottom surface thereof that passes through the incident beam 232*a* during the passage thereof over an optical detection unit.

In general, the detection device comprises U detection units for the seconds indicator and Q detection units for the minutes indicator, wherein some of these detection units can be common to both hands. In the alternative embodiment shown, four detection units common to both indicators are provided. The U detection units define U reference time positions X0(*u*), u=1 to U, for the seconds indicator, and the Q detection units define Q reference time positions Y0(*q*), q=1 to Q, for the minutes indicator. Four detection units for the minutes indicator allow this indicator to be detected in a time interval of about 15 minutes.

The aforementioned detection device is of the optical type. However, it should be noted that the detection device can be of another type, in particular of the capacitive, magnetic or inductive type. A detection unit of the capacitive, magnetic or inductive type can be subjected to the same control as that described for an optical detection unit and the same processing of the measurements taken can be provided within the scope of a correction cycle according to the present invention, which results in the same correction of the actual time displayed.

A detection phase will now be described with reference to FIG. 6, which detection phase is intended to take place at the start of a cycle for correcting the time displayed, for the main embodiment wherein the reference actual time $T_{Rf}$ generated by the internal time base 42 is formed by at least a reference current second $X_R$ and a reference current minute YR.

Firstly, the electronic correction circuit 48, 48A is arranged and the duration of the detection phase is provided to allow the detection device to detect, during this detection phase, when the drive mechanism 10 (FIG. 1) is running and timed by the oscillating mechanical resonator 14, at least a passage of the seconds indicator 34S through a reference time position from among the reference time positions X0(*u*), u=1 to U, and at least a passage of the minutes indicator through a reference time position from among the reference time positions Y0(*q*), q=1 to Q. The electronic correction circuit is arranged such that it can determine, in association with the internal time base 42 and on the basis of measurement values from a plurality of measurement values, at least a first moment of passage $T_{X0}$ of the seconds indicator through any reference time position, denoted by X0, from among the reference time positions provided for this seconds indicator, this first moment of passage being formed at least by a corresponding value of the reference current second $X_R$, and at least a second moment of passage $T_{Y0}$ of the minutes indicator through any second reference time position, denoted by Y0, from among the reference time positions provided for this minutes indicator, this second moment of passage being formed at least by a corresponding value of the reference current minute YR. In the explanations herein below, the seconds hand is thus detected by a detection unit when passing through the reference time position X0, and the minutes hand is thus detected by a detection unit when passing through the reference time position Y0.

In order to detect the passage of an indicator through a reference time position, a plurality of measurements are carried out at a measurement frequency $F_{Ms}$. Each measurement gives a measurement value and occurs at a determined moment of measurement. For this purpose, the measurements are carried out during short time intervals. In the case of an optical detection unit of an optical detection device, the light source is periodically activated at the measurement frequency $F_{Ms}$ to generate a plurality of light pulses, and the photodetector provides a plurality of corresponding light intensity values.

In a first general alternative embodiment, during the detection phase, the detection device is activated so as to carry out a plurality of successive measurements at at least one measurement frequency which is determined by the clock circuit 44 of the internal time base 42, this clock circuit providing a periodic digital signal at the measurement frequency $F_{Ms}$ directly to the detection device or indirectly to this detection device via the control unit. In a preferred alternative embodiment, the measurement frequency is variable and the correction device 6 is arranged such that it can detect the passage of the seconds indicator through the reference time position X0 with a first measurement frequency $FS_{Mes}$ and the passage of the minutes indicator through the reference time position Y0 with a second measurement frequency $FM_{Mes}$ that is less than the first measurement frequency. In a specific alternative embodiment, the first measurement frequency $FS_{Mes}$ is provided such that it is less than three times a setpoint frequency F0c for the mechanical resonator 14 and greater than or equal to 1 Hz, i.e. 1 Hz<=$FS_{Mes}$<3·F0c, whereas the second measurement frequency $FM_{Mes}$ is provided such that it is less than or equal to ⅛ Hz ($FM_{Mes}$<=⅛ Hz).

It can be advantageous, so that the detection units can correctly carry out the measurements and to slightly increase the precision of the determination of the moments of passage of the two hands through the respective reference time positions thereof, for the seconds hand to be substantially unmoving during the measurements. In the case, for example, of a mechanical resonator substantially oscillating at 4 Hz and the measurement frequency for the seconds hand corresponding to 4 Hz or 8 Hz, all of the measurements can take place during pulses for sustaining the mechanical resonator and thus when the escape wheel is rotating as well as the seconds wheel bearing the seconds hand. To prevent the majority of the measurements from taking place when the seconds hand is undergoing a small rotational motion, in an advantageous alternative embodiment, the first measurement frequency $FS_{Mes}$ has a value that is different from double the setpoint frequency F0c divided by a positive integer N, i.e. $FS_{Mes}$·2·F0c/N.

In another more developed alternative embodiment, the measurement frequency is determined by the mechanical resonator in conjunction with the clock circuit. The device for correcting the actual time displayed thus comprises a sensor associated with the mechanical resonator and arranged such that it can detect the passages of the oscillating resonator through the neutral position thereof, corresponding to the position of minimum potential energy thereof. During the detection phase, the detection device is activated and controlled by the control unit associated with the internal time base to carry out a plurality of successive measurements, each following the detection of a passage of the mechanical resonator through the neutral position thereof and after a certain time difference from this detection. Preferably, this time difference lies in the range T0c/8 to 3·T0c/8, where T0c is the setpoint period which is equal to the inverse of the setpoint frequency. For this purpose, the clock circuit 44 is arranged to provide the control unit with a periodic signal at a frequency equal to 8/T0c or close thereto. The sensor provides the control unit with a signal indicating when the mechanical resonator passes through the neutral position thereof. After this moment, the control unit activates reception of the signal provided by the clock circuit at the frequency that is about equal to 8/T0c and counts two rising or falling edges in the periodic signal. At the second edge considered, the control unit initiates a measurement and thus a light pulse. If desired, the moment of each measurement can thus be known. Since the clock circuit and the mechanical resonator are not synchronised, the time difference will be in the aforementioned range of values. With a time difference in this range, the pallet-wheel is at a halt and the seconds hand is thus unmoving during the measurements. In this developed alternative embodiment, the measurement frequency is equal to 2·F0c if a measurement is carried out upon each detection of a passage of the resonator through the neutral position thereof. If a measurement is carried out every N detections, the measurement frequency is substantially equal to 2F0c/N. It can be seen that, for the processing of the measurements which will be described hereinbelow, the hypothesis that the natural frequency F0 of the resonator is equal to F0c can be made, such that $F_{Ms}$=2·F0c/N. If a watch has a high daily error, i.e. for example 14 seconds per day, this corresponds to an error of 10 ms per minute. Since a minute is a sufficient detection period for the seconds hand, such an error is insignificant for the calculation of a time error for this hand.

Figure 6:
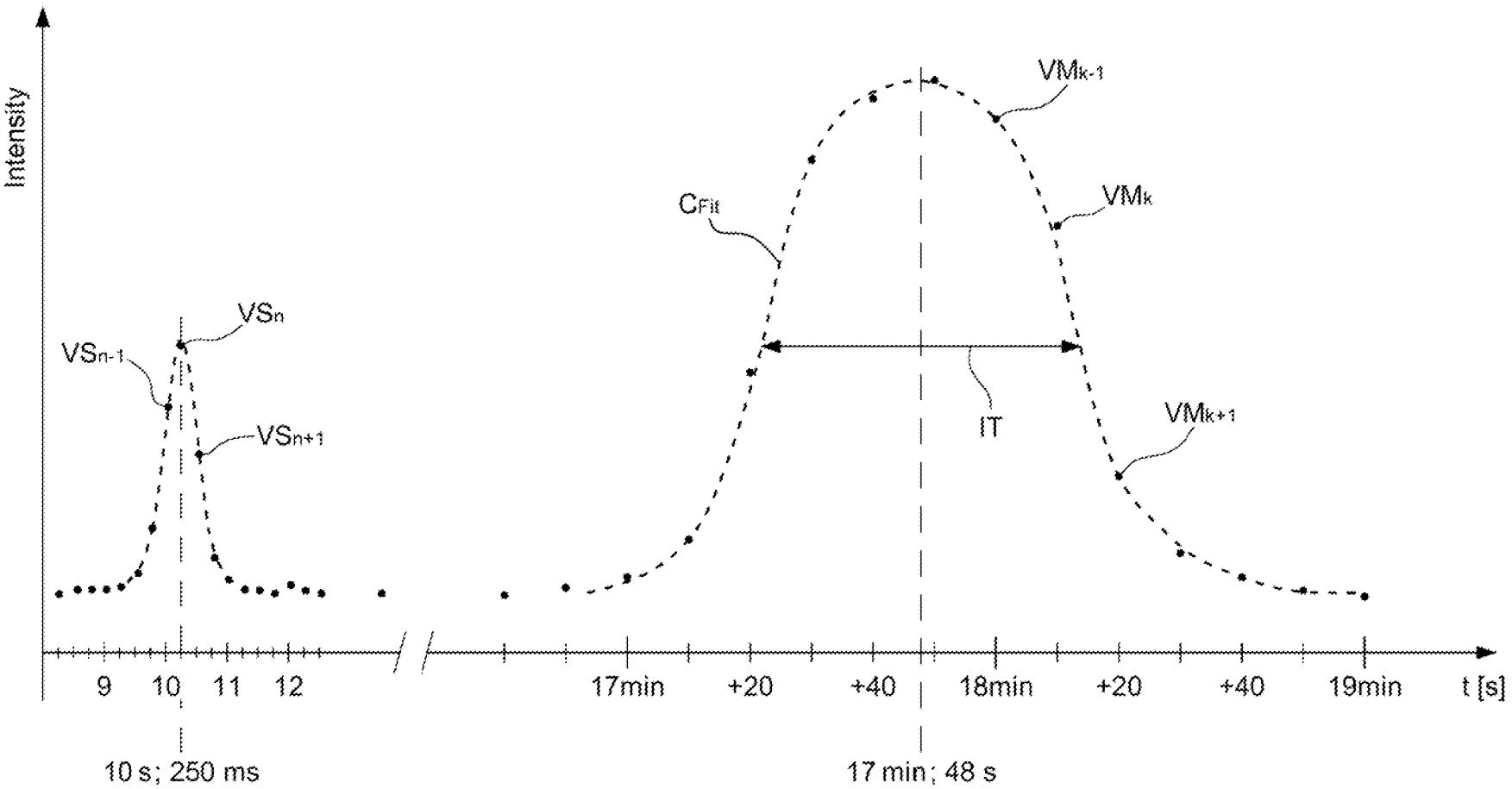
FIG. 6 shows a plurality of measurement values provided by the optical detection device, according to the first embodiment, during a detection phase allowing a time error of the seconds hand and a time error of the minutes hand to be determined.

FIG. 6 shows a first series of measurements carried out for the detection of the seconds hand at a first frequency $FS_{Ms}$=4 Hz, preferably using the developed alternative embodiment described hereinabove if the setpoint frequency for the mechanical resonator is also equal to 4 Hz, and a second series of measurements at a second frequency $FM_{Ms}$=1/10 Hz (every 10 seconds to save energy) since the minutes hand rotates 60 times slower than the seconds hand and generally has a larger width. It can be seen that 4 Hz can easily be derived from the clock circuit 44 which is arranged to supply second pips to the time base for measuring the reference actual time. The frequency $FM_{Ms}$ is generated by a ten-cyclic counter, incremented by the second pips associated with the control unit.

The first series of measurements gives a first series of intensity values $VS_n$, where n is a positive integer, to which corresponds a first series of moments of measurement $TS_n$. The second series of measurements gives a second series of intensity values $VM_k$, where k is a positive integer, to which corresponds a second series of moments of measurement $TM_k$. Thus, a pair of values $VS_n$ and $TS_n$, respectively $VM_k$ and $TM_k$ corresponds to each measurement.

For the processing phase that follows the detection phase, no recording of the reference actual time corresponding to each measurement during the detection phase is provided for, however the numbering or classification in chronological order of the measurements of each series of measurements is provided for, in addition to the establishment of a time relation with the reference actual time $T_{Rf}$ for each series of measurements. In the case of numbering that associates a number n, respectively k, with each value $VS_n$, respectively $VM_k$, the periodic digital signal at the measurement frequency $F_{Ms}$ (periodic measurement signal) can also be provided to the processing unit 46 that receives the measurement values via a signal SMs provided thereto by the detection device, either directly or via the control unit. In the case of a classification in chronological order, the rank of the measurement value can suffice for determining the corresponding moment of measurement. Two successive measurements of the same series are known to be separated by a period TMs which is the inverse of the measurement frequency $F_{Ms}$. If, for a moment X, respectively Y, given by the periodic measurement signal, the control unit or directly the processing unit stores in memory the corresponding reference actual time $TS_{Rf,X}$ for the seconds hand, respectively $TM_{Rf,Y}$ for the minutes hand, and if a number of periods of the periodic measurement signal is determined between the reference actual time stored in memory and a measurement of rank n, respectively of rank k, then the rank (or the number) of each measurement corresponds to a determined reference actual time. This temporal relationship can be mathematically expressed as follows:

$$TS_n=(n-X)/FS_{Ms}+TS_{Rf,X}$$

$$TM_k=(k-Y)/FM_{Ms}+TM_{Rf,Y}$$

One specific case concerns X=Y=0. The control unit waits for a second pip which defines an initial time for a series of measurements and as soon as it receives it, on the one hand it activates the detection device or it takes into consideration the measurements that only occurred after this initial moment, with the exception of this initial moment, and on the other hand it records the reference actual time $TS_{Rf,X}$, respectively $TM_{Rf,0}$. The following is thus obtained:

$$TS_n=n/FS_{Ms}+TS_{Rf,0} \text{ where } n=1 \text{ to } N$$

$TM_k=k/FM_{Ms}+TM_{Rf;0}$ where $k=1$ to $K$ where N and K are the measurement numbers for the detection of the seconds hand and of the minutes hand respectively.

The processing unit 46 processes each series of measurements to determine the first moment of passage $T_{X0}$ of the seconds indicator through the reference time position X0 and the second moment of passage $T_{Y0}$ of the minutes indicator through the reference time position Y0. Various methods for processing the measurement data can be used. By way of example, the two examples with reference to FIG. 6 are mentioned, in addition to a simplified example. To determine the value $T_{X0}$, since the seconds hand is relatively thin and rotates relatively quickly, an algorithm determines the maximum value $VS_{max}$ to which corresponds a rank/number $n=Z_E$.

Thus, $T_{X0}=Z_E/FS_{Ms}+TS_{Rf;0}$

In FIG. 6, $T_{X0}$=10 s and 250 ms ($T_{X0}$=10.25 s).

To determine the value $T_{Y0}$, an algorithm determines a width, corresponding to a time interval IT, substantially halfway along the height of a symmetric convex curve $C_{Fit}$ adjusted to the series of measurement values $VM_k$ to be able to determine a mid-value of this width, this mid-value defining the moment of passage $T_{Y0}$ of the mid-longitudinal axis of the minutes hand through the reference time position Y0, which is defined by the mid-radial axis of the detection unit concerned/by the radial direction of alignment of the light source and of the photodetector. It can be seen that the time interval IT is a characteristic parameter of the indicator concerned which allows it to be differentiated from the other indicators. Moreover, the maximum light intensity detected in also a characteristic parameter of the indicator considered. For the data processing, the algorithm implemented in the processing unit advantageously uses the numbers/ranks k corresponding to the values $VM_k$. It can be seen here that the value $T_{Y0}$ does not correspond to a rank/number in integer form (the measurements here occurring only every 10 seconds), but corresponds to an intermediate fractional number $Z_F$ between two adjacent ranks/numbers.

Thus $T_{Y0}=Z_F/FM_{Ms}+TM_{Rf;0}$

In FIG. 6, $T_{Y0}$=17 minutes and 48 seconds ($T_{Y0}$=17 min; 48 s). $T_{Y0}$ is thus an integer $PM_{Y0}$ in minutes (integer part of $T_{Y0}$) corresponding to the reference current minute during the passage of the indicator through the reference time position Y0, to which is added a value $PS_{Y0}$ in seconds which defines a fractional part for the current minute given by the minutes indicator during the passage of the indicator through the reference time position Y0, this value $PS_{Y0}$ corresponding to the reference current second during the passage of the minutes indicator through the reference time position Y0. Thus $T_{Y0}=(PM_{Y0}; PS_{Y0})$. It can be seen that the value $PS_{Y0}$ can optionally have decimals. In a simplified alternative embodiment, $PS_{Y0}$ can be ignored, however this causes a significant loss of precision for the minutes hand. Thus, in the main embodiment, the moment of passage of the minutes hand through a reference time position (which generally corresponds to an integer in minutes) is generally determined with an integer part in minutes and a fractional part in seconds (sexagesimal part), this determination being preferably carried out with a precision in the order of one second or less than one second.

In the two processing methods described hereinabove, in general, the control unit and/or the processing unit is/are connected to the internal time base so as to be able to save in memory the reference actual time at at least one given moment of the detection phase. The electronic correction circuit is arranged such that it can determine, during the detection phase, at least a first moment of measurement and a second moment of measurement respectively corresponding to at least a first measurement and a second measurement from among a series of successive measurements, these first and second moments of measurement being determined by the internal time base. The first moment of measurement is formed by at least a corresponding first value of the reference current time unit and the second moment of measurement is formed by at least a second value of this reference current time unit. Furthermore, the electronic correction circuit is arranged such that it can calculate, as a function of said at least a first moment of measurement and a second moment of measurement, and of the corresponding measurement values, a third moment which determines the moment of passage of the indicator considered through the reference time position concerned.

In a simplified alternative embodiment, the moment of passage of a hand through a reference time position is determined by comparing each measurement value received by the processing unit directly with a threshold value provided for this hand. As soon as the processing unit detects that the value of a measurement exceeds this threshold value, it assigns the moment of this measurement to the moment of passage and it records the value of the reference actual time directly after this detection. This simplified alternative embodiment is less precise, but it requires low electronic resources. The electronic correction circuit can thus be simplified.

After determining the moments of passage as described hereinabove, the electronic correction circuit is arranged such that it can determine a first time error for the seconds indicator, by comparing at least one first moment of passage of this seconds indicator with a corresponding first reference time position, and a second time error for the minutes indicator by comparing at least one second moment of passage of this minutes indicator with a corresponding second reference time position. In a general alternative embodiment, the determination of the first time error and of the second time error is carried out by the processing unit, which subtracts the value of the corresponding reference time position from the moment of passage determined.

For the seconds indicator and the minutes indicator, the two respective time errors $E_S$ and $E_M$ are given by:

$E_S=T_{X0}-X0$; $E_M=T_{Y0}-Y0$

By design, X0 corresponds to an integer in seconds and Y0 corresponds to an integer in minutes, i.e. Y0=(Y0; 0). $E_S$ is given in seconds, optionally with one or more decimals since $T_{X0}$ is normally determined with decimals (better precision than one second). The processing algorithm can decide to keep only one decimal for example. Since the moment of passage $T_{Y0}$ determined for the minutes indicator has an integer part $PM_{Y0}$ in minutes and a fractional part $PS_{Y0}$ in seconds, the time error $E_M$ is determined with an integer part $E_{Mm}$ in minutes and a fractional part $E_{Ms}$ in seconds ($E_{Ms}$ is thus added to $E_{Mm}$). According to the chosen notation: $E_M=(E_{Mm}; E_{Ms})$. It can be seen that $E_{Ms}$ can take one or more decimals resulting from the calculation carried out for the determination thereof, however the algorithm generally does not retain any decimals for the value $E_{Ms}$ in seconds since this value is already a fractional part for the minutes indicator.

This is formally written as follows:

$E_M=(E_{Mm};E_{Ms})=(PM_{Y0};PS_{Y0})-(Y0;0)=(PM_{Y0}-Y0;PS_{Y0})$.

In the example shown in FIG. 6:

$X0=15$ s and $E_S=10.25-15=-4.75$ s $Y0=(15;0)$ and $E_M=(17;48)-(15;0)=(2;48)$, i.e. 2 min and 48 s.

It can be seen that the fractional part $E_{Ms}$ of the time error $E_M$ relative to the current minute displayed by the minutes indicator is far different from the time error $E_S$ of the current second displayed by the seconds indicator. As described hereinabove, this situation is not abnormal for a conventional mechanical movement since the kinematic link between these two indicators is broken when a user manually sets the hands of the display. A specific problem is thus highlighted, which generally has the following two causes:

1) A display of the actual time is formed by a plurality of separate indicators which are used to represent the passing of time. They are thus all related to the same physical magnitude, time.
2) Conventional mechanical clock movements comprise a manual hand-setting device, which momentarily breaks the kinematic link between, on the one hand, the seconds indicator and, on the other hand, the minutes indicator and the hours indicator. Thus, any time difference, between zero and sixty seconds, normally appears between the fractional part of the current minute displayed by the minutes indicator and the current second displayed by the seconds indicator. As a result, the current minute displayed has, in a visible manner in the presence of a graduation of the minutes and seconds, a fractional part in seconds, the value whereof differs from the integer part of the current second displayed, which is also in seconds. There is thus a difference in seconds between two data displayed, both relating to the seconds.

Within the scope of the present invention, the electronic correction circuit is provided such that it can further determine an overall time error $T_{Err}$, for the display of a watch of the mechanical type, as a function of the first time error determined for the seconds indicator, of the second time error determined for the minutes indicator, and of at least one predefined correction criterion which selects a manner for processing the first and second time errors to determine an overall time error for the display of the timepiece.

In a preferred processing mode of the main embodiment, in a main alternative embodiment where the minutes indicator is of the analogue type, two correction criteria are established, i.e.:

Criterion No. 1: After correction, the seconds indicator must correctly indicate the current second, that is to say as accurately as possible.

Criterion No. 2: After correction, the residual error in seconds for the minutes indicator must be greater than or equal to a maximum selected loss $T_{max}$, i.e. greater than or equal to $-T_{max}$.

Thus, a main alternative embodiment provides that at least the minutes indicator, from among the set of indicators, is of the analogue type, this minutes indicator displaying the minutes as a positive integer and a fractional part which is variable. Furthermore, the timepiece further comprises a hand-setting device which is arranged to momentarily break the kinematic link between the minutes indicator and the seconds indicator to set the hands of said display. Finally, the electronic correction circuit is arranged such that it can determine an overall time error $T_{Err}$ for the display as a function of at least one predefined correction criterion for the seconds indicator and/or the minutes indicator in addition to the first and second time errors respectively related to the seconds and minutes indicators.

In a preferred alternative embodiment, the overall time error is determined so as to substantially correct the first time error for the seconds indicator during said correction period.

In an advantageous alternative embodiment, the overall time error is determined such that the minutes indicator has, at the end of the correction period, for the case whereby this minutes indicator thus has a time difference corresponding to a loss, at most a maximum loss which is selected in the range of values of the fractional part of the current minute displayed, i.e. a loss of between zero and sixty seconds.

In a preferred alternative embodiment, the processing algorithm implemented in the processing unit 46 to determine the overall time error $T_{Err}$ includes the following:

Calculation of a cumulative error $EC_{Ms}$, relative to the fractional part in seconds of the current minute displayed by the minutes indicator, by theoretically applying the first correction criterion, i.e. by subtracting the time error $E_S$ of the seconds indicator from the fractional part $E_{Ms}$ of the time error $E_M$ of the minutes indicator, i.e.: $EC_{Ms}=E_{Ms}-E_S$ Integer division of the cumulative error $EC_{Ms}$ by sixty (this operation is denoted as '$EC_{Ms}$ modulo 60'), which gives a quotient $Q_M$ (integer in minutes) and a remainder $R_S$ in seconds (positive).

Selection of a maximum loss $T_{max}$ for the minutes indicator, according to the second correction criterion.

Determination of an overall error $E_{MG}$ for the value relative to the minute in the overall time error $T_{Err}$, this overall error $E_{MG}$ being capable of taking two different values as a function of the remainder $R_S$ of said integer division and of said maximum loss $T_{max}$, i.e.:

$E_{MG}=E_{Mm}+Q_M$ if $R_S$ falls within the range $[0;59-T_{max}]$ $E_{MG}=E_{Mm}+Q_M+1$ if $R_S$ falls within the range $[60-T_{max};59]$ for the case where $T_{max}$ is greater than zero.

Definition of the overall time error to be corrected: $T_{Err}=(E_{MG};E_S)$ where $E_{MG}$ is an integer in minutes, and $E_S$ is formed by an integer in seconds, optionally with one or more decimals.

Thus, in the example shown in FIG. 6, by selecting $T_{max}=15$ s:

$E_S=-4.75$ s, $E_M=(2$ min;48 s); $EC_{Ms}=48+4.75=52.75$ s $EC_{Ms}$ modulo 60 gives: $Q_M=0$; $R_S=53$ s (rounded value)

$E_{MG}=E_{Mm}+Q_M+1=2+0+1=3$: $T_{Err}=(E_{MG};E_S)=(3;-4.75)$.

It can be seen that the alternative embodiment $T_{max}=0$ corresponds to a specific case in which it has been decided that the minutes hand must not show a loss, but must always be corrected so as to be exactly equal to the reference current minute or have a certain gain of between '0' and '59' seconds. A selection of $T_{max}=30$ s corresponds to a case wherein the minutes hand has a residual error after correction that is located between a loss of 30 seconds (−30 s) and a gain of 30 seconds (+30 s). An alternative embodiment where $T_{max}=15$ s can be advantageous and represents a good compromise.

Additionally, three examples are provided below (where $T_{max}=15$ s):

Example 1

$E_S=25$ s, $E_M=(-2$ min;19 s); $EC_{Ms}=19-25=-6$ s $EC_{Ms}$ modulo 60 gives: $Q_M$=−1 min; $R_S$=54 s $E_{MG}=E_{Mm}+Q_M+1=-2-1+1=-2$; $T_{Err}=(-2;25)=(-1;-35)$ Example 2

$E_S=-30$ s, $E_M=(-2$ min;36 s); $EC_{Ms}=36+30=66$ s $EC_{Ms}$ modulo 60 gives: $Q_M$=1; $R_S$=6 s $E_{MG}=E_{Mm}+Q_M=-2+1=-1$; $T_{Err}=(-1;-30)$ Example 3

$E_S=5$ s, $E_M=(1$ min;42 s); $EC_{Ms}=42-5=37$ s $EC_{Ms}$ modulo 60 gives: $Q_M$=0; $R_S$=37 s $E_{MG}=E_{Mm}+Q_M=1+0=1$; $T_{Err}=(1;5)$ The determination of the overall time error $T_{Err}$ is carried out by the processing unit, which subsequently provides same to the control unit for the phase of correcting the time displayed by the timepiece. However, the overall time error can also be calculated by the control unit which thus receives, from the processing unit, the time errors determined for the indicators considered. Thus, the correction signal $S_{Cor}$ provided by the processing unit comprises either the value $T_{Err}$, or the values $E_S$ and $E_M$. It can be seen that the processing unit and the control unit can advantageously be formed by a single electronic circuit or by the same electronic unit. The separation between these two units is functional in order to better describe the various phases of a correction cycle.

The overall correction of the display of the watch to be carried out during a correction cycle is given by $-T_{Err}$ entirely converted into seconds. Thus, in example 1, the correction will be made by producing a gain of 95 seconds, in example 2, the correction will be made by producing a gain of 90 seconds, and in example 3, the correction will be made by producing a loss of 65 seconds in the actual time displayed.

It should be noted that the embodiments described concern a correction device intended to correct the actual time displayed as a function of two time errors respectively determined for a seconds hand and a minutes hand of a watch provided with a mechanical movement, however the invention is not limited to this main embodiment. More specifically, in one specific embodiment, a time error is also determined for the hours hand and the correction provided also depends on this time error. For the hours hand, which is normally in phase with the minutes hand and in a continuous meshing connection with this minutes hand, only the difference between the current hour displayed and a reference current hour given by the time base is taken into account to determine the overall time error.

In another specific embodiment, the timepiece comprises only an hours indicator, indicating the current hour, and a minutes indicator which indicates the current minute (thus no indication of the current second). In a preferred alternative embodiment, only a time error for the minutes indicator is determined. In this alternative embodiment, the overall time error is equal to the time error determined for the minutes indicator. It can be seen in one embodiment wherein the timepiece also has a seconds hand, that the indication of the seconds can be ignored in an alternative embodiment and only the minutes hand is precisely corrected. However, although such an alternative embodiment allows the actual time to be given with a correct indication of the current minute, it makes little sense since the seconds hand thus gives an erroneous indication and the presence thereof seems of little use.

In a simple alternative embodiment, only the seconds hand is detected and only the potential time error thereof is thus corrected. For this last alternative embodiment to have meaning, it must be accepted that the minutes hand gives the correct indication of the current minute. This can be considered if a correction cycle is provided with a high enough frequency, for example once a day or once every two days. Nonetheless, in the preferred alternative embodiments, the minutes indicator is detected and the potential time error thereof is taken into account for the correction of the actual time displayed, since the error to be corrected does not only depend on the time drift, but also on possible manipulations of the stem-crown pulled out into the hand-setting position thereof or on various possible disruptions.

Finally, the timepiece further comprises a communication unit 50 which is arranged to receive, from an external device, from an external installation or from an external system, a synchronising signal $S_{Sync}$ providing a precise actual time that is formed by only the correct current minute and the correct current second, since in the main embodiment, only the seconds and minutes indicators are detected and then corrected overall. When it receives a signal $S_{Sync}$, the communication unit 50 provides the precise actual time $H_{RE}$ to the internal time base 42 which thus synchronises the reference actual time to the precise actual time. The external synchronisation system can be a GPS system that gives a very precise legal time. In this case, the communication unit is formed by a unit for receiving a GPS signal related to the precise actual time. In another alternative embodiment, the external installation is a long-distance radio-synchronisation antenna, as is particularly found in Europe and the USA. In such a case, the communication unit is formed by a unit for receiving a signal RF. In another alternative embodiment, which can complement one of the two aforementioned alternative embodiments, the external device is a mobile electronic device, for example a mobile phone or a computer. In such a case, the communication unit comprises a BLE (Bluetooth Low Energy) or NFC (Near Field Communication) communication unit. It can be seen that, in the last alternative embodiment, the precise actual time is in general derived from the time base of the external device, which is normally routinely synchronised to a clock giving the correct legal time via the telephone network or via the Internet network.

In general, the correction device comprises a wireless communication unit, which is arranged such that it can communicate with an external system capable of providing the precise actual time, the correction device being arranged such that it can synchronise the reference actual time to a precise actual time, formed by current time units of the precise actual time corresponding to those of the reference actual time, during a synchronisation phase wherein the communication unit is activated so as to receive the precise actual time from the external system.

In an advantageous alternative embodiment, the communication unit is periodically activated by the control unit or directly by the internal time base to receive the precise actual time. Thus, the communication unit is periodically and automatically activated to synchronise the reference actual time to the precise actual time during a synchronisation phase. In a preferred alternative embodiment, the user is able to activate the communication unit in particular via an external control member of the timepiece. The two alternative embodiments can be combined for automatic, periodic synchronisation and the possibility of carrying out synchronisation on demand.

The communication unit is particularly important after a power cut affecting the internal time base. Thus, the control unit is arranged to not carry out any correction cycle if the reference actual time has not been synchronised to an external system providing the precise actual time and maintained by the internal clock circuit in an uninterrupted manner since a last synchronisation phase. In a preferred alternative embodiment, as soon as the time base is deactivated for any reason whatsoever, this information is recorded in a permanent memory (non-volatile memory) which comprises at least one status bit ('ON/OFF') for the internal time base. During a new subsequent activation of the time base, the status bit retains its 'OFF' value until the correction device synchronises the time base to the precise actual time of an external system, as described. Before carrying out a correction cycle, in particular before carrying out a detection phase, the control unit queries the status bit to obtain the value thereof, and does not carry out any detection phase as long as this value is 'OFF'. The correction device begins a new correction cycle with a detection phase only when the value of the status bit is 'ON'. If a cycle is interrupted and is to be continued, in particular after a possible interruption in a correction cycle between the processing phase and the correction phase, the control unit can continue such a correction cycle at a later time, provided that the prior detection phase ended correctly and that the reference actual time is no longer needed to continue the correction cycle.

In one advantageous embodiment, the timepiece comprises an external control member for synchronising the reference actual time to the precise actual time, this external control member being capable of being actuated by a user of the timepiece. The external control member and the correction device are arranged to allow a user to activate the correction device so that this correction device synchronises the reference actual time to the precise actual time during a synchronisation phase. In a specific alternative embodiment, the external control member is formed by a crown associated with a control stem which are also used to manually set the hands of the display.

Another problem must be examined with regard to a watch having a mechanical movement. As described hereinabove, such a watch conventionally comprises a manual hand-setting device using a stem-crown. Thus, a correction cycle by the correction device according to the invention must be prevented from being disrupted by a manual hand-setting operation (with the exception of a manual control intended to cause the hours hand to jump by one hour, which manual control is also advantageous for the timepiece according to the invention, in particular for the main embodiment described hereinabove). A mechanism can be provided for blocking the external control member (the stem-crown) so that it cannot modify the position of the minutes hand and/or halt the seconds hand during a correction cycle. This normally requires an electromechanical actuator, which makes the timepiece more complex. One alternative involves arranging for a detection of the displacements of the stem-crown, in particular for detecting whether this control member is displaced into a position corresponding to that for setting the hands with the possibility of changing the position of the minutes hand and/or of the seconds hand. As soon as such a detection takes place, the control unit ends the correction cycle underway. Moreover, before starting a correction cycle, the correction device detects whether the control member is in the aforementioned manual correction position and the control unit does not start a correction cycle if this is the case and as long as this situation lasts. The device for detecting whether the stem is located in the hand-setting position thereof can be easily arranged along the control stem or the hand-setting mechanism associated with this stem. Advantageously, a capacitive or magnetic detection (the latter by placing a small magnet on the stem or on the associated mechanism) is chosen. In one advantageous alternative embodiment, each time the correction device detects that the external control member has been displaced into the hand-setting position thereof, it quickly carries out a correction cycle as soon as this member is then repositioned into another position (in particular into the winding position for a stem-crown).

Figure 7:
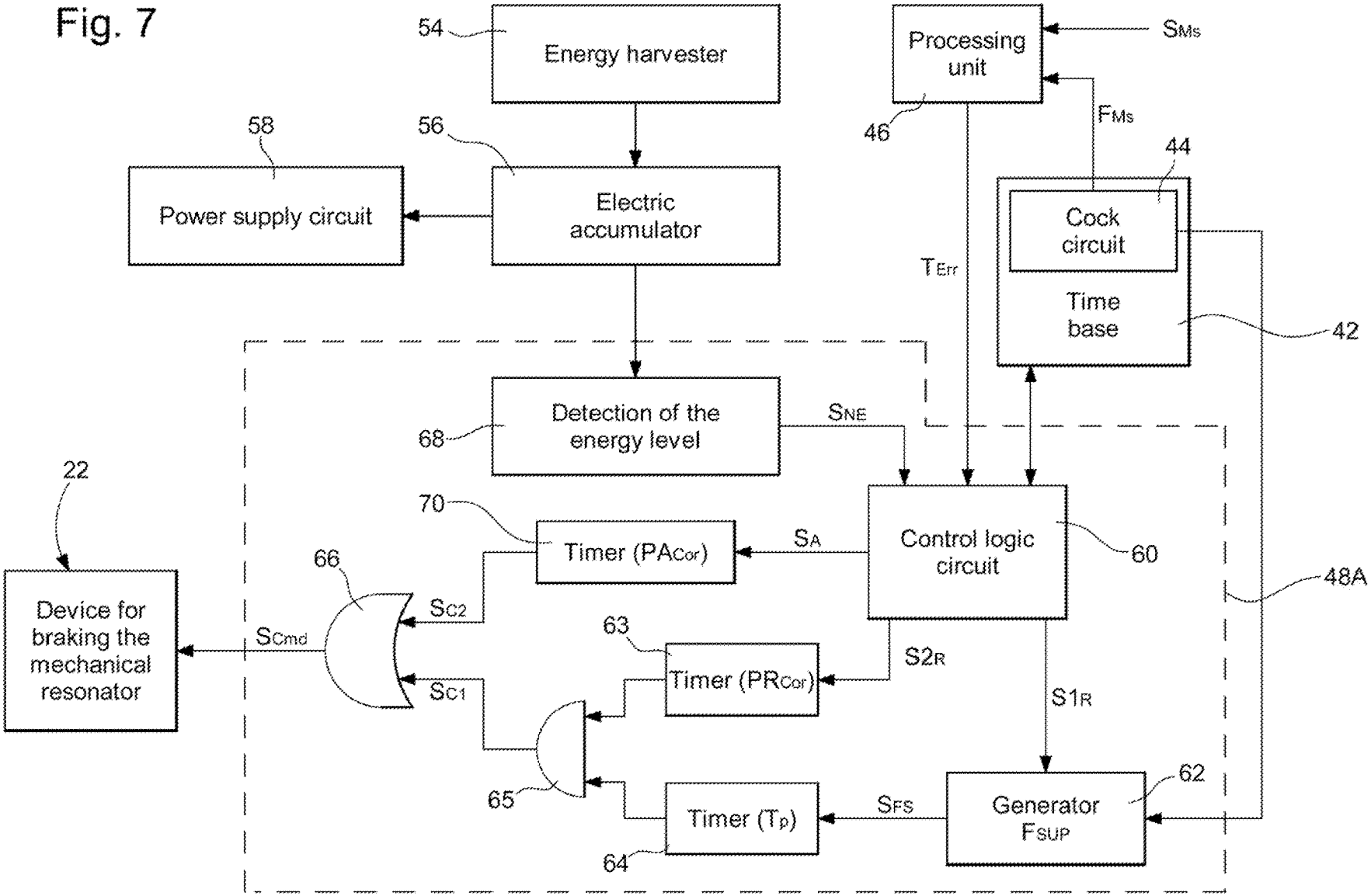
FIG. 7 schematically shows an alternative embodiment of the correction device of the timepiece according to the first embodiment.

FIG. 7 shows the device for correcting the timepiece according to an advantageous alternative embodiment of the first embodiment.

The timepiece comprises an energy harvester 54 which can be formed by various types of devices known by a person skilled in the art, in particular a magnetic, light or heat energy harvester, as well as an electric accumulator 56. In an alternative embodiment, the magnetic energy harvester is arranged to receive energy from an external magnetic source allowing the electric accumulator 56 to be recharged without electrical contact. In another alternative embodiment, the energy harvester is formed by a magnet-coil system allowing a small amount of energy to be harvested from the oscillation of the mechanical resonator of the timepiece and thus of the barrel sustaining this oscillation. In the above alternative embodiment, at least one magnet is arranged on the oscillating element of the resonator or on the support of the resonator and at least one coil is arranged respectively on said support or on said oscillating element, such that the majority of the magnetic flux generated by the magnet passes through the coil when the resonator oscillates in the usable operating range thereof. Preferably, the magnet-coil coupling is provided about the neutral position* (rest position) of the resonator. In another alternative embodiment, wherein the mechanical movement is an automatic movement, the oscillating weight is used to drive a micro-generator producing an electric current which is stored in the accumulator. It should be noted that the energy harvester can also be hybrid, i.e. formed by a plurality of different units, in particular of the wireless/contactless type, which are intended to harvest various energies from various energy sources and transform these various energies into electrical energy.

The control unit 48A controls a device 22 for braking the mechanical resonator 14, in particular an electromechanical actuator of the piezoelectric type schematically shown in FIG. 1. It should be noted that other types of actuators allowing a braking force to be momentarily applied to the mechanical resonator can be provided. Optionally, the control unit comprises a circuit 68 for detecting the level of available electrical energy, this detection circuit providing a signal SNE to a control logic circuit 60 to provide it with information regarding the level of electrical energy available, such that this logic circuit can know whether the correction module has enough energy before launching an operation for correcting the time displayed. If this is not the case, the following various options are possible:

1) The timepiece has a transmitter allowing the user to be directly notified that the accumulator must be recharged to enable complete correction of the time displayed, for example via an optical signal (LED) or acoustic signal generated by the transmitter. The timepiece does not carry out any correction operation as long as the electrical energy level is insufficient for a correction operation to be completed.

2) The timepiece has a transmitter, in particular a BLE communication unit, allowing a mobile phone or another external electronic device to be notified that the accumulator must be recharged in order to carry out a complete operation for correcting the time displayed, the mobile phone comprising an application for notifying the user of this information using the electronic display thereof. The timepiece does not carry out any correction operation as long as the electrical energy level is insufficient for a correction operation to be completed. The mobile phone can further be used to recharge the electric accumulator 56, preferably in a contactless manner, via the energy harvester 54 or via another energy harvesting device specific to transferring energy via a mobile phone, for example by magnetic induction.

3) The timepiece only carries out a partial correction of the time displayed using the energy available in the accumulator 56. According to two alternative embodiments, it does not transmit any information to the user or it notifies the user of this situation via the transmitter mentioned in either of the two options above.

4) The timepiece does not transmit any information and does not carry out any correction operation as long as the electrical energy level is insufficient for a correction operation to be completed.

In the absence of an electrical energy management system as indication hereinabove, the timepiece can begin a required correction operation if the available electrical voltage is sufficient and can carry out this correction operation as long as the electrical voltage supplied by the power supply circuit 58 is sufficient. In an advantageous alternative embodiment, the correction device is placed in a standby mode when no operation for correcting the time displayed is planned, in order to save the electrical energy available in the accumulator 56. Various parts of the correction module can be activated, depending on the needs, during different periods only.

The control unit 48A of the timepiece 2 comprises a control logic circuit 60 connected to the time base 42 and to the processing unit 46 which provides the latter, in the form of a correction signal $S_{Cor}$, with the value of the overall time error $T_{Err}$ determined during the previous processing phase. The control logic circuit is arranged to carry out various logic operations during each correction cycle. Moreover, the control unit 48A comprises a device 62 for generating a periodic digital signal having a given frequency $F_{SUP}$ (the generator device 62 is also referred to as a 'frequency generator' or simply as a 'generator' at the frequency $F_{SUP}$). Depending on whether the overall time error $T_{Err}$ to be corrected corresponds to a loss (negative $T_{Err}$) or to a gain (positive $T_{Err}$) in the display of the actual time, the control logic circuit 60 respectively generates either two control signals $S1_R$ and $S2_R$, which it respectively transmits to the frequency generator 62 and to a timer 63, or one control signal $S_A$ which it transmits to a timer 70. The timers 63 and 70 are programmable and are used to measure an intended correction period, respectively a period $PR_{Cor}$ for correcting a loss and a period $PA_{Cor}$ for correcting a gain. By definition, a gain corresponds to a positive error and a loss corresponds to a negative error.

The paragraphs below will firstly describe the arrangement of the control unit 48A for correcting a loss detected in the display of the time during a correction phase following the aforementioned detection and processing phases, and then the arrangement of this unit for correcting a gain during a correction phase.

In the case of a negative overall time error corresponding to a loss, according to a first loss-correction mode, the invention provides for generating a series of periodic braking pulses at a frequency $F_{SUP}$, these periodic braking pulses being applied by the braking device 22, in particular by the actuator 22A, to the oscillating resonator. For this purpose, the control logic circuit 60 activates the frequency generator 62 via the signal $S1_R$ and the timer 63 which counts up to or down from a time interval corresponding to a correction period $PR_{Cor}$, the duration (the value) whereof is determined by the logic circuit (by definition, the expression 'timer' encompasses a timer counting up to a given time interval in addition to a timer counting down to zero from this given time interval which is initially input into this timer).

In the alternative embodiment shown, when the frequency generator is activated, it provides a periodic digital signal $S_{FS}$, at the frequency $F_{SUP}$, to another timer 64 (timer having a value Tp corresponding to a selected duration for the periodic braking pulses). The outputs of the timers 63 and 64 are provided to an 'AND' logic gate 65 which outputs a periodic activation signal $S_{C1}$ to periodically activate the braking device 22, during the intended correction period $PR_{Cor}$, via an 'OR'logic gate 66 or any other switching circuit allowing the periodic activation signal $S_{C1}$ to be transmitted to the braking device. The periodic activation signal $S_{C1}$ forms the control signal $S_{Cmd}$ in the case of correcting a loss detected in the time displayed by the timepiece. Thus, the braking device applies periodic braking pulses to the mechanical resonator at the frequency $F_{SUP}$ during a correction period $PR_{Cor}$, the duration (value) whereof depends on the loss to be corrected. As a general rule, the braking pulses have a dissipative nature since part of the energy of the oscillating resonator is dissipated during these braking pulses. In a main embodiment, the mechanical braking torque is applied substantially by friction, in particular by means of a mechanical braking member applying a certain pressure on a braking surface of the resonator, preferably a circular braking surface, as described hereinabove in the description of the timepiece 2 with reference to FIG. 1.

Preferably, as for the alternative embodiment shown in FIG. 1, the system formed by the mechanical resonator and by the device for braking this resonator is configured so as to enable the braking device to start, in the usable operating range of the oscillating resonator, a mechanical braking pulse substantially at any moment in the natural oscillation period of the oscillating resonator. In other words, one of the periodic braking pulses can substantially begin at any angular position of the oscillating resonator, in particular the first braking pulse occurring during a correction period.

According to the disclosure of the international patent document WO 2018/177779 already cited hereinabove, the average frequency of an oscillating resonator can be precisely regulated by applying thereto, in a continuous manner, periodic braking pulses at a braking frequency $F_{FR}$ advantageously corresponding to double the setpoint frequency F0c divided by a positive integer N, i.e. $F_{FR}=2\cdot F0c/N$. The braking frequency $F_{FR}$ is proportional to the setpoint frequency F0c for the mechanical resonator and depends only on this setpoint frequency once the positive integer N is given. The international patent document WO 2018/177779 discloses that, after a transitory phase occurring at the start of the activation of the braking device applying the periodic braking pulses at the braking frequency $F_{FR}$, a synchronous phase is established during which the oscillation of the mechanical resonator is synchronised, on average, to the setpoint frequency F0c, provided that the braking torque applied by the braking pulses and the duration of these braking pulses are selected such that the braking pulses occur, during the synchronous phase, upon the passage of the mechanical resonator through extreme positions in the oscillation thereof, i.e. the reversal of the direction of the oscillatory motion occurs during each braking pulse or at the end of each braking pulse. The latter solution occurs in the advantageous case, which is in particular more reliable, whereby the mechanical resonator is halted by each braking pulse and subsequently remains blocked by the braking device until the end of this braking pulse.

Although of little interest, the international patent document WO 2018/177779 indicates that a synchronisation can also be obtained for a braking frequency $F_{FR}$ having a value that is greater than double the setpoint frequency (2F0), in particular for a value equal to M·F0 where M is an integer greater than two (M>2). In an alternative embodiment where $F_{FR}$=4·F0, the system merely loses energy with no effect during the synchronous phase, as one out of every two pulses occurs at the neutral point of the resonator, which is disadvantageous. For a higher braking frequency $F_{FR}$, pairs of pulses in the synchronous phase that do not occur at the extreme positions cancel out the effects of one another. It is thus understood that these are theoretical scenarios of no major practical interest. It should be noted that other braking frequencies can result in a synchronisation of the resonator to the setpoint frequency, however the conditions for implementing the regulation method are much more tedious and difficult to implement.

Within the scope of the development at the origin of the present invention, it was highlighted that the noteworthy phenomenon disclosed in the international patent document WO 2018/177779 can be used not only to continuously synchronise a resonator to the setpoint frequency thereof, but also to vary, in a determined manner, the oscillation frequency of a resonator in two frequency ranges respectively situated below and above the setpoint frequency thereof; i.e. a determined average frequency can be imposed on a mechanical resonator, which determined average frequency is different from the setpoint frequency thereof, being either greater than or less than same, by applying periodic braking pulses which can synchronise this resonator to a frequency that is different from the setpoint frequency but sufficiently close thereto to allow a synchronous phase to be established between the oscillating resonator and the braking device generating the braking pulses at a frequency selected for this purpose, while maintaining the oscillating resonator in a functional regime to time the running of the timepiece. The present invention proposes using this noteworthy discovery to correct the time displayed by a timepiece by varying the running of the mechanical clock movement considered, i.e. by varying the frequency of the resonator which times the running of the mechanism driving the display of the timepiece in question during a given correction period.

In particular, the first embodiment of the electronic control unit described here provides for correcting a loss detected in the time displayed according to a first loss-correction mode wherein, during a correction period $PR_{Cor}$, the oscillating resonator is synchronised to a correction frequency $FS_{Cor}$ which is greater than the setpoint frequency F0c. It has been shown within the scope of the development at the origin of the present invention that, in a manner similar to the case of a synchronisation to the setpoint frequency, the best results are obtained, for a correction frequency that is greater than or less than the setpoint frequency, when the braking frequency $F_{Bra}$ is selected, for a given correction frequency $F_{Cor}$, in order to satisfy the following mathematical equation:

$$F_{Bra}=2\cdot F_{Cor}/N, \text{ where } N \text{ is a positive integer.}$$

Thus, the periodic braking pulses are applied to the mechanical resonator at a braking frequency $F_{Bra}$ advantageously corresponding to double the correction frequency $F_{Cor}$ divided by a positive integer N, that is preferably quite low. This equation is valid for a correction frequency $F_{Cor}=FS_{Cor}$ which is greater than the setpoint frequency and also for a correction frequency $F_{Cor}=FI_{Cor}$ which is less than the setpoint frequency (first gain-correction mode which will occur hereafter in another embodiment of a timepiece according to the invention). The braking frequency $F_{Bra}$ is thus proportional to the provided correction frequency $F_{Cor}$ and depends only on this correction frequency once the positive integer N is selected. The term 'synchronisation to a given frequency' is understood to mean synchronising on average to this given frequency. This definition is important for a number N greater than two. For example, in the case N=6, only one oscillation period in three undergoes a variation of the duration thereof, relative to the setpoint period T0c=1/F0c (thus relative to the natural/free oscillation period T0=1/F0), resulting from a time difference generated by each braking pulse in the oscillation of the resonator.

It should be noted that, as with the case of a synchronisation to the setpoint frequency, other braking frequencies can be used to obtain, under certain conditions, a synchronisation to a desired correction frequency, however the selection of a braking frequency $F_{Bra}=2\cdot F_{Cor}/N$ allows a synchronisation to the frequency $F_{Cor}$ to be obtained in a more effective and more stable manner. In general, the mathematical equation expressing the relationship between the braking frequency and the correction frequency is $F_{Bra}=(p/q)\cdot F_{Cor}$ where p and q are two positive integers and the number q is advantageously greater than the number p. A person skilled in the art can experimentally draw up a list of the fractional numbers p/q that are appropriate and under which conditions (in particular for which braking torque).

It can be seen that the braking pulses can be applied with a constant force couple or a non-constant force couple (for example substantially in a Gaussian or sinusoidal curve). The term 'braking pulse' denotes the momentary application of a force couple to the resonator which brakes the oscillating member thereof (balance), i.e. which opposes the oscillatory motion of this oscillating member. In the case of a variable torque, the pulse duration is generally defined as the part of this pulse that has a significant force couple for braking the resonator, in particular the part for which the force couple is greater than half the maximum value. It should be noted that a braking pulse can exhibit a significant variation. It can even be choppy and form a succession of shorter pulses. In general, the duration of each braking pulse is provided such that it is lower than half a setpoint period T0c for the resonator, however it is advantageously less than one quarter of a setpoint period and preferably less than T0c/8.

Figure 8:
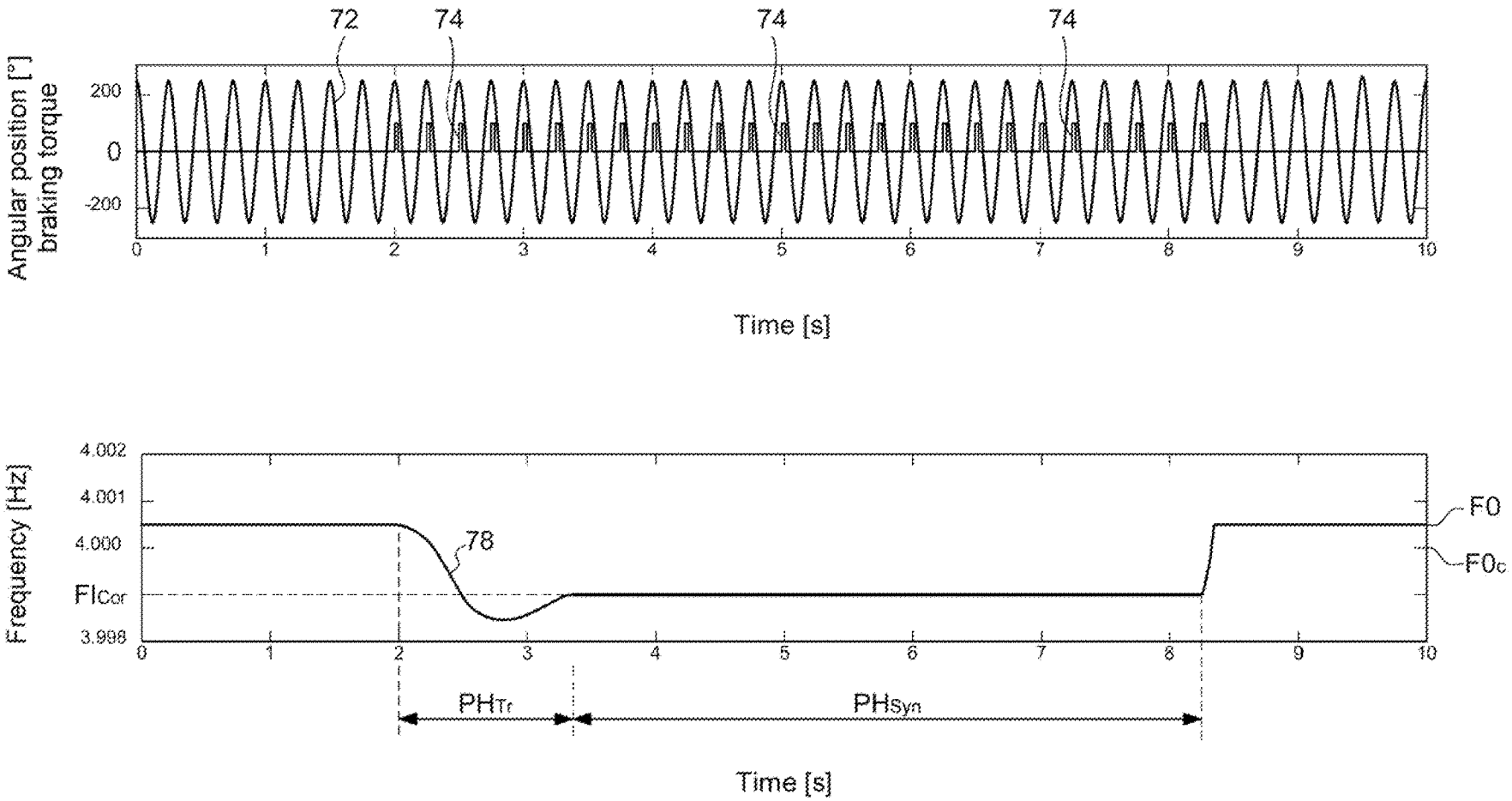
FIGS. 8 and 9 show, during a correction taking place via a series of periodic braking pulses, the changes to the oscillation frequency of a mechanical resonator during a gain-correction period, respectively a loss-correction period for the time indicated by a display of the timepiece considered, in the case of a ratio between the correction frequency and the setpoint frequency that is relatively close to one.
Figure 9:
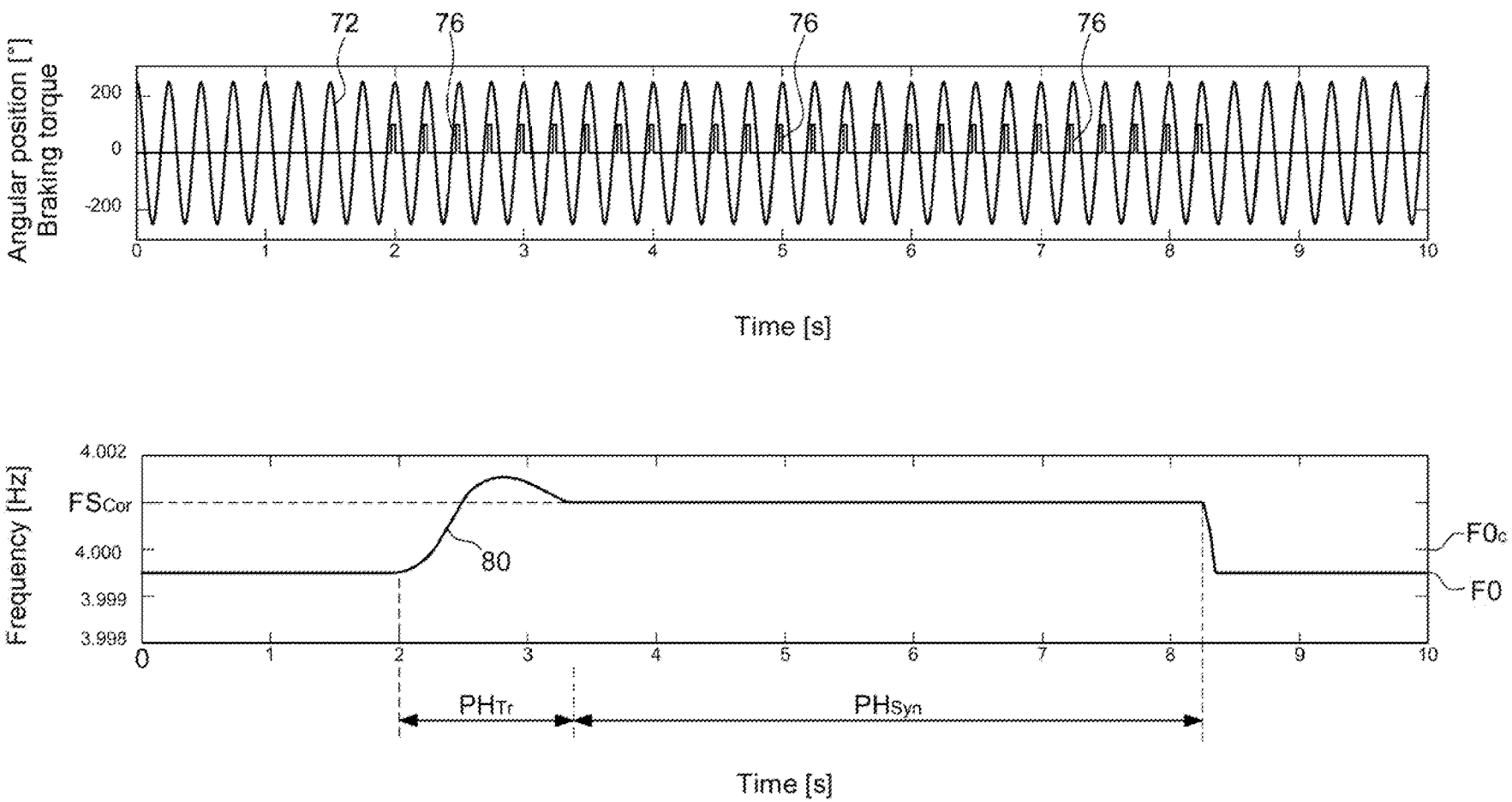

FIGS. 8 and 9 show, for a mechanical resonator having a setpoint frequency F0c=4 Hz and having an oscillation 72, respectively a first series of periodic braking pulses 74 applied to the resonator at a frequency $F_{INF}=2\cdot FI_{Cor}$ where $FI_{Cor}$=0.99975·F0c=3.999 Hz, for the case of a natural frequency F0=4.0005 Hz, and a second series of periodic braking pulses 76 applied to the resonator at a frequency $F_{SUP}=2\cdot FS_{Cor}$ where $FS_{Cor}$=1.00025·F0c=4.001 Hz, for the case of a natural frequency F0=3.9995 Hz. The bottom graphs in FIGS. 8, 9 show the changes to the oscillation frequency of the resonator during a correction period, which is defined as being the period during which the braking pulses are applied to the resonator at the frequency $F_{INF}$ or $F_{SUP}$. The curve 78 shows the changes to the oscillation frequency of the mechanical resonator during the application of the first series of periodic braking pulses 74 to correct a gain detected in the time displayed, the braking frequency $F_{INF}$ resulting in a correction frequency $FI_{Cor}$, given by the synchronisation frequency, which is less than the setpoint frequency F0c (first gain-correction mode). The curve 80 shows the changes to the oscillation frequency of the mechanical resonator during the application of the second series of periodic braking pulses 76 to correct a loss detected in the time displayed, the braking frequency $F_{SUP}$ resulting in a correction frequency $FS_{Cor}$, given by the synchronisation frequency, which is greater than the setpoint frequency (first loss-correction mode).

The very short correction period in FIGS. 8 and 9 was taken so as to show a full correction period while representing the oscillation of the resonator and the periodic braking pulses in a clearly visible manner on the graph giving the angular position of the resonator as a function of time. More specifically, in a few seconds, the possible correction is relatively small, in practice less than one second. For the correction frequencies chosen in FIGS. 8 and 9, the correction is thus very small. Thus, although the natural frequencies (natural/free frequencies) of the oscillating resonator are, in this case, within the norm for a mechanical watch, since they correspond to a daily error of about 10 seconds per day (gain, respectively loss), the correction frequencies are given purely for illustration purposes only and are much closer to the setpoint frequency than the correction frequencies which are generally provided for implementing the first gain- or loss-correction mode. In conclusion, FIGS. 8 and 9 are only given schematically to show, as a whole, the behaviour of the oscillating resonator when subjected to a series of periodic braking pulses at a correction frequency close to the setpoint frequency, yet different therefrom, and in the case of a natural frequency resulting in a conventional time drift. More detailed and precise considerations regarding the possible correction frequencies will be described hereinbelow.

Figure 10:
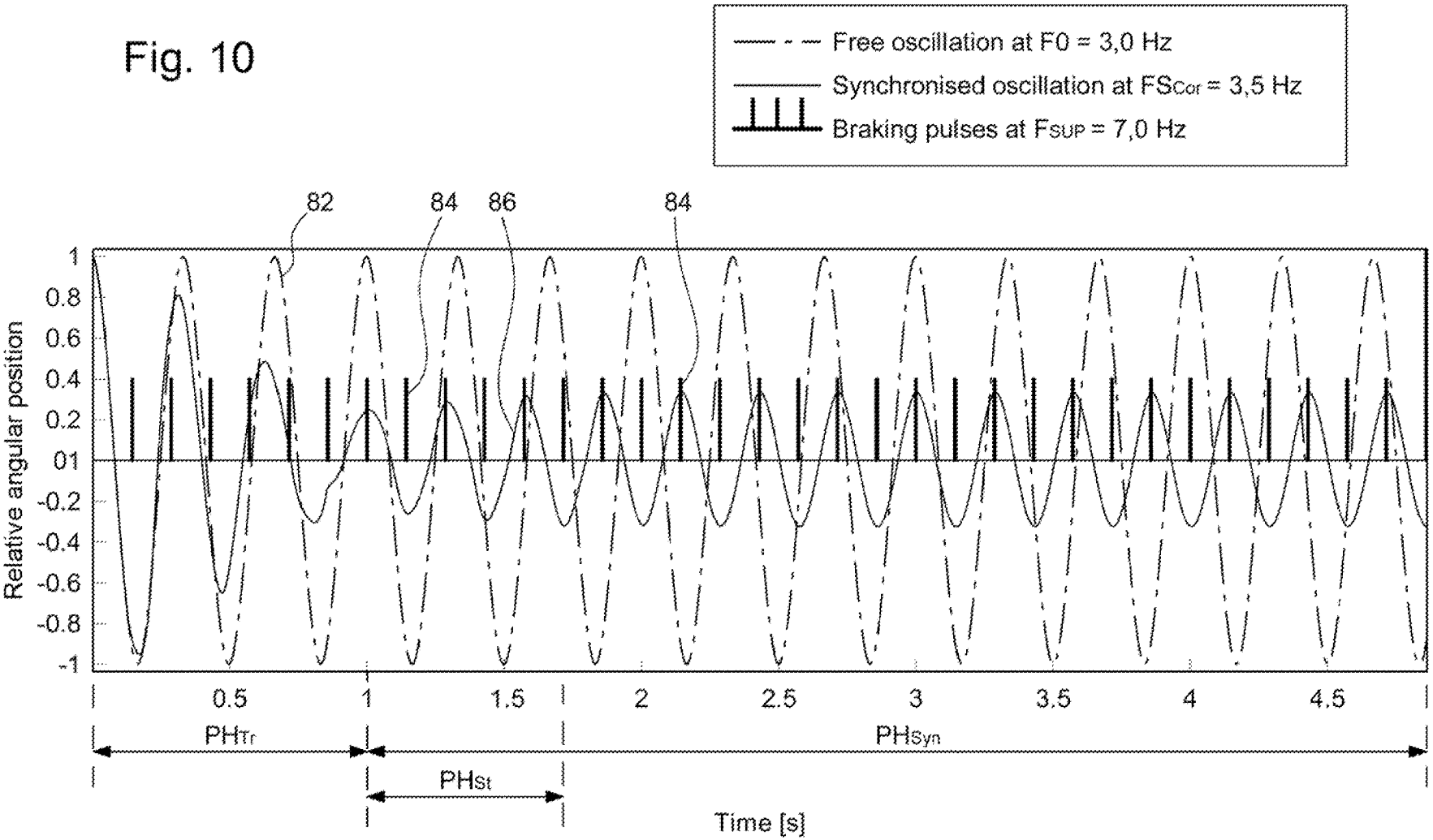
FIG. 10 shows, in the case of a relatively high ratio between the correction frequency and the setpoint frequency, the oscillation of a mechanical resonator at the start of a loss-correction period involving a series of periodic braking pulses, this correction period having an initial transient phase.
Figure 11:
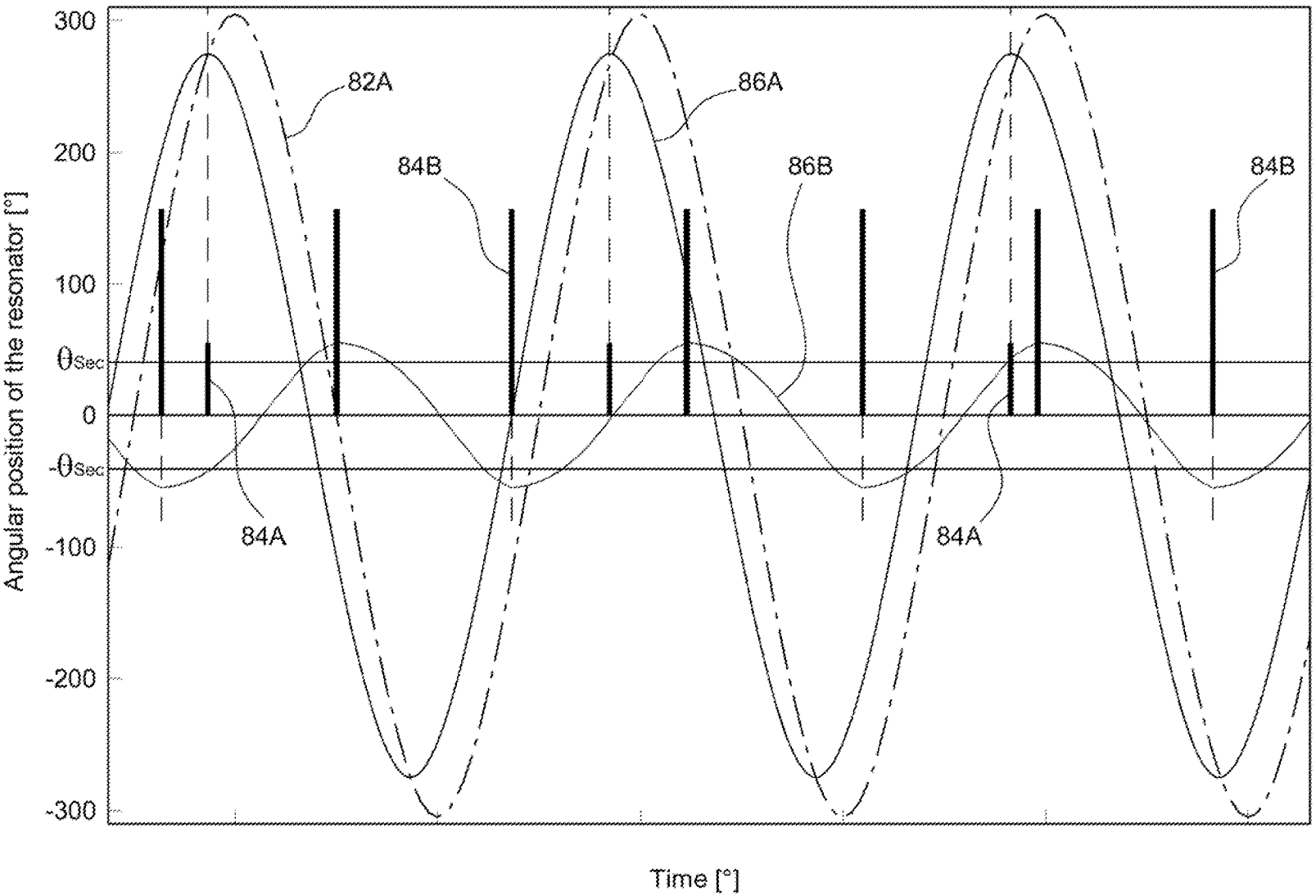
FIG. 11 shows, during a loss correction carried out using a series of periodic braking pulses, several oscillation periods of a mechanical resonator during a synchronous phase for two different synchronisation frequencies.

In the two graphs showing the frequency curves 78 and 80, at the start of the correction period, a transitory phase $PH_{Tr}$ can be seen, during which the frequency varies before stabilising at the frequency $FI_{Cor}$, respectively $FS_{Cor}$ during a synchronous phase $PH_{Sym}$ following the transitory phase. In the two cases shown, the transitory phase $PH_{Tr}$ is relatively short (less than 2 seconds) and the changes to the frequency occur in the direction of the desired correction frequency. In the two cases shown, the average correction per unit of time during the transitory phase is approximately equal to that which occurs during the synchronous phase. However, it should be noted that the transitory phase can be longer, for example from 3 to 10 seconds, and the changes to the frequency during the transitory phase varies on a case-by-case basis such that the average correction is variable and undetermined, however it remains low in practice. Reference can be made to FIG. 9 to 11 of the international patent document WO 2018/177779 wherein the transitory phases for synchronising the resonator to the setpoint frequency F0c, from a natural frequency that is close thereto yet different therefrom, are longer. It can be seen in FIG. 10 of this document that, when the setpoint frequency is greater than the natural frequency of the resonator, the oscillation frequency begins by decreasing at the start of the transitory phase before increasing to ultimately exceed the natural frequency and stabilise at the setpoint frequency.

The duration of the transitory phase and the changes to the frequency during this transitory phase depend on various factors, in particular on the braking torque, the duration of the pulses, the initial amplitude of the oscillation, and the moment at which the first braking pulse is applied in an oscillation period. It is thus difficult to control the time deviation resulting from a transitory phase relative to the setpoint frequency. By way of example, if $F_{Cor}$=1.05·F0c=4.2 Hz and the transitory phase lasts 10 seconds at most, and if it is assumed that the average frequency during this transitory phase is equal to F0c, then the absolute time deviation relative to $F_{Cor}$ is at most equal to half a second. This uncertainty thus generates a small error in the correction generated during a correction period, however it is not negligible. A solution is described hereinbelow to prevent such an error. In the first embodiment of the electronic control unit, a possible small error thus exists in the correction obtained if (the duration of) the correction period $PR_{Cor}$ is determined solely based on the overall time error $T_{Err}$ to be corrected, by defining this correction period as being the period during which a series of periodic braking pulses at the intended braking frequency is applied to the resonator, and by applying the hypothesis that the oscillation frequency during the correction period is that of the synchronisation frequency.

The synchronisation frequency determines the correction frequency. By definition, the correction frequency $F_{Cor}$ is equal to the synchronisation frequency. It can be seen that, in the synchronous phase of the correction period, the duration of the braking pulses must be sufficient for the braking torque applied to the resonator to be able to bring same to a halt (passage through an extreme angular position, defining the instantaneous amplitude thereof) during or at the end of each braking pulse. In the case of a synchronisation frequency that is greater than the setpoint frequency for correcting a loss, the time interval during which the resonator remains at a halt during a braking pulse decreases the possible correction per unit of time, such that this time interval is preferably limited, taking into account a certain safety margin, to obtain a shorter correction period thanks to a higher synchronisation frequency. It should be noted that the frequency of the braking pulses, the sustaining energy supplied to the resonator upon each alternation of the oscillation thereof and the value of the braking torque occur in the interval of time required to bring the oscillating resonator to a halt. For a given braking frequency and the resulting correction frequency, a person skilled in the art will know how to determine, in particular in an experimental manner or via simulations, a braking torque and a duration for the braking pulses in order to optimise the braking system. For setpoint frequencies between 2 Hz and 10 Hz, braking torques in the range 0.5 μNm to 50 μNm and braking pulses in the range 2 ms to 10 ms appear to be generally appropriate for the correction frequencies that are advantageously used in practice (these value ranges being given in a non-limiting manner for illustration purposes).

Based on the aforementioned hypothesis, i.e. that the synchronisation frequency applies throughout the entire correction period $PR_{Cor}$, the value of the correction period to be provided can be determined based on the overall time error $T_{Err}$ to be corrected, on the setpoint frequency F0c and on the correction frequency $F_{Cor}$; and since the synchronisation frequency determines the correction frequency which is equal thereto, the value of the correction period to be provided can also be determined based on the overall time error $T_{Err}$ to be corrected, on the setpoint frequency F0c and on the braking frequency $F_{Bra}$. By definition, as stated hereinabove, a gain in the time displayed corresponds to a positive error, whereas a loss corresponds to a negative error. The following mathematical equations are obtained for determining the value/the value of the correction period:

$$P_{Cor}=T_{Err}\cdot F0C/(F0C\cdot F_{Cor})=2T_{Err}\cdot F0c/(2F0c-N\cdot F_{Bra})$$

In the first loss-correction mode (negative error), the correction frequency $F_{Cor}=FS_{Cor}$ is greater than F0c, such that $P_{Cor}$ is positive. In such a case, the braking frequency $F_{Bra}=F_{SUP}$. The following equation is thus obtained:

$$PR_{Cor}=T_{Err}\cdot F0c/(F0c\cdot FS_{Cor})=2T_{Err}\cdot F0c/(2F0c-N\cdot F_{SUP})$$

In the first gain-correction mode (positive error), the correction frequency $F_{Cor}=FI_{Cor}$ is less than F0c, such that $P_{Cor}$ is positive. In such a case, the braking frequency $F_{Bra}=F_{INF}$. The following equation is thus obtained:

$$PA_{Cor}=T_{Err}\cdot F0c/(F0c\cdot FI_{Cor})=2T_{Err}\cdot F0c/(2F0c-N\cdot F_{INF})$$

Following the general description regarding a correction of the running of a mechanical timepiece obtained by a series of periodic braking pulses applied to the resonator thereof, we can now return to the first embodiment of the timepiece according to the invention. The control unit 48A (FIG. 7) is arranged to provide the braking device, whenever the overall time error $T_{Err}$ corresponds to a displayed time loss that is to be corrected, with a control signal $S_{C1}$ derived from the periodic digital signal $S_{FS}$ provided by the frequency generator 62, during a correction period $PR_{Cor}$, to activate the braking device 22 such that this braking device generates a series of periodic braking pulses that are applied to the resonator at the frequency $F_{SUP}$. Since (the duration of) the correction period is determined by the loss to be corrected, the number of periodic braking pulses in the series of periodic braking pulses is thus also determined by the loss to be corrected. The frequency $F_{SUP}$ is provided and the braking device is arranged such that each series of periodic braking pulses at the frequency $F_{SUP}$ can, during the corresponding correction period, result in a first synchronous phase wherein the oscillation of the resonator is synchronised (by definition 'synchronised on average') to a correction frequency $FS_{Cor}$ which is greater than the setpoint frequency F0c provided for the mechanical resonator.

With reference to FIG. 10 to 13B, the paragraphs below will give several observations regarding the braking pulses, in particular concerning the braking frequencies $F_{Bra}$ and the corresponding correction frequencies $F_{Cor}$ which are advantageously considered for a preferred alternative embodiment of the first loss-correction mode, and also for a preferred alternative embodiment of a first gain-correction mode (which will be implemented in an embodiment described hereafter) wherein a gain detected in the time displayed is intended to be corrected by a series of braking pulses at a frequency $F_{INF}$, already defined hereinabove, resulting in a correction frequency $FI_{Cor}$, also defined hereinabove, which is less than the setpoint frequency F0c.

FIG. 10 shows a first part of a correction period with a relatively high ratio between the correction frequency $FS_{Cor}$=3.5 Hz and the setpoint frequency F0c=3.0 Hz (substantially equal to the natural frequency of the resonator when oscillating freely, represented by the oscillation 82), i.e. a ratio $RS=FS_{Cor}/F0c=3.5/3.0=1.167$. When braking pulses 84 with a braking frequency $F_{Bra}=F_{SUP}=2\cdot FS_{Cor}$=7.0 Hz (case of N=1) and a sufficient braking force couple are applied to the mechanical resonator, allowing, in the transitory phase $PH_{Tr}$, the amplitude of the oscillation 86 of the oscillating resonator to be sufficiently decreased to ultimately come to a halt during each braking pulse, the corresponding correction frequency, i.e. $FS_{Cor}$=3.5 Hz can be relatively quickly imposed on this resonator. It can be seen that the desired synchronisation is obtained in the example given after just one second, however a phase $PH_{St}$ during which the oscillation is stabilised occurs at the start of the synchronous phase $PH_{Syn}$. In the case shown, the amplitude increases again during the stabilisation phase to ultimately stabilise at an amplitude corresponding to about one third of the initial amplitude of the free resonator.

A demonstrator (a prototype of the timepiece according to the invention) has been produced for the case presented in FIG. 10. By applying periodic braking pulses at the frequency $F_{SUP}$=7.0 Hz to the mechanical resonator, a gain of 7 hours was obtained on the display of the timepiece for a correction period of 6 hours in a very precise manner. Precisely 1 hour was thus 'gained' in a time of 6 hours. Such a result paves the way for corrections to the time indicated by the display that differ from the corrections made to a time drift of this display solely the result of an imprecision of the resonator operating freely (i.e. in the absence of braking pulses).

FIG. 11 shows the free oscillation 82A of a mechanical resonator, a first oscillation 86A of this resonator in a synchronous phase of a correction period wherein the ratio RS between the correction frequency $FS_{Cor}$ and the setpoint frequency F0c is relatively low (i.e. relatively close to '1'), and a second oscillation 86B of this resonator in a synchronous phase of a correction period wherein the ratio RS between the correction frequency $FS_{Cor}$ and the setpoint frequency F0c is relatively high (i.e. relatively far from '1'). The first oscillation 86A results from a series of periodic braking pulses 84A of relatively low intensity and occurring once per oscillation period (which corresponds to the case of N=2 where $F_{SUP}=FS_{Cor}$). However, the second oscillation 86B results from a series of periodic braking pulses 84B of relatively high intensity and occurring once per alternation of the oscillation (which corresponds to the case of N=1, i.e. $F_{SUP}=2\cdot FS_{Cor}$).

By selecting, in an appropriate manner, the braking torque and the braking frequency, it can be seen that the correction frequency can continuously vary between the setpoint frequency F0c and a certain higher frequency $FSC_{max}$, for correcting a loss in the time displayed, and can continuously vary between the setpoint frequency F0c and a certain lower frequency $FIC_{max}$, for correcting a gain in the time displayed. The higher frequency $FSC_{max}$ and the lower frequency $FIC_{max}$ are not values that can be easily calculated theoretically. They must be determined in practice for each timepiece. It can be seen that although this information is of interest, it is not essential. What is important is that the braking frequencies are selected and the braking torques available are appropriate for generating, during each correction period, preferably quite quickly, a synchronous phase during which the mechanical resonator can oscillate at the correction frequency provided for by the mathematical equation given hereinabove, without the oscillation thereof being brought to a halt (i.e. the resonator must not be halted such that it cannot restart from the halted position, which would cause the drive mechanism of the display to come to a halt).

FIG. 11 shows a safety angle $\theta_{Sec}$ beneath which, in absolute value form, the mechanical resonator is prevented from coming to a halt (i.e. between $-\theta_{Sec}$ and $\theta_{Sec}$), and thus above which the amplitude, in absolute value form, must practically remain during the synchronous phase, at least after the stabilisation phase. Advantageously for the operation of the mechanical resonator, the angle $\theta_{Sec}$ is equal or, preferably, greater than an angle $\theta_{ZI}$ (see FIG. 14) which corresponds to the coupling angle between the resonator and the escapement associated therewith, on either side of the neutral position of the resonator defined by the angular position of the coupling pin borne by the plate of the balance when this resonator is at or passes through the rest position thereof. In order to halt the mechanical resonator during a braking pulse, the angular coupling zone ($-\theta_{ZI}$ to $\theta_{ZI}$) of the mechanical resonator with the escapement is thus declared to be a 'prohibited zone' (it can be seen that braking is possible within this prohibited zone during the transitory phase, however the resonator is prevented from coming to a halt in this prohibited zone). It should be noted that, within the usable operating range of the resonator, in order to preserve correct operation of the escapement and in particular to guarantee the unlocking phase, the safety angle $\theta_{Sec}$ could need to be greater than the coupling angle $\theta_{ZI}$. A person skilled in the art will be able to determine a value for the safety angle $\theta_{Sec}$ for each mechanical movement associated with a correction device according to the first embodiment. The coupling angle $\theta_{ZI}$ can vary from one mechanical movement to another, in particular between 22° and 28°.

The condition of not blocking the resonator in the angular safety zone during the loss-correction period is important since the passing time must continue to be counted via the escapement (i.e. the timing of the running of the drive mechanism of the time display) during this loss-correction period. Thus, in a highly advantageous manner, said frequency $F_{SUP}$ and the duration of the periodic braking pulses are selected such that, during said synchronous phase of a correction period within the scope of the first loss-correction mode, each of the periodic braking pulses occur outside a coupling zone of the oscillating mechanical resonator with the escapement, preferably outside a safety zone defined for the mechanical movement. This also applies when selecting said frequency $F_{INF}$ and the duration of the periodic braking pulses within the scope of the first gain-correction mode.

In order to orient a person skilled in the art as regards the choice of correction frequencies and corresponding braking frequencies, a mathematical model has been drawn up based on the equation of the motion of a mechanical oscillator. To determine a maximum positive or negative correction, the resonator is considered to be in a synchronous and stable phase. Furthermore, a simplification is introduced for the sustain force applied to the resonator by the energy source via the escapement, considered to be of the type cos(ωt). It should be noted that this simplification is sensible since it reduces the maximum value relative to the actual case where all of the energy supplied to the resonator occurs in the prohibited zone $\theta_{ZI}$ defined hereinabove. Finally, the duration of the braking pulses is considered to be very small, thus isolated, by defining the braking frequency $F_{Bra}$ as the inverse of the time value $T_{Sec}$ at which the resonator reaches, in the equation of the motion given hereinbelow, the safety angle $\theta_{Sec}$ in the half-alternation corresponding to the number N selected in the equation $F_{Cor}=N\cdot F_{Bra}/2$.

To determine the maximum correction and thus the minimum or maximum period depending on whether the time error to be corrected is negative (loss) or positive (gain), the time t=0 is given by a braking pulse during which the oscillator is brought to a halt at the safety angle $\theta_{Sec}$. Furthermore, in the stable synchronous phase, the resonator must halt the following braking pulse as early as possible, respectively as late as possible, also at the safety angle $(-1^N)\cdot\theta_{Sec}$ in a time range given by the value of N and by the fact that the correction frequency is provided such that it is greater than or less than the setpoint frequency F0c to correct the loss or the gain.

In such a case, the equation of the motion is given by:

$$\theta(t)=(\theta_0+(\theta_{Sec}-\theta_0)e^{-t/\tau})\times\cos(2\pi f_0 t)$$

where $\tau=Q\cdot T0/\pi$, T0 is the free oscillation period (considered to be equal to T0c=1/F0c for the calculations) and $\theta_0$ is the amplitude of the free oscillation.

It can thus be seen that the quality factor Q of the mechanical resonator is included in the equation of the motion.

To obtain a correction frequency $FS_{Cor}$ that is greater than the setpoint frequency F0c, $T_{Sec}$ must occur in an alternation after the passage of the resonator through the neutral/rest position thereof. The following is thus obtained for a given N:

$$\theta(T_{Sec})=-1^N\theta_{Sec} \text{ where } T_{Sec}\in[(2N-1)/4T_0, N/2T_0]$$

The maximum braking frequency $FSB_{max}(N)=1/T_{Sec}$ and the maximum correction frequency $FSC_{max}(N)=N\cdot FSB_{max}/2$.

To obtain a correction frequency $FI_{Cor}$ that is less than the setpoint frequency F0c, $T_{Sec}$ must occur in an alternation before the passage of the resonator through the neutral/rest position thereof. The following is thus obtained for a given N:

$$\theta(T_{Sec})=-1^N\theta_{Sec} \text{ where } T_{Sec}\in[N/2T_0, 2N+1/4T_0]$$

The minimum braking frequency $FIB_{min}(N)=1/T_{Sec}$ and the minimum correction frequency $FIC_{min}=N\cdot FIB_{min}/2$.

Figure 12A:
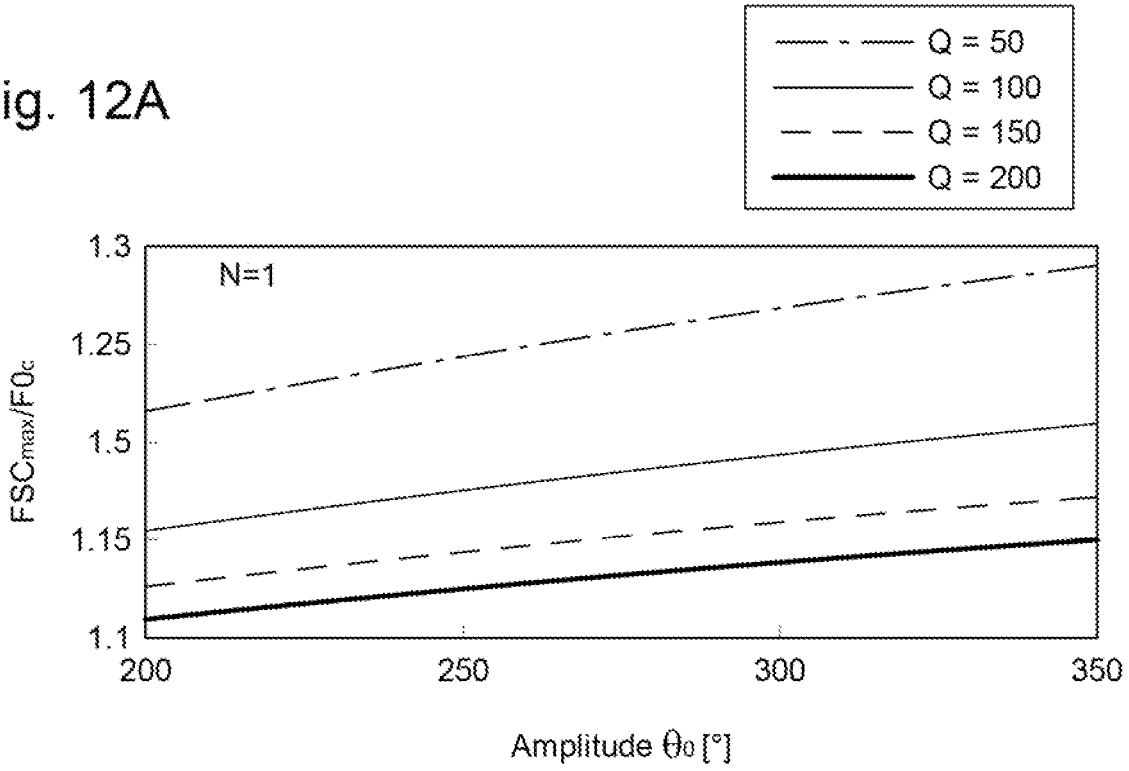
FIG. 12A shows, for a braking frequency corresponding to one braking pulse per alternation of the oscillation of a mechanical resonator, a plurality of curves of the maximum relative synchronisation frequency as a function of the amplitude of the free oscillation of the resonator and of the quality factor thereof.
Figure 12B:
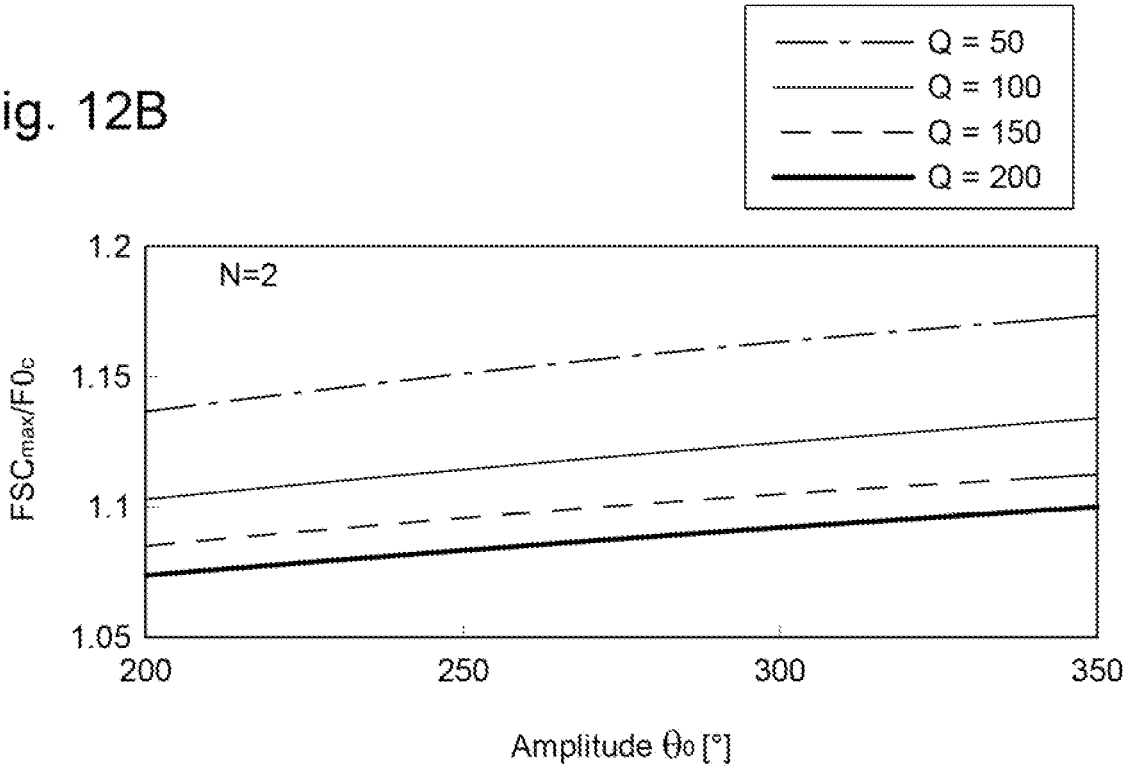
FIG. 12B shows, for a braking frequency that corresponds to one braking pulse per period of oscillation of a mechanical resonator, a plurality of curves of the maximum relative synchronisation frequency as a function of the amplitude of the free oscillation of the resonator and of the quality factor thereof.

FIGS. 12A and 12B respectively show the curves of $RS_{max}(N=1)=FSC_{max}(N=1)/F0c$ and $RS_{max}(N=2)=FSC_{max}(N=2)/F0c$ as a function of the amplitude $\theta_0$ of the free oscillation of the mechanical resonator for various quality factors Q of this mechanical resonator. It can be seen that the smaller the quality factor, the greater the ratio $RS_{max}(N)$.

Figure 13A:
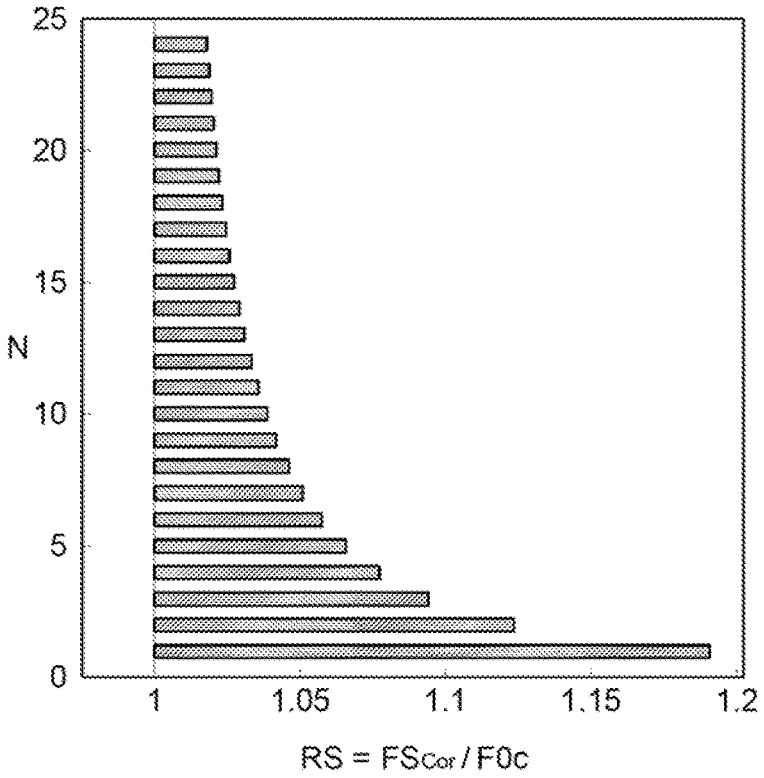
FIG. 13A is a graph showing, with approximation, for a given setpoint frequency, the possible correction frequency ranges for correcting a loss in the time display using short periodic braking pulses, as a function of a plurality of braking frequencies selected for the braking pulses.

FIG. 13A gives, for a resonator having a quality factor Q=100, a free amplitude $\theta_0$=300° and a safety angle $\theta_{Sec}$=25°, the greater correction frequency ranges, for a setpoint frequency F0c and various respective values of N, which can be considered within the scope of the first loss-correction mode, showing the ratio $RS=FS_{Cor}/F0c$ which extends between the value '1' and $RS_{max}(N)$.

Figure 13B:
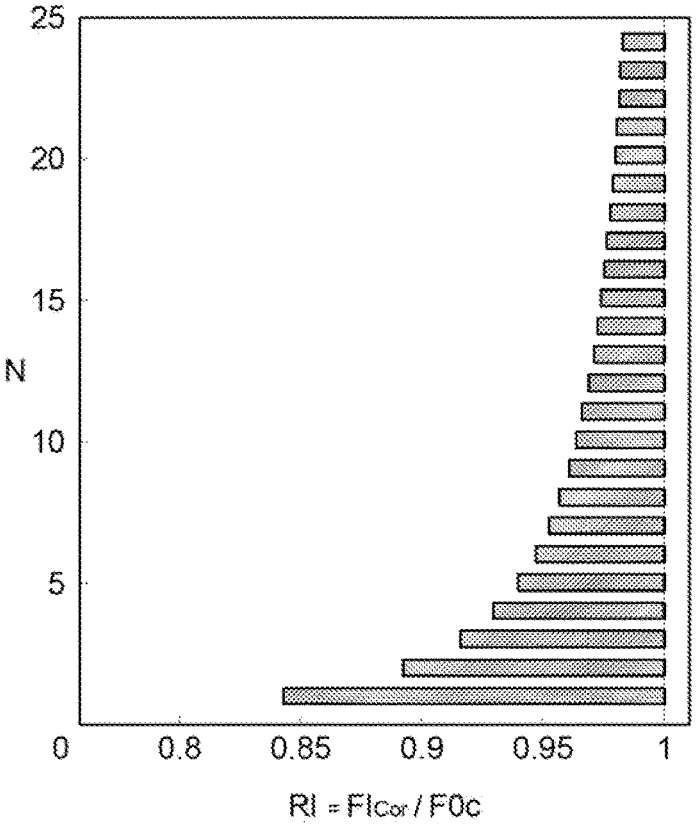
FIG. 13B is a graph showing, with approximation, for a given setpoint frequency, the possible correction frequency ranges for correcting a gain in the time display using short periodic braking pulses, as a function of a plurality of braking frequencies selected for the braking pulses.

FIG. 13B gives, for a resonator having a quality factor Q=100, a free amplitude $\theta_0$=300° and a safety angle $\theta_{Sec}$=25°, the lower correction frequency ranges, for a setpoint frequency F0c and various respective values of N, which can be considered within the scope of the first gain-correction mode, showing the ratio $RI=FI_{Cor}/F0c$ which extends between $RI_{max}(N)$ and the value '1'.

As stated hereinabove, the ranges given in FIGS. 13A and 13B are the result of a simplified theoretical model. The maximum and respectively the minimum correction frequencies can be seen to depend on a plurality of parameters. These figures give a good indication of the reality for a mechanical movement having fairly standard properties. However, for each given mechanical movement, the limit values must be defined when looking to get close thereto to carry out large corrections in relatively short correction periods.

After having described in detail the arrangement of the control unit and the operation of the correction device of the first embodiment of the timepiece according to the invention for correcting a loss in the time displayed by the timepiece, the arrangement of the control unit according to this first embodiment will now be described for correcting a gain in the time displayed according to a second gain-correction mode.

To allow the second gain-correction mode to be implemented, the timepiece comprises a device for blocking the mechanical resonator. In general, within the scope of the second gain-correction mode, the control unit is then arranged such that it can provide the blocking device, when the external correction signal received by the receiver unit corresponds to a displayed time gain that is to be corrected, a control signal which activates the blocking device such that this blocking device blocks the oscillation of the mechanical resonator during a correction period, the value/duration whereof is determined by the gain to be corrected, in order to halt the running of said drive mechanism during this correction period.

In the first embodiment described with reference to FIG. 1 to 7, the timepiece 2 comprises a blocking device which is formed by the braking device 22, in particular by the piezoelectric actuator 22A, which is also used to implement the first loss-correction mode. When the overall time error $T_{Err}$ corresponds to a gain in the time displayed which is to be corrected, the logic circuit 60 of the control unit 48A (FIG. 7) provides a control signal $S_A$ to the timer 70 which is programmable. This timer 70 thus generates a signal $S_{C2}$ for activating the braking device 22, via the 'OR' gate 66 or another switch, for a correction period $PA_{Cor}$, the duration whereof is substantially equal to the corresponding gain $T_{Err}$ to be corrected. The periodic activation signal $S_{C2}$ thus forms the control signal $S_{Cmd}$. It can be seen that the activation signal $S_{C2}$ controls the braking device 22 in a blocking mode of the mechanical resonator for a relatively long time, i.e. during substantially the entire correction period $PA_{Cor}=T_{Err}$. For this purpose, the voltage thus supplied by the power supply circuit 26 between the two electrodes of the piezoelectric strip 24 can differ from that provided to generate the periodic braking pulses to correct a loss. This voltage is selected such that the braking force applied to the mechanical resonator can bring same to a halt, preferably quite quickly, and subsequently block same until the end of the correction period.

In an alternative embodiment, the electrical voltage applied to the piezoelectric strip 24 is variable during the correction period. For example, a higher voltage can be provided at the start of the correction period, which is selected in order to quickly bring the resonator to a halt, in particular during the alternation of the oscillation of this resonator in which the start of the correction period occurs, and the voltage can subsequently be reduced to a lower value that is nonetheless sufficient to keep the resonator at a halt. Advantageously, the electrical voltage is selected such that the resulting braking force cannot halt the mechanical resonator in the prohibited angular zone ($-\theta_{ZI}$ to $\theta_{ZI}$) defined hereinabove. For this purpose, the braking torque is selected such that it is strong enough to be able to bring the resonator to a halt and block same in the angular halted position, wherever that is, and small enough to prevent this braking torque from bringing the resonator to a halt in the prohibited angular zone. Preferably, the resonator is prevented from coming to a halt in the angular safety zone ($-\theta_{Sec}$ to $\theta_{Sec}$) described hereinabove. The aforementioned condition is important when the resonator is not self-starting. In general, it suffices to ensure that the resonator can start back up at the end of the correction period.

According to one specific alternative embodiment ensuring that the resonator is quickly brought to a halt outside the aforementioned angular safety zone, a preliminary phase is provided, which occurs before the correction period where the resonator is blocked (i.e. where it remains at a halt after being quickly or instantly brought thereto at the start of the correction period). During the preliminary phase, the first loss-correction mode available in the first embodiment is used. It is clear that in the synchronous phase of the first correction mode described hereinabove, the passage through an extreme angular position occurs during each braking pulse. Thus, the braking pulses are in phase with the passages of the mechanical resonator through one of the two extreme angular positions thereof, each of these passages defining the start of an alternation. This is taken advantage of by activating the frequency generator 62 during the preliminary phase, which is intended to have a relatively short duration but nonetheless sufficient for establishing a synchronous phase wherein the resonator is synchronised to the frequency $FS_{Cor}$. The preliminary phase ends, for example, during a final braking pulse which is immediately followed by the correction period with activation of the braking device in the blocking mode. The resonator is thus known to be blocked outside the angular safety zone. The braking torque for the preliminary phase can be different from that used to correct a loss as described hereinabove.

Since the behaviour of the frequency during the transitory phase at the start of a series of periodic braking pulses can vary on a case-by-case basis, the error generated by the preliminary phase is almost impossible to determine. However, a maximum error can be estimated. For example, if the frequency $F_{SUP}=1.05 \cdot F0c$ (correction of 30 seconds in 10 minutes) and the preliminary phase is provided with a duration of 10 seconds (selected duration greater than those of the transitory phases capable of taking place), the maximum error can be estimated to equal 0.5 seconds (half a second). For a mechanical movement, although such an error is not negligible, it is relatively small since a conventional mechanical movement has a daily error generally in the range 0 and 5 to 10 seconds.

Figure 14:
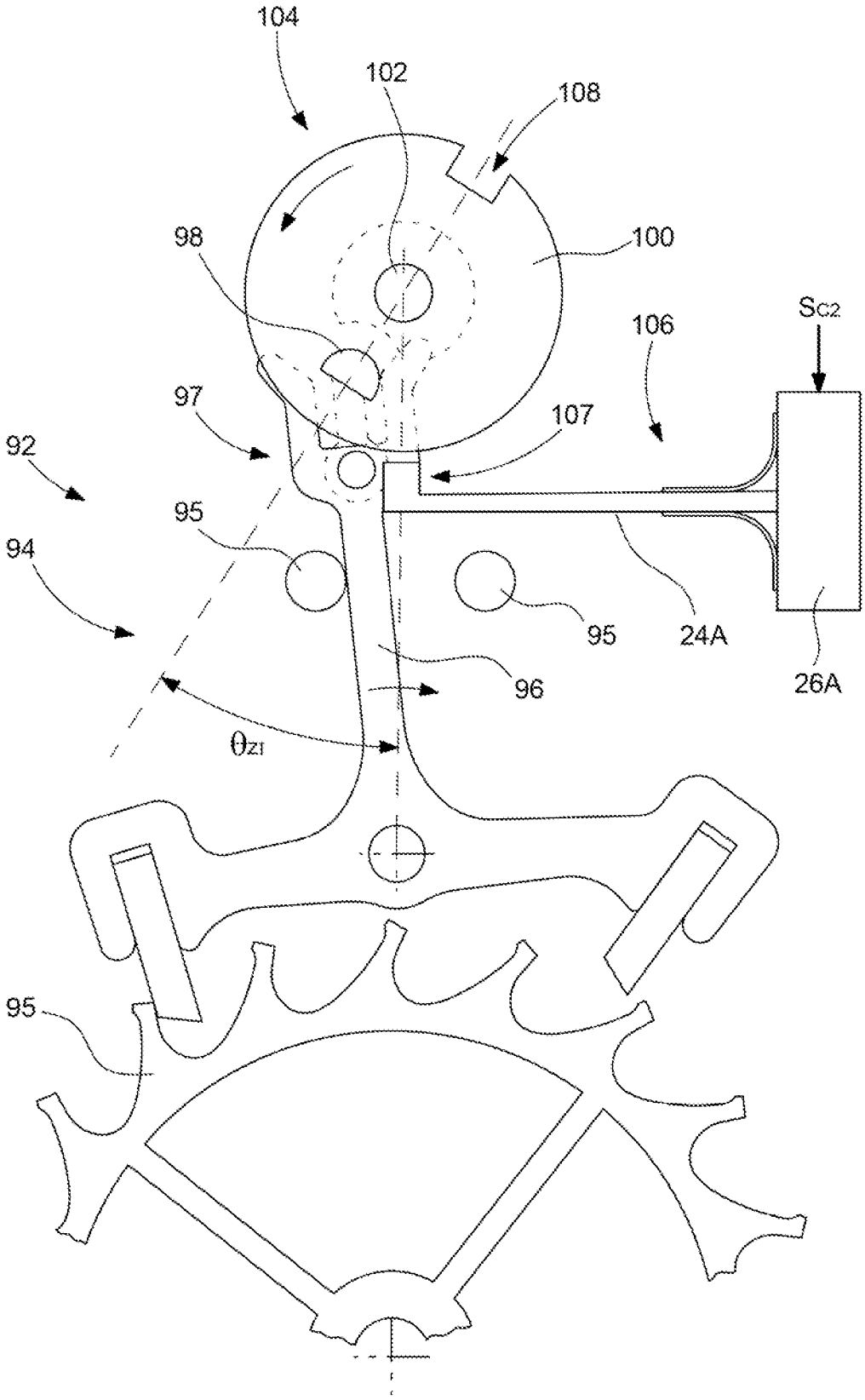
FIG. 14 partially shows a second embodiment of a timepiece according to the invention.

With reference to FIG. 14, a second embodiment of a timepiece according to the invention will be described, which differs from the first embodiment by the arrangement of the blocking device advantageously allowing the second mode to be implemented for correcting a gain in the time display associated with the mechanical movement of the timepiece. This mechanical movement 92 comprises a conventional escapement 94 formed by a pallet-wheel 95 and a pallet-lever 96 capable of oscillating between two pegs 95. The pallet-lever comprises a fork 97 between the horns whereof is conventionally inserted at each alternation the pin 98 also forming the escapement and borne by a plate 100 which is integral with the staff 102 of the balance 104 (partially shown) of the mechanical resonator or formed integrally in one piece with this staff (i.e. the staff is machined with a longitudinal profile defining the plate). The plate 100 is circular and centred about the central axis of the staff 102 which defines the rotational axis of the balance 104.

The timepiece comprises a blocking device 106 which is separate from the braking device 22A (FIG. 1) used to correct a loss. This blocking device is thus dedicated to implementing the second gain-correction mode. The blocking device is formed by an electromechanical actuator, in particular by a piezoelectric actuator of the same type as that described with reference to FIG. 1. According to the alternative embodiment shown, the actuator comprises a flexible piezoelectric strip 24A and voltage is supplied to the two electrodes thereof by a power supply circuit 26A. The strip 24A has, at the free end thereof, a projecting part 107 forming a stud, which is situated on the plate 100 side. The strip extends in a direction parallel to a tangent of the circumference of the plate, at a short distance from this circular circumference. The plate has a through-cavity 108, which radially opens out onto the periphery of the plate, and the profile thereof in the general plane of the plate is provided so as to allow the stud 107 to be housed therein when situated angularly facing this cavity and when the piezoelectric actuator 106 is activated. According to the alternative embodiment shown, the cavity 108 is diametrically opposite the pin 98 and the stud is angularly situated in the zero position of the pin (i.e. the angular position of this pin when the resonator is at rest, respectively passes through the neutral position thereof). It should be noted that this zero angular position of the pin normally defines the zero angular position of the balance 104, and thus of the mechanical resonator, in a fixed angular frame of reference relative to the mechanical movement 92 and centred about the rotational axis of the balance.

In an equivalent alternative embodiment, the cavity can be arranged at another angle relative to the pin, for example at 90°, and the actuator 106 is thus positioned at the periphery of the plate such that the stud 107 is diametrically opposite the cavity when the resonator is at rest. Thus, regardless of the alternation and the angular position when the piezoelectric actuator is activated, the stud will enter the cavity when the resonator is in an angular position that is substantially equal, in absolute value form, to 180° (this being exactly the case if the balance is in phase, i.e. the pin is aligned with the respective centres of rotation of the balance and of the pallet-lever when the resonator is at rest). This value of 180° is clearly outside the safety zone (it is greater than the safety angle defined hereinabove) and it is generally lower than the range of the amplitudes of the mechanical resonator corresponding to the usable operating range thereof.

Furthermore, according to the advantageous alternative embodiment shown in FIG. 14, the sidewalls of the cavity 108 are parallel to the radius passing through the centre thereof and the rotational axis of the balance. In an equivalent alternative embodiment, these sidewalls are radial. Similarly, the stud 107 has two sidewalls, perpendicular to the general plane of the plate, which are parallel to the radius passing through the centre thereof and the rotational axis of the balance or which are, in the equivalent alternative embodiment, substantially radial relative to the rotational axis. Thanks to this arrangement, when the stud 107 is inserted into the cavity 108 which thus acts as a housing therefor, this stud blocks the rotation of the plate 100 and thus of the balance 104 via a substantially tangential force, the direction whereof is substantially parallel to the overall longitudinal direction of the piezoelectric strip 24A. When the actuator 106 is activated, the end of the strip bearing the stud 107 undergoes a substantially radial displacement, relative to the rotational axis of the balance, and the stud can thus, as a function of the angular position of the balance at this moment in time, either exert an essentially radial force on the circular lateral surface of the plate 100, or at least partially enter the cavity 108. The actuator must only be arranged such that the stud can undergo, when this actuator is activated, a sufficient displacement to be inserted into the cavity when the latter is located in an angular position corresponding substantially to that of the stud (in a fixed angular frame of reference relative to the stud).

A relatively low frictional force can be provided when the stud comes to bear against the circular lateral surface of the plate at the start of a correction period, i.e. after the activation of the actuator, in the case wherein the cavity is not facing the stud when the proximal surface thereof reaches the circular circumference of the plate. Thus, it can be guaranteed that the amplitude of the resonator does not reduce by much during the initial braking caused by the stud exerting a radial force against this circular lateral surface. Furthermore, when the stud is inserted into the cavity while the latter is located facing the stud, the radial force exerted by the piezoelectric strip on the plate can be very low or zero. The electrical energy required to block the resonator during the correction period can thus be relatively low, much lower than in the case of the first embodiment.

When the correction device of the timepiece determines, during a correction cycle, an overall time error corresponding to a gain in the display of the time, the control logic circuit thereof, in a manner similar to that of the operation of the first embodiment, activates the blocking device 106, by providing a control signal $S_{C2}$ thereto, similar to that described hereinabove within the scope of the first embodiment, for a period that is substantially equal to the overall time error to be corrected. Thanks to the arrangement of a cavity in a circular plate centred about the rotational axis of the resonator and an actuator having a corresponding part, however that is preferably narrower than the cavity, which is arranged such that it can undergo a substantially radial movement between a position of non-interaction, corresponding to a state in which it is not supplied by the actuator, and a state of interaction with the balance of the resonator, corresponding to a state in which it is supplied by the actuator in the alternative embodiment described here, the start of the activation of the blocking device 106 can take place at any time, regardless of the angular position of the resonator and regardless of the direction of the oscillatory motion (thus independently of the ongoing alternation from among the two alternations forming each oscillation period). This is highly advantageous.

Finally with reference to the second embodiment, the electromechanical actuator can be of a different type from that shown in FIG. 10. For example, in an alternative embodiment, the actuator can comprise a ferromagnetic or magnetised core which can be displaced under the effect of a magnetic field generated by a coil. In particular, this core is collinear with the coil and it comprises an end part exiting the coil at least when the actuator is activated, this end part forming a finger which is configured such that it can be inserted into the cavity of the plate, this finger in particular having a terminal part in the shape of the stud 107. In a preferred alternative embodiment, the actuator is a bistable actuator. The supply of the actuator is advantageously maintained, during the activation thereof to pass from the position of non-interaction to the position of interaction, until the stud enters at least partially the cavity 108. Such an alternative embodiment is of particular interest since the actuator must not exert any blocking force by applying a radial pressure on an element of the balance of the resonator in the two stable positions thereof respectively corresponding to the provided position of non-interaction and position of interaction. In this preferred alternative embodiment, the power consumption can be very low, regardless of the duration of the correction period, which is highly advantageous.

Figure 15:
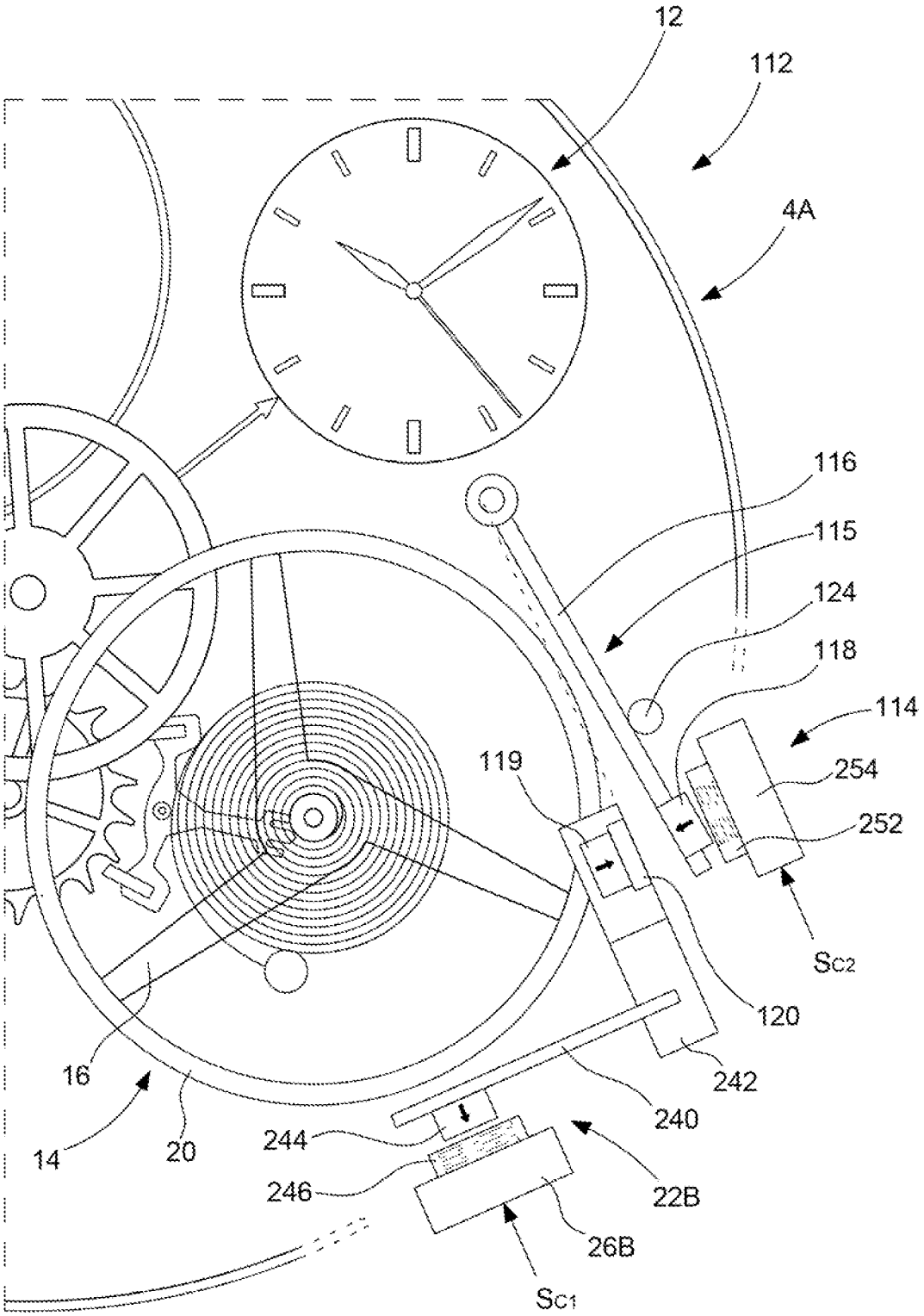
FIG. 15 partially shows a third embodiment of a timepiece according to the invention.

With reference to FIG. 15, a third embodiment of a timepiece according to the invention will be described, which essentially differs from the first embodiment by the arrangement of the blocking device advantageously allowing the second mode to be implemented for correcting a gain in the time display associated with the mechanical movement of the timepiece. The references already described with reference to FIGS. 1 and 7 will not be described in detail again. Similarly to the second embodiment, the timepiece 112 according to the third embodiment comprises a blocking device 114 which is separate from the braking device 22B used to correct a loss. The operation of the braking device 22B is similar to that of the braking device 22A described hereinabove, i.e. it is also adapted to implement the first loss-correction mode described in detail hereinabove. In the alternative embodiment described here, the braking device 22B is formed by an electromechanical actuator of the electromagnetic type, i.e. comprising a magnet-coil system for actuating a flexible strip 240 embedded in a support 242 and the free end whereof forms a brake pad/element for braking the resonator 14. This actuator comprises a magnet 244, borne by the flexible strip, and a coil 246 situated facing the magnet and connected to an electrical power supply 26B which receives the control signal $S_{C1}$, which produces pulses of electric current in the coil to generate braking pulses. Each current pulse in the coil produces a magnetic flux which generates a magnetic repulsion force on the magnet 244, and the flexible strip 240 then comes into contact with the lateral surface of the felloe 20 of the resonator to produce a certain mechanical braking force on this resonator during a braking pulse.

The blocking device 114 is noteworthy for at least two reasons. Firstly, it acts on a conventional mechanical resonator 14 without requiring any modifications, in particular without requiring any specific machining, unlike for the second embodiment. Furthermore, the blocking device is a bistable element, i.e. a blocking element has two stable positions, namely in this case the lever 115. The blocking device is arranged such that a first of the two stable positions of the lever corresponds to a position of non-interaction with the balance 16 whereas the second of these two stable positions corresponds to a position for locking the resonator via a radial force exerted by a strip 116, forming the lever 115, on the felloe 20 of the balance. The strip 116 is pivoted about an axis arranged in the mechanical movement 4A (in another alternative embodiment, the lever is arranged such that the pivot axis thereof is arranged on a support that is separate from the mechanical movement and belonging to a correction module). In an alternative embodiment, this axis is formed by a fixed peg about which an annular terminal part of the strip 116 is mounted. This strip is rigid or semi-rigid, wherein mild flexibility can be advantageous.

The strip 116 is associated with a specific magnetic system procuring the bistable nature of the lever 115 and thus of the blocking device 114. The magnetic system comprises a first magnet 118, borne by the strip and thus fixed to this strip for rotation therewith, a second magnet 119 arranged in a fixed manner relative to the mechanical movement (in the alternative embodiment shown, the second magnet is inserted in a fixed manner inside a lateral opening in the support 242) and a small ferromagnetic plate 120 arranged between the first magnet and the second magnet, at a short distance from the second magnet 119 or thereagainst (for example the small plate is bonded against this magnet, only a layer of adhesive thus separating the magnet from the small plate, or it is inserted in a fixed manner into a housing in the support 242 situated in front of the magnet 119).

The first and second magnets 118, 119 have opposite magnetic polarities and the respective magnetic axes thereof are substantially aligned. Thus, in the absence of the small ferromagnetic plate, these two magnets would constantly exert a repulsion force on one another and the lever would remain in or always return to, in the absence of forces external to the magnetic system, a position wherein the strip is in abutment against a peg 124 limiting the rotation thereof. However, thanks to the arrangement of the small ferromagnetic plate, the magnetic force exerted between the two magnets is reversed. More specifically, when the moving magnet 118 is moved closer from the remote position thereof (shown in FIG. 11), the repulsion force decreases until it is cancelled out and ultimately reversed when the moving magnet moves close to the small ferromagnetic plate. Thus, when the moving magnet 118 is situated very close or against the small ferromagnetic plate 120, this moving magnet is subjected to a magnetic attraction force. This surprising physical phenomenon is described in detail in the Swiss patent application CH 711 889, which further contains several horological applications.

The lever 114 is arranged to take two stable positions in the absence of forces external to the magnetic system of the blocking device. The first stable position is a position of non-interaction, wherein the strip 116 is in abutment against the peg 124, the moving magnet 118 thus being subjected to a magnetic repulsion force from the magnetic assembly, formed by the fixed magnet 119 and by the small ferromagnetic plate 120, which maintains the lever 115 against this peg. The second stable position is a position of interaction, wherein the strip 116 is in abutment against the felloe 20 of the balance 16, the moving magnet 118 thus being subjected to a magnetic attraction force from said magnetic assembly, which maintains the lever 115 against this felloe. The small ferromagnetic plate 120 is arranged such that the strip 116 exerts a radial force blocking the balance 16, and thus the resonator 14, when the lever is in the second stable position thereof. In order for the strip to exert a blocking force against the outer lateral surface of the felloe 20, the surface of the small plate 120, situated facing the moving magnet 118, must be slightly withdrawn relative to the proximal surface of this moving magnet when the strip 116 comes into contact with the felloe. If the strip is semi-rigid and thus has a certain flexibility, the moving magnet can ultimately abut against the proximal surface of the small ferromagnetic plate, however in this case the strip is under bending.

In order to displace the bistable lever 115 between the two stable positions thereof, in both directions, the blocking device comprises a device for actuating this lever, arranged to alternately switch the lever between the two stable positions thereof. In the alternative embodiment shown, the actuation device is formed by a coil 252 connected to an electrical power supply 254. The coil 252 is aligned with the magnetic assembly, formed by the fixed magnet 119 and by the small ferromagnetic plate 120, and arranged immediately behind the moving magnet 118 when the lever is in the position of non-interaction thereof. Depending on the polarity of the electrical voltage applied to the coil 252, the moving magnet is subjected to a magnetic attraction or repulsion force from this coil, thus allowing the lever to pass from one of the two stable positions thereof into the other in both directions. The actuation device is controlled by the logic circuit of the control unit via the power supply circuit 254 thereof which receives the control signal $S_{C2}$. At the start of a gain-correction period, the control signal generates a first electrical current pulse in the coil 252 with a polarity which produces a repulsion force for the moving magnet 118 and a sufficient duration for the lever to pass into the position of interaction thereof, then the power supply to the coil is cut off until the end of the correction period, when a second electrical current pulse is generated in the coil with an opposite polarity, this second pulse thus producing an attraction force on the moving magnet which is provided such that it is sufficient to cause the lever to switch into the position of non-interaction thereof, thus ending the correction period.

In another alternative embodiment, the device for actuating the lever is separate and independent from the magnetic system of the bistable lever. In such a case, the electromagnetic system of the actuation device is formed by a second magnet borne by the lever and a coil arranged facing this second magnet, similarly to the preceding alternative embodiment. This electromagnetic system can be arranged upstream or downstream of said magnetic system relative to the pivot axis of the lever.

This embodiment is noteworthy in that the blocking force exerted by the blocking device during the correction period does not originate from an electrical power supply to this blocking device, but from said magnetic system forming it. Thus, the blocking device only requires electrical power at the start and at the end of the correction period for the second gain-correction mode, during the switching of the bistable lever between the two stable states thereof by the actuation device.

In another alternative embodiment resulting in the same physical phenomenon and thus the same sought-after effect, the small ferromagnetic plate 120 is arranged against the moving magnet 118, with which it is rigidly connected. Finally, another alternative embodiment provides for combining the second and third embodiments. For this purpose, the strip of the lever comprises, in the region in which contact is made with the felloe 20, a stud which projects towards this felloe, which has a cavity along the overall circular circumference thereof. A person skilled in the art will know how to arrange the blocking device such that the first stable position thereof is a position of non-interaction and the second stable position thereof is a position of interaction wherein the stud is at least partially inserted into the cavity, this stud generally exerting initially a dynamic dry friction against the outer lateral surface of the felloe, when the lever is actuated by the actuation device to pass from the first stable position thereof into the second stable position thereof at the start of a gain-correction period, before penetrating the cavity when the latter is presented facing the stud during the oscillation of the balance.

Figure 16:
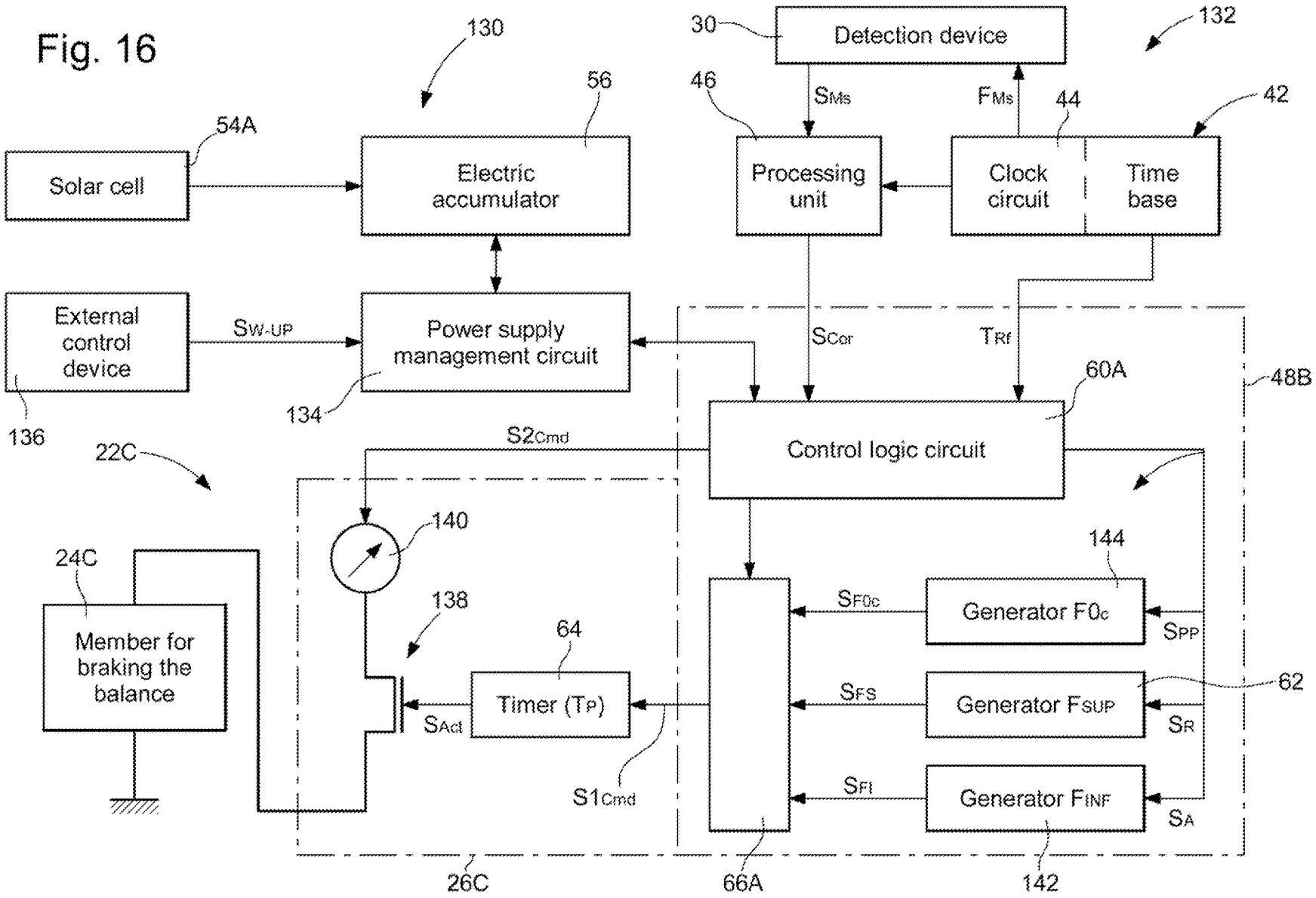
FIG. 16 schematically shows a fourth embodiment of a timepiece according to the invention.

A fourth embodiment of a timepiece is described hereinbelow with reference to FIG. 16 and FIG. 1. This fourth embodiment is a preferred embodiment which differs from the first embodiment substantially as a result of the gain-correction mode thereof.

The electrical power supply 130 to the correction device 132 comprises an energy harvester formed by a solar cell 54A, in particular arranged at the dial or the bezel bearing the glass protecting the dial. This dial generally forms a part of the time display. Moreover, an external control device 136 is provided so as to supply an activation signal to the correction device, upon request from a user of the timepiece, to initiate/start in the timepiece a cycle for correcting the time displayed (in other words to launch the method for correcting the time displayed which is implemented within the correction device 132).

The electrical power supply 130 comprises a circuit 134 for managing the power supply to the correction device 132. This circuit is capable of receiving various information from the electric accumulator 56 and it receives, from the external control device 136 a wake-up signal $S_{W\text{-}UP}$ when this device is actuated by a user. Once the management circuit 134 has received a wake-up signal, it detects the energy level available in the accumulator 56. Similarly to the first embodiment, if the energy level is insufficient to complete the correction method, the management circuit can react in various ways. It can in particular remain on standby for an electrical energy supply via the solar cell thereof or other energy harvesting means also provided, or start, insofar as possible, a correction cycle knowing that there is a risk it cannot correctly complete the cycle due to the available energy being insufficient. In an alternative embodiment, if the energy level is insufficient to carry out a complete correction cycle but sufficient to carry out a detection phase, the correction device directly carries out such a detection phase, only powering the parts required for this detection phase, while waiting for a new provision of electrical energy to be able to subsequently carry out a correction phase. Generally, when the available energy level is sufficient for a correction cycle, the management circuit 134 activates the correction device to carry out a correction cycle.

Since the fourth embodiment is characterised by an implementation of the first loss-correction mode, similarly to the first embodiment, and of the first gain-correction mode, described hereinabove but not implemented in the first embodiment, any correction provided for here is carried out by a series of periodic braking pulses during a correction period. One main alternative embodiment provides for all of the braking pulses having the same duration Tp. Thus, only one timer 64 is required to determine the duration of the braking pulses and this timer is arranged, in the alternative embodiment shown in FIG. 16, in the power supply circuit 26C. This timer provides an activation/actuation signal $S_{Act}$ to a switch 138 placed between a voltage source 140 and the braking member 24C acting on the balance. The braking member 24C is, for example, similar to the piezoelectric strip (FIG. 1) of the alternative embodiment shown for the first embodiment or to the flexible strip associated with the magnet-coil system (FIG. 15) of the third embodiment. Thus, the switch 138 controls the power supply to the actuator forming the braking device. The timer 64 receives a first control signal $S1_{Cmd}$ from a switching device 66A which is controlled by the logic circuit 60A such that the first control signal is selectively formed by a periodic digital signal from among three periodic digital signals provided $S_{FS}$, $S_{FI}$ and $S_{F0c}$ which respectively have three different frequencies $F_{SUP}$, $F_{INF}$ and F0c. The periodic digital signal periodically resets the timer to the selected frequency and, in response, this timer periodically activates the actuator for a duration Tp, by momentarily making the switch 138 conducting, to generate a series of periodic braking pulses at this selected frequency.

When an overall time error determined by the correction device corresponds to a loss to be corrected, the logic circuit 60A determines, as a function of the selected frequency $F_{SUP}$, a corresponding correction period $PR_{Cor}$ or, in an equivalent manner, a number of periodic braking pulses to be generated at the frequency $F_{SUP}$ during the ongoing correction cycle. To achieve this, it uses the formula regarding this determination described hereinabove. To apply the series of braking pulses at the frequency $F_{SUP}$ resulting in a correction frequency $FS_{Cor}$ that is greater than the setpoint frequency, it uses the frequency generator 62, described hereinabove, which provides a periodic digital signal $S_{FS}$ at the frequency $F_{SUP}$ to the timer 64 via the switch 66A, which is controlled for this purpose by the control logic circuit.

When an overall time error determined by the correction device corresponds to a gain to be corrected, the logic circuit 60A determines, as a function of the selected frequency $F_{INF}$, a corresponding correction period $PA_{Cor}$ or a number of periodic braking pulses to be generated at a frequency $F_{INF}$, defined hereinabove, during the ongoing correction cycle. To achieve this, it uses the formula regarding this calculation described hereinabove. To apply the series of braking pulses at the frequency $F_{INF}$ resulting in a correction frequency $FI_{Cor}$ that is less than the setpoint frequency, it uses the frequency generator 142 which provides a periodic digital signal $S_{FI}$ at the frequency $F_{INF}$ to the timer 64 via the switch 66A, which is controlled for this purpose by the control logic circuit.

In general, to allow for the implementation of the first gain-correction mode, the electronic control unit 48B is arranged such that it can provide the braking device, when the correction signal $S_{Cor}$ provided by the processing unit corresponds to a gain in the time displayed that is to be corrected, with a control signal derived from a periodic digital signal provided by a frequency generator at a frequency $F_{INF}$, during a correction period, to activate the braking device such that it generates a series of periodic braking pulses applied to the mechanical resonator at the frequency $F_{INF}$. This frequency $F_{INF}$ is provided and the braking device is arranged such that the series of periodic braking pulses at the frequency $F_{INF}$ can, during the correction period, result in a synchronous phase wherein the oscillation of the mechanical resonator is synchronised to a correction frequency $FI_{Cor}$ which is less than the setpoint frequency F0c provided for the mechanical resonator. The (duration of the) correction period and thus the number of periodic braking pulses in said series of periodic braking pulses are determined by the gain to be corrected.

The correction device of the fourth embodiment comprises an enhancement to increase the precision of the correction carried out and also allow relatively high braking torques to be applied, in particular for corrections at frequencies that are relatively far from the setpoint frequency, without the risk of sustainably halting the mechanical resonator by bringing same to a halt, during a braking pulse at the start of the correction period, within the angular coupling zone of the resonator with the escapement, or generally within the angular safety zone described hereinabove. According to this enhancement, the timepiece comprises a device for determining the passage of the oscillating mechanical resonator through at least one specific position, this device for determining a specific position of the mechanical resonator allowing the electronic control unit to determine a specific moment at which the oscillating mechanical resonator is located in said specific position, and thus to determine the phase of the resonator. Furthermore, the electronic control unit is arranged such that a first activation of the braking device occurring at the start of the correction period, to produce a first interaction between this braking device and the mechanical resonator, is initiated as a function of said specific moment.

According to an advantageous alternative embodiment of the enhancement described hereinabove and with reference to FIG. 16, the correction device further comprises a frequency generator 144 which is arranged such that it can generate a periodic digital signal $S_{F0c}$ at the setpoint frequency F0c provided for the resonator. The control unit 48B is arranged such that it can provide the braking device with a control signal derived from the periodic digital signal $S_{F0c}$, during a preliminary period directly preceding the correction period, to activate the braking device such that this braking device generates a preliminary series of periodic braking pulses which are applied to the mechanical resonator at the setpoint frequency F0c. For this purpose, the control logic circuit 60A provides the generator 144 with a control signal SPP. The duration Tp of the periodic braking pulses and the braking force applied to the oscillating resonator, during the preliminary series of periodic braking pulses, are provided such that none of these braking pulses can bring the oscillating resonator to a halt in the coupling zone of this oscillating resonator with the escapement associated therewith (between $-\theta_{ZI}$ and $\theta_{ZI}$) or, preferably, in a predefined safety zone (between $-\theta_{Sec}$ and $\theta_{Sec}$) covering the coupling zone (these zones are described hereinabove).

Furthermore, the duration of the preliminary period and the braking force applied to the oscillating resonator, during the preliminary series of periodic braking pulses, are provided so as to produce, at least at the end of the preliminary period, a preliminary synchronous phase wherein the oscillation of the mechanical resonator is synchronised (on average) to the setpoint frequency F0c. In the alternative embodiment shown, the electrical voltage source 140 is variable and controlled by the logic circuit 60A which provides it with a control signal $S2_{Cmd}$, such that the voltage level applied to the braking member 24C can be varied in order to vary the braking force. A braking force can thus be applied during the preliminary period that is weaker than that applied during a following correction period. The braking force can also be varied during the preliminary period and/or the correction period. In an alternative embodiment, the braking frequency during the preliminary period is equal to 2·F0c, which also results in a synchronisation to the frequency F0c by applying one braking pulse per alternation.

The correction period intended to correct a gain or a loss directly follows the preliminary period. More specifically, the initiation of a first braking pulse at the frequency $F_{INF}$ or $F_{SUP}$, at the start of a period for correcting the time displayed, occurs after a time interval determined relative to a moment at which the last braking pulse of the preliminary period was initiated, such that this first braking pulse occurs outside a predefined safety zone covering the aforementioned coupling zone. This condition is easily met since the resonator is in a synchronous phase at least at the end of the preliminary period, which consequently means that the resonator comes to a halt during the last braking pulse of this preliminary period. Thus, a reversion of the direction of rotation occurs during said last braking pulse such that the start of a new alternation of the oscillation of the resonator occurs during this last braking pulse. The correction device can thus know the oscillation phase with a precision of Tp/2 (for example a precision of 3 ms). As a result, the electronic control unit can be arranged such that the control logic circuit can determine an initial moment for initiating the first braking pulse which meets the aforementioned condition, by activating the frequency generator 62 or 142, depending on the required correction, after a determined time interval has passed since said last braking pulse which ensures that the first braking pulse is outside the predefined safety zone.

Moreover, the moment at which said first braking pulse is initiated and the braking force applied to the oscillating resonator, during this first pulse, and subsequently during following periodic braking pulses during the correction period, are provided such that the synchronous phase at the correction frequency $FI_{Cor}$ or $FS_{Cor}$ preferably starts as soon as the first braking pulse is applied, or as soon as a second braking pulse is applied if the first braking pulse is intended to reduce the amplitude of the oscillation without managing to bring the resonator to a halt, and such that this synchronous phase lasts throughout the entire duration of the correction period. In a specific alternative embodiment, the first braking pulse of the correction period occurs after a time interval corresponding to the inverse of the frequency $F_{SUP}$ or $F_{INF}$, depending on the required correction, after the moment at which the last braking pulse of the preliminary period occurs. In another specific alternative embodiment, said time interval is selected such that it is equal to the inverse of double the correction frequency $FS_{Cor}$ or $FI_{Cor}$, depending on the required correction, or to the inverse of this frequency $FS_{Cor}$ or $FI_{Cor}$. The enhancement described hereinabove is noteworthy in that it uses available resources, in particular the braking device provided for carrying out the required correction, to determine the oscillation phase of the resonator. No specific sensor is required to determine this phase. Moreover, no significant time drift is induced by the preliminary period (generally T0c/4 maximum). It can be seen that the generators at the various frequencies have been shown in a separate manner in FIG. 12, however a single programmable frequency generator can be used.

A fifth embodiment of a timepiece according to the invention is described hereinbelow with reference to FIG. 17 to 19. This fifth embodiment is arranged to allow the second gain-correction mode, described hereinabove in the preceding embodiments, to be implemented, in addition to a second loss-correction mode which will be described here in more detail.

Figure 17:
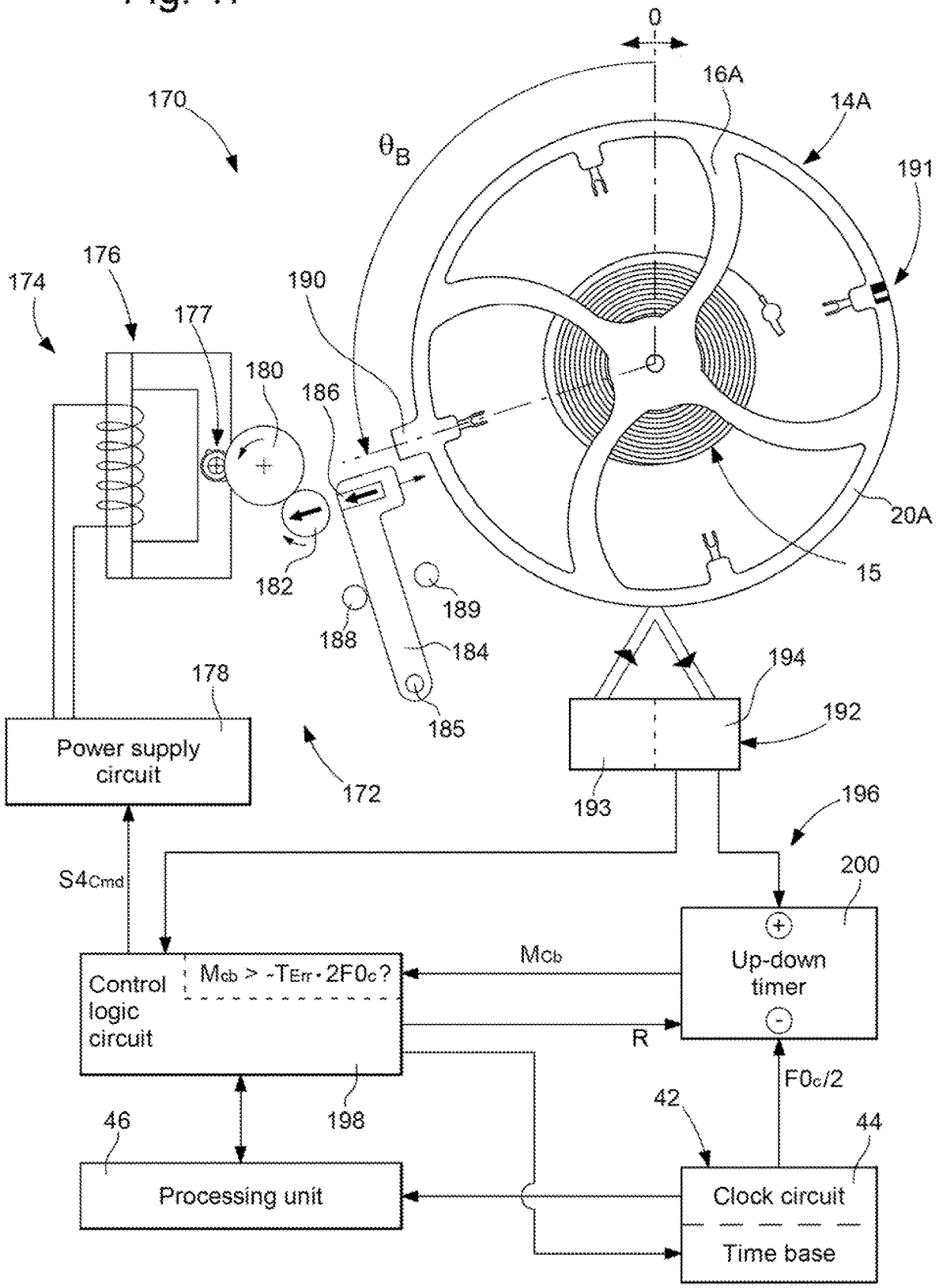
FIG. 17 schematically shows a fifth embodiment of a timepiece according to the invention.

The timepiece 170 according to the fifth embodiment is partially illustrated in FIG. 17, where only the mechanical resonator 14A of the mechanical movement is shown. With the exception of the device for correcting the time displayed, the other elements of the timepiece are similar to those shown in FIG. 1. The mechanical resonator comprises a balance 16A associated with a balance-spring 15. The balance comprises a felloe 20A which has a projecting part 190 extending radially at the periphery thereof. No other element of the balance extends as far as the radial position of the end part of the projecting part 190.

The balance comprises a mark 191 formed by a non-symmetrical succession of bars having different light reflection coefficients for light originating from an optical sensor 192 or simply a different reflection of this light, in particular a succession of at least two black bars of different widths and separated by a white bar, the width of one of the two black bars being equal to the sum of the widths of the other black bar with the white bar. It is understood that the bars thus form a sort of code with a transition in the middle of the mark 191. Instead of black bars and a white bar, other colours can be used. In an alternative embodiment, the black bars correspond to matte zones of the felloe, whereas the white bar corresponds to a glossy zone of this felloe. The black bars can also correspond to notches in the felloe that have an inclined plane. A plurality of alternative embodiments are thus possible. It should be noted that the mark 191 has been shown on the top of the felloe for the description thereof, however in the alternative embodiment illustrated, it is situated on the outer lateral surface of the felloe since the optical sensor is arranged in the general plane of the balance 16A. In another alternative embodiment, the mark is situated as shown, on the top or bottom surface of the felloe, and the sensor is thus pivoted 90° in order to illuminate this mark.

The optical sensor 192 is arranged to detect the passages of the oscillating resonator through the neutral position thereof (corresponding to the angular position '0' for the projecting part 190) and to allow the direction of motion of the balance to be determined during each passage through this neutral position. This optical sensor comprises an emitter 193 emitting a light beam towards the felloe 20A, this emitter being arranged such that it illuminates the mark 191 when the resonator passes through the neutral position thereof, and a light receiver 194 arranged to receive at least part of the light beam that is reflected by the felloe at the mark. The optical sensor thus forms a device for detecting a specific angular position of the balance, allowing the electronic control unit to determine a specific moment at which the oscillating mechanical resonator is located in the specific angular position, and also a device for determining the direction of motion of the balance during the passage of the oscillating resonator through the specific angular position. Other types of detectors for detecting the position and direction of motion of the mechanical resonator can be provided in other alternative embodiments, in particular capacitive, magnetic or inductive detectors.

Furthermore, the timepiece 170 comprises a device for braking the resonator which is formed by an electromechanical device 174 having a bistable, moving abutment. An alternative embodiment is provided as a non-limiting example in FIG. 17. The electromechanical device 174 comprises an electromechanical motor 176, of the horological stepping motor type having small dimensions, which is powered by a power supply circuit 178, which comprises a control circuit arranged to produce, when it receives a control signal $S4_{Cmd}$, a series of three electrical pulses which are provided to the coil of the motor such that the rotor 177 thereof advances by one step at each electrical pulse, i.e. by half a revolution. The series of three electrical pulses is provided to quickly drive the rotor, in a continuous or near-continuous manner. The pinion of the rotor meshes with an intermediate wheel 180 which meshes with a wheel having a diameter that is equal to three times that of the pinion of the rotor and fixedly bearing a first bipolar permanent magnet 182. Given the diameter ratio between said pinion and the wheel bearing the magnet 182, the latter revolves by half a revolution during a series of three electrical pulses. Thus, the first magnet has a first rest position and a second rest position wherein the first magnet has a magnetic polarity that is opposite that of the first rest position (the term 'rest position' is understood to mean a position in which the magnet 182 is located after the motor 176 has carried out, as instructed, a series of three electrical pulses and after the rotor thereof has then ceased to revolve).

Moreover, the actuator 174 comprises a bistable lever 184 pivoted about an arbor 185 fastened to the mechanical movement and limited in the rotation thereof by two pegs 188 and 189. The bistable lever comprises, at the free end thereof, forming the head of this lever, a second bipolar permanent magnet 186 which is capable of moving and substantially aligned with the first magnet 182, the magnetic axes of these two magnets being provided such that they are substantially collinear when the first magnet is in either of the two rest positions thereof. Thus, the first rest position of the first magnet corresponds, relative to the second magnet 186, to a position of magnetic attraction, and the second rest position thereof corresponds to a position of magnetic repulsion. Each time the control signal $S4_{Cmd}$ activates the power supply circuit so as to carry out a series of three electrical pulses, the first magnet rotates half a turn and the lever alternately passes from a stable position of non-interaction with the balance of the resonator to a stable position of interaction with this balance wherein the lever 184 thus forms an abutment for the projecting part 190, which abuts against the head of this lever when the resonator oscillates and when the projecting part reaches this head, regardless of the direction of rotation of the balance at the time of impact.

In the position of non-interaction, the moving lever is outside a space crossed by the projecting part 190 when the resonator oscillates with an amplitude in the usable operating range thereof. However, in the position of interaction, the moving lever is located partially inside this space crossed by the projecting part and thus forms an abutment for the resonator. The term 'stable position' is understood to mean a position in which the lever remains in the absence of any power supply from the motor 176 which is used to actuate the lever between the two stable positions thereof, in both directions. The lever thus forms a bistable moving abutment for the resonator. This lever thus forms a retractable stop member for the resonator. The actuator 174 is arranged such that the lever can remain in the position of non-interaction and in the position of interaction without maintaining a power supply to the motor 176.

The stop member in the position of interaction thereof and the projecting part define a first angular stop position $\theta_B$ for the balance of the oscillating resonator which is different from the neutral position thereof, the projecting part abutting against the stop member in this first angular stop position when it arrives from the angular position '0' thereof, corresponding to the neutral position of the resonator, during second half-alternation of a first determined alternation from among the two alternations of each oscillation period of the resonator. Furthermore, the angle $\theta_B$ is provided such that it is less than a minimum amplitude of the oscillating mechanical resonator in the usable operating range thereof. Moreover, the angle $\theta_B$ is provided such that the oscillating resonator is halted by the stop member outside the coupling zone of the oscillating resonator with the escapement of the mechanical movement, which has been described hereinabove. The stop member in the position of interaction thereof and the projecting part further define a second angular stop position, close to the first but greater than the latter, for the balance of the oscillating resonator when the projecting part arrives from an extreme angular position of the resonator during a first half-alternation of the second alternation from among the two alternations of each oscillation period. This second angular stop position is also provided such that it is less than a minimum amplitude of the oscillating mechanical resonator in the usable operating range thereof.

It can be seen that the projecting part 190 can, in another alternative embodiment, axially extend from the felloe or from one of the arms of the balance, and the bistable electromechanical device 174 is thus arranged such that the bistable lever has a motion in a plane parallel to the rotational axis of the balance. In this other alternative embodiment, the respective magnetisation axes of the two magnets 182 and 186 are axial and remain substantially collinear, the magnet 182 thus being arranged beneath the head of the lever. It can be seen that such an arrangement of the bistable electromechanical device can also be provided within the scope of the alternative embodiment shown with a projecting part extending radially from the felloe. It should be noted that the projecting part of the resonator can, in another alternative embodiment, be arranged about the staff of the balance, in particular at the periphery of a plate borne by this staff or formed integrally in one piece with the staff. In an alternative embodiment, such a plate is the plate that bears the escapement pin.

Finally, the timepiece 170 comprises a control unit 196 which is associated with the optical sensor 192 and arranged to control the power supply circuit 178 of the electromechanical device, to which the control unit provides the control signal $S4_{Cmd}$. The control unit comprises a control logic circuit 198, an up-down timer 200 and a clock circuit 44. This control unit is associated with the electromechanical device 174 to allow the second gain-correction mode to be implemented, in addition to the second mode for correcting a loss in the time displayed by the display of the timepiece, described hereinbelow.

To implement the second correction mode implemented in this fifth embodiment, the control unit 196 is arranged to control the electromechanical device (also referred to as the 'actuator' or 'electromechanical actuator') such that it can selectively actuate the stop member (the bistable lever 184), depending on whether a loss or a gain in the time displayed by the timepiece is to be corrected, so that this stop member is displaced from the position of non-interaction thereof to the position of interaction thereof respectively before the projecting part 190 reaches said first angular stop position OB during said second half-alternation of said first alternation of an oscillation period and before the projecting part 190 reaches said second angular stop position during said first half-alternation of said second alternation of an oscillation period.

In general, to at least partially correct a gain (positive time error), the electromechanical device is arranged such that, when the stop member is actuated to stop the mechanical resonator in a first half-alternation, the stop member momentarily prevents, after the projecting part has abutted against this stop member, the mechanical resonator from continuing the natural oscillatory motion specific to this first half-alternation, such that this natural oscillatory motion during the first half-alternation is momentarily interrupted before being continued, after a certain blocking time which ends by the withdrawal of the stop member. Preferably, the case of a bistable electromechanical device as described hereinabove provides for correcting substantially all of a positive overall time error, determined by the correction device of the timepiece according to the invention, during a continuous blocking period defining a correction period, which is substantially equal to the gain to be corrected. For this purpose, in the alternative embodiment described, after the moment at which the resonator passes through the neutral position thereof during a said second alternation of an oscillation period (alternation where the projecting part 190 reaches the head of the lever 184 before the passage of the resonator through the neutral position thereof), this second alternation being detected by the optical sensor 192 thanks to the arrangement intended to detect the direction of the oscillatory motion during the detection of the passages of the resonator through the neutral position thereof, the control unit waits until a time of T0c/4 is reached to activate the actuator such that it drives, via the motor thereof, the lever 184 from the stable position of non-interaction thereof into the stable position of interaction thereof, where the head of the lever forms an abutment for the projecting part. Depending on the value of the angular stop position, which lies for example in the range 90° to 120°, a time of less than T0c/4 can be provided, for example T0c/5, to initiate a series of three electrical pulses allowing the motor 176 to be driven such that the rotor thereof rotates quickly by one and a half revolutions, the time interval for allowing the lever to pivot between the two stable positions thereof, by reversing the direction of the magnetic flux generated by the magnet 182, thus being extended. In the latter case, it must be ensured that the projecting part has indeed exceeded the angular stop position in the alternation preceding the first half-alternation during which the resonator is intended to be blocked during a correction period.

In general, to at least partially correct a loss (negative time error), the electromechanical device is arranged such that, when the stop member is actuated to stop the mechanical resonator in a second half-alternation of at least one said first alternation of an oscillation period (alternation during which the projecting part 190 reaches the head of the lever 184 after the passage of the resonator through the neutral position thereof), it thus prematurely ends this second half-alternation without blocking the resonator, but by reversing the direction of the oscillatory motion of this resonator, such that the mechanical resonator directly begins a subsequent alternation, after being instantaneously or near-instantaneously halted by the collision of the projecting part with the stop member. Thus, within the scope of the second loss-correction mode, the detector for detecting the position and direction of motion of the resonator and the electronic control unit are arranged such that they can activate the actuator, each time the overall time error determined by the correction device corresponds to a loss in the time displayed, such that this actuator actuates the stop member thereof so that the projecting part of the oscillating resonator comes to abut against this stop member in a plurality of half-alternations of the oscillation of the mechanical resonator each of which follow the passage thereof through the neutral position, so as to prematurely end each of these half-alternations without blocking the mechanical resonator. The number of half-alternations of said plurality of half-alternations is determined by the loss to be corrected.

Figure 18:
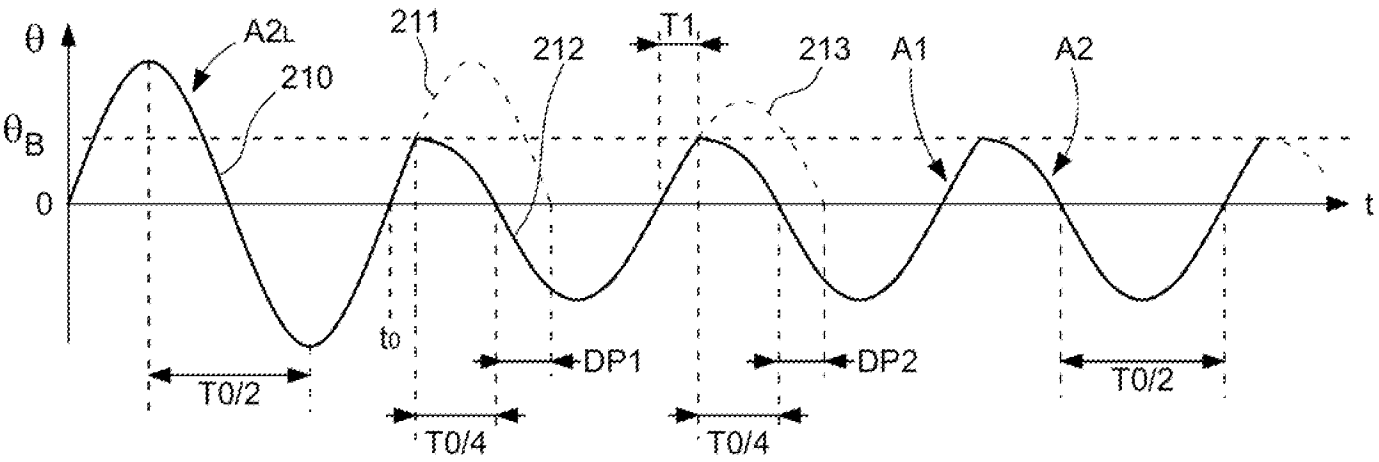
FIGS. 18 and 19 show the oscillation of the mechanical resonator during a loss-correction period respectively for two alternative embodiments of the braking device of the timepiece in FIG. 17.
Figure 19:
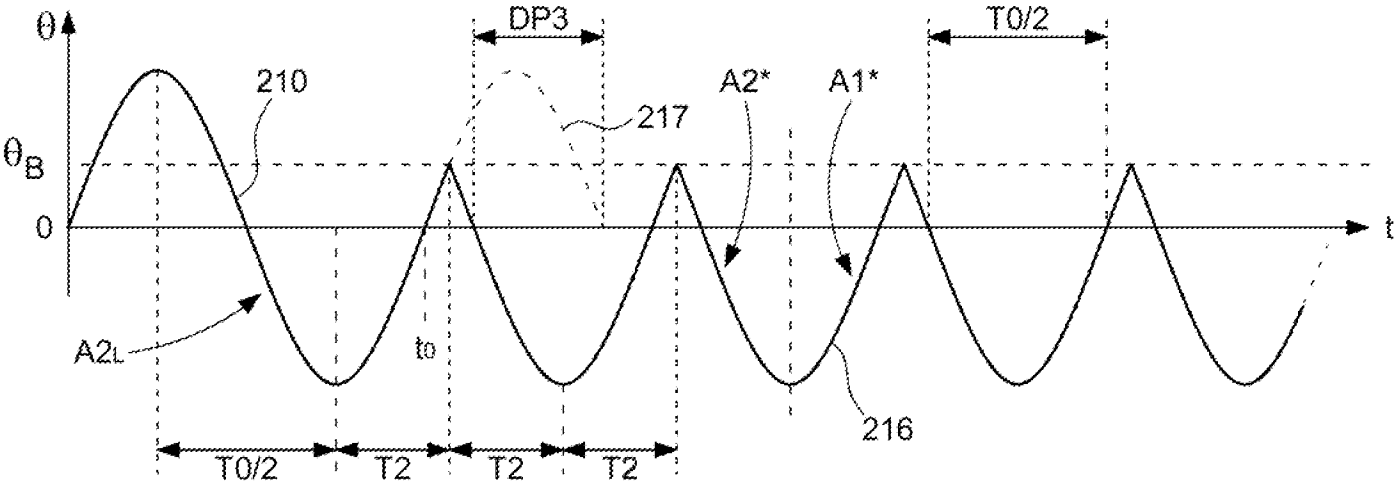

In a preferred alternative embodiment shown in FIGS. 18 and 19, the electronic control unit and the actuator are arranged such that, to at least partially correct a loss, the lever is maintained in the position of interaction thereof, after this lever is actuated from the position of non-interaction thereof to the position of interaction thereof when the oscillating resonator is located angularly on the neutral position side relative to the angular stop position, until the end of the correction period during which the projecting part of the oscillating mechanical resonator periodically abuts several times against the head of the lever, the (duration of the) correction period during which the lever is maintained in the position of interaction thereof being determined by the loss to be corrected. The pivoting of the lever from the position of non-interaction thereof to the position of interaction thereof can occur either in a said first alternation (that wherein the impact with the projecting part is intended to take place, this first alternation being detected by the detection of the direction of rotation of the balance) preferably directly after the detection of the passage through the neutral position so that the lever is placed in the position of interaction thereof before the projecting part reaches the stop angle $\theta_B$, or in a said second alternation (also detected by the detection of the direction of rotation of the balance) directly after the detection of the passage through the neutral position, this second alternative embodiment allowing more time to actuate the lever and allowing it to be placed in a stable manner in the position of interaction thereof (the stop angle is by definition less than or equal to 180°). For example, if $\theta_B$=120° and the amplitude of the free oscillation of the resonator $\theta_L$=270°, then in the second alternative embodiment, a time interval is procured corresponding to a rotation between the angle '0' and a little under 240° (360°−120°), i.e. about 230° if the angle $\theta_T$ to the rotational axis defined by the head of the lever is equal to about 10°, to carry out the pivoting of the lever (so as not to block the balance by exceeding the position of the projecting part in the second alternation); whereas in the first alternative embodiment, a time interval corresponding only to a rotation between the angle '0' and 120° is obtained. It can be seen that if $\theta_L<360°-\theta_B-\theta_T$, then much more time is available in the second alternative embodiment for the pivoting of the lever.

In general, in order to determine the duration of a loss-correction period, the control unit comprises a measuring circuit associated with the optical sensor, this measuring circuit comprising a clock circuit, providing a clock signal at a given frequency, and a comparator circuit allowing a time drift of the oscillating resonator relative to the setpoint frequency thereof to be measured, the measuring circuit being arranged such that it can measure a time interval corresponding to a time drift of the mechanical resonator from the start of the correction period. The control unit is arranged to end the correction period as soon as said time interval is equal to or slightly greater than an overall time error determined by the correction device.

In the alternative embodiment described in FIG. 17, the measuring circuit comprises a clock circuit 44, providing a periodic digital signal at the frequency F0c/2, and an up-down timer 200 (reversible timer). This up-down timer receives, at the '−' input thereof, the periodic signal of the clock circuit (causing this timer to decrement by two units for each setpoint period T0c=1/F0c) and at the '+' input thereof, a digital signal from the optical sensor 192 which comprises a pulse or a change in logic state upon each passage of the resonator 14A through the neutral position '0' thereof. Since such a passage occurs in each alternation of the oscillating resonator, the timer 200 is incremented by two units at each oscillation period. Thus, the state of the timer (integer $M_{Cb}$) is representative of a time drift of the mechanical resonator relative to the setpoint frequency which is determined by the clock circuit 44 having the precision of a quartz oscillator. The integer $M_{Cb}$ corresponds to the number of additional alternations carried out by the resonator, from an initial moment when the reversible timer is reset, relative to a case of an oscillation at the setpoint frequency.

The control logic circuit 198 receives, from the optical sensor 192, a digital signal allowing this logic circuit to determine the passages of the resonator through the neutral position thereof and the direction of the oscillatory motion at each of these passages. In order to correct a given loss, after a passage of the resonator through the neutral position thereof is detected as described hereinabove, the control logic circuit on the one hand activates the actuator 174 so that it actuates the lever into the position of interaction thereof and, on the other hand, resets the up-down timer 200, which defines the start of a correction period. It should be noted that this reset can, in an alternative embodiment, take place before powering the actuator 174 to pivot the lever, but after the control unit 196 and the optical sensor 192 have been activated. In other alternative embodiments, the optical sensor is replaced by another type of sensor, for example of the magnetic, inductive or capacitive type. In a specific alternative embodiment, the detector detecting the passage of the mechanical resonator through the neutral position thereof is formed by a miniaturised acoustic sensor (microphone of the MEMS type) capable of detecting the acoustic pulses generated by the impacts between the pin of the balance and the fork of the pallet-lever forming the escapement of the mechanical movement.

The number of alternations at the setpoint frequency F0c in a negative overall time error $T_{Err}$ (determined loss) is equal to $-T_{Err}$-2·F0c. Thus, as soon as the number $M_{Cb}$ of the up-down timer reaches this value or slightly exceeds same (since this value is not necessarily an integer), the loss determined is made up and the time displayed is once again correct (it thus gives the actual time in a precise manner, in particular with a precision of one second). The control logic circuit is thus arranged such that it can compare the state of the timer with the value $-T_{Err}\cdot 2\cdot F0c$, and such that it can end the correction period as soon as it detects that the number $M_{Cb}$ is greater than or equal to this value, by controlling the power supply circuit 178 to the actuator so that the latter actuates the lever from the stable position of interaction thereof to the stable position of non-interaction thereof.

FIGS. 18 and 19 show the oscillations of the resonator 14A, respectively in the two specific extreme cases of the preferred alternative embodiment described hereinabove, at the start of a period for correcting a given loss. FIG. 18 concerns the case wherein the kinematic energy of the resonator is fully absorbed during each impact between the projecting part of the balance and the head of the abutment. The free oscillation 210 in particular has a second free alternation $A2_L$ before a detection of a time to upon the passage of the resonator through the neutral position thereof (position '0' of the projecting part 190) in the first following alternation, the time to marking the start of a period for correcting a given loss. The lever is displaced into the position of interaction thereof directly after the time to. After the first impact between the projecting part and the lever, a relatively large positive phase difference DP1 is obtained between the fictive free oscillation 211 and the oscillation 212. A stable phase is then established wherein the oscillation 212 is shortened, relative to a fictive free oscillation 213 from the preceding halting of the resonator by the stop member, in the second half-alternation of the first alternation A1 of each oscillation period, which thus results in a positive phase difference DP2 that is smaller than DP1. The second alternation A2 of the oscillation 212 is not disrupted by the lever.

FIG. 19 concerns a specific case of a heavy impact or elastic collision between the projecting part and the head of the lever. In this case, the kinetic energy of the resonator is retained during each impact, given that there is no dissipation of the kinetic energy during the impacts, only a reversion of the direction of the oscillatory motion. The amplitude of the oscillation 216 during the correction period thus remains identical to that of the free oscillation 210, and thus of the fictive free oscillation 217 for each oscillation period. After the time to, a stable phase is established with alternations A1* and A2* of a duration T2 which is far less than T0/2, generating a relatively high positive phase difference DP3 at each oscillation period.

To obtain an elastic collision, the lever can be considered to have a certain elasticity, in particular the body of the lever and/or the head are formed by an elastic material capable of being subjected to a certain degree of compression, so as to momentarily absorb the kinetic energy of the balance and redistribute it immediately after the oscillatory motion is reversed. In such a case, the oscillation 216 will slightly exceed the stop angle $\theta_B$. In another more sophisticated alternative embodiment, it is the projecting part that is mounted elastically on the felloe of the balance. For example, the projecting part has a base forming a slide arranged in a circular slide-way machined in the felloe and an elastic element, in particular a small helical spring is arranged in the slide-way behind the slider, i.e. on the other side of the head of the lever relative to the projecting part when located in the angular position '0' thereof. In practice, the impacts between the projecting part of the balance and the abutment of the electromechanical device are generally between the two extreme situations described in FIGS. 18 and 19.

In another embodiment, the electromechanical device is formed by a monostable electromechanical actuator which comprises a moving finger arranged such that this moving finger can be alternately displaced between a first radial position and a second radial position when this actuator is respectively not activated (not powered) and activated (i.e. powered). The first radial position of the finger corresponds to a position of non-interaction with the balance of the oscillating resonator and the second radial position thereof corresponds to a position of interaction with the oscillating balance wherein this finger thus forms an abutment for the projecting part of the oscillating balance, in a similar manner to the head of the lever 184.

In a preferred general alternative embodiment, the correction device is arranged such that it can be periodically activated, in an automatic manner, to carry out a correction cycle during which the detection device is activated during a detection phase, so as to allow the electronic correction circuit to determine an overall time error, and the braking device is then activated to correct, during a correction period, at least a large part of this overall time error.

One specific embodiment of the present invention provides for using the braking device of the correction device and the internal clock circuit not only to correct a time error detected in the display of the actual time, but also to implement a regulation such as that provided for in the international patent document WO 2018/177779 cited hereinabove. According to the disclosure of this document, a mechanical braking device of the type described within the scope of the present description, is used to impose an average frequency on the oscillating mechanical resonator which is synchronised to a setpoint frequency F0c determined by an internal electronic clock circuit providing a periodic reference signal. To achieve this, the regulating device continuously and periodically activates the mechanical braking device at a braking frequency derived from the periodic reference signal. Thanks to such a regulation, a time drift of the oscillating mechanical resonator can be effectively prevented as long as the regulating device is active (in particular powered with electricity). By advantageously combining the regulating device described in the international patent document WO 2018/177779 and the correction device according to the present invention (sharing the mechanical braking device and the clock circuit), the frequency at which the correction device must be activated can be limited, which can surprisingly result in reduced electricity consumption despite the fact that the regulating device is permanently active.

Without the regulating device, the correction device is, for example, activated once a week to carry out a correction cycle (with a mechanical watch that is relatively precise in other respects, this can ensure that the time error does not exceed one minute). To fully benefit from the correction device and have a watch for which the error in the actual time displayed remains less than the common daily error (in particular less than 10 seconds), the correction device is advantageously activated once a day. If looking for a precision in the order of one second, correction cycles must be carried out periodically, for example every three or four hours, which thus results in a relatively high power consumption. However, by implementing the regulation method (which a priori does not require any additional resources), the correction device could be automatically activated just once a month, or less, as long as the mechanical movement runs without stopping. However, it can be seen that it is not rare for a mechanical watch to stop if, for a movement of the conventional automatic type, the user thereof does not wear the watch for several days a week and if, for a manually-wound movement, the user thereof does not regularly wind the watch. In such a case, after a subsequent rewinding of the barrel, the display must be reset to the precise actual time, which is generally carried out manually by the user. Moreover, the watch can be subjected to disruptions (for example impacts or strong accelerations capable of causing a hand to slide about the axis thereof, in addition to the momentary presence of a strong external magnetic field, etc.). As stated hereinabove, an external intervention (manual hand-setting using an external control member) can also vary the display. In all of these situations, the correction device according to the present invention is required in order to guarantee that the watch precisely displays the actual time. However, if the correction device is controlled by appropriate sensors or detectors such that it is activated after a disruptive or potentially disruptive event, in particular after the hands are set manually as stated hereinabove, the implementation of the regulation method in a timepiece according to the present invention can be advantageous.

In one advantageous embodiment, the timepiece comprises an external control member capable of being actuated by a user of the timepiece, this external control member and the correction device being arranged to allow a user to activate the correction device so that it carries out a correction cycle during which the detection device is activated for a detection phase, so as to determine an overall time error, and the braking device is then activated to correct, during a correction period, at least a large part of this overall time error. In a specific alternative embodiment, the external control member is formed by a crown associated with a control stem which also act to manually set the display to the actual time. In a preferred alternative embodiment, the possibility of controlling the correction device using an external control member so that it carries out a correction cycle is combined with an internal automatic control which periodically activates the correction device so that it routinely carries out a correction cycle.

Reference is made to FIG. 20 to 24 to describe a second embodiment of the detection device which is arranged in a timepiece 260 such that it can indirectly detect the passage of at least one indicator of the display through at least one corresponding reference time position. In general, the detection device is arranged such that it can detect at least one predetermined respective angular position of a wheel integral with the indicator considered or of a detection wheel, forming the drive mechanism or complementing same, which drives or which is driven by the wheel integral with the indicator. Where appropriate, the detection wheel is selected or configured so as to have a rotational speed that is less than that of the wheel integral with the indicator and a gear ratio R equal to a positive integer or the inverse of an integer depending on whether the detection wheel is respectively driving or driven. The predetermined angular position that is detected by a detection unit of the detection device corresponds to a reference time position given for the indicator considered. Thus, the detection of the moment of passage of the wheel integral with the indicator or of the detection wheel through said predetermined angular position allows a time error to subsequently be determined, as described hereinabove for the first embodiment of the detection device relative to a direct detection.

Figure 20:
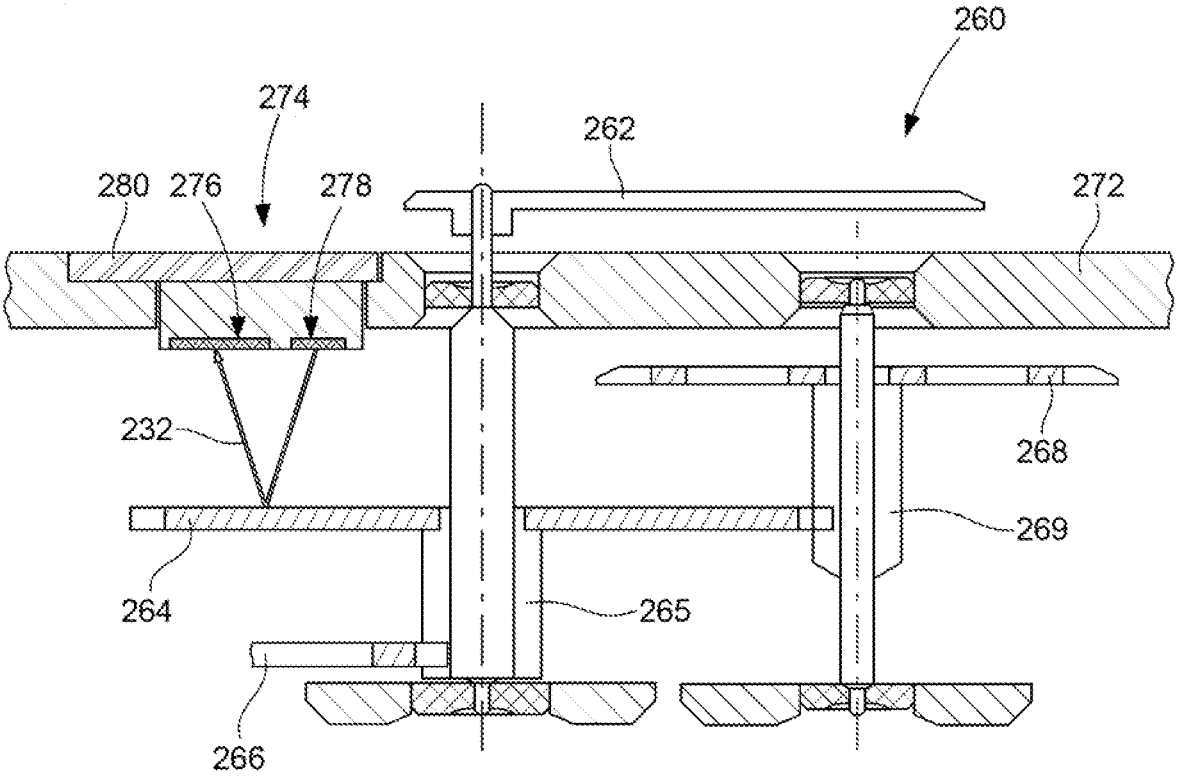
FIG. 20 is a first partial cross-section made through a timepiece according to the invention, which comprises a second embodiment of the detection device for the display, in relation to a first unit for detecting the passage of the seconds hand through a corresponding reference time position.
Figure 21:
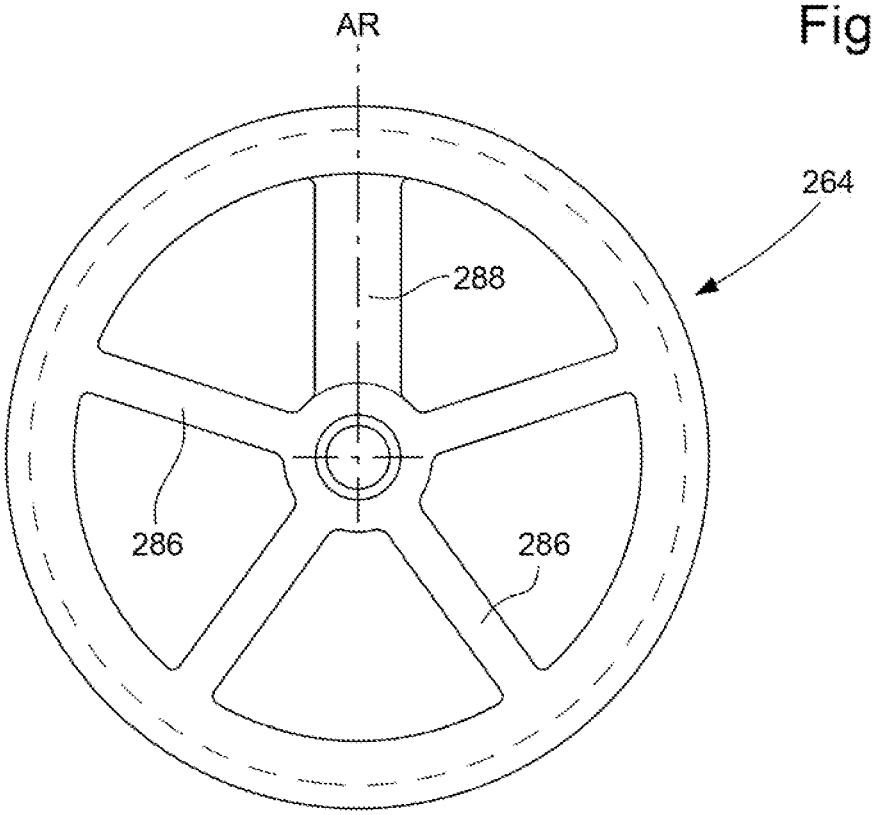
FIG. 21 is a top view of the seconds wheel (also named 'fourth wheel') of the mechanical movement forming the timepiece in FIG. 20.

FIGS. 20 and 21 show an advantageous arrangement of an optical detection unit 274 for detecting the passage of the seconds hand 262 through a given reference time position. This detection is carried out in an indirect manner by detecting a specific reference axis AR of the seconds wheel 264 bearing this hand. The seconds wheel is conventionally driven in rotation by a third wheel 266 via the seconds-wheel pinion 265. The seconds wheel 264 is, in the example given, directly meshed with the escape wheel set which is formed by an escape wheel 268 and a pinion 269. The escape wheel 268 is coupled to the resonator of the mechanical movement in question.

The detection device comprises an optical detection unit 274 associated with the seconds hand 262 and arranged such that it can detect a predetermined angular position of the seconds wheel. This detection unit is similar to any optical detection unit described within the scope of the first embodiment. It should be noted that a detection unit of another type can be provided, in particular of the capacitive, magnetic or inductive type. The reference axis AR, defining said predetermined angular position of the seconds wheel 264, is defined by a specific arm 288 of this wheel which has a different width to that of the other arms 286 of the wheel. This arm 288 has at least one reflective zone in the region covered by the light beam 232, emitted by the light source, during the passage thereof under the detection unit 274. For the wheel to remain in equilibrium, it can be seen that the arm 288 has a reduced thickness since it has about double the width of the other arms. The detection unit 274 is arranged on a support 280, in particular a PCB, and is inserted into an opening in the plate 272.

The processing unit 46 (FIG. 1) determines the reference axis AR on the basis of a series of measurements at a given measurement frequency $F_{Ms}$, similarly to the determination of the mid-longitudinal axis of the minutes hand in the first embodiment of the detection unit, and thus the moment of passage of this mid-longitudinal axis beneath the mid-longitudinal axis of the detection unit 274, which comprises a light source 278 and a photodetector 276 aligned in a radial direction of the seconds wheel. The overlaying of the mid-longitudinal axes of the specific arm and of the detection unit defines the predetermined reference time position. Using the same notation used hereinabove (when describing the operation of the processing unit 46), said overlaying of the mid-longitudinal axes, during a detection phase, determines the moment of passage $T_{X0}$ of the seconds hand through the reference time position X0. Thus, the clock must angularly position the seconds hand relative to the seconds wheel so that, during said overlaying of the mid-longitudinal axes, the seconds hand indicates a current second corresponding to the predetermined reference time position.

Figure 22:
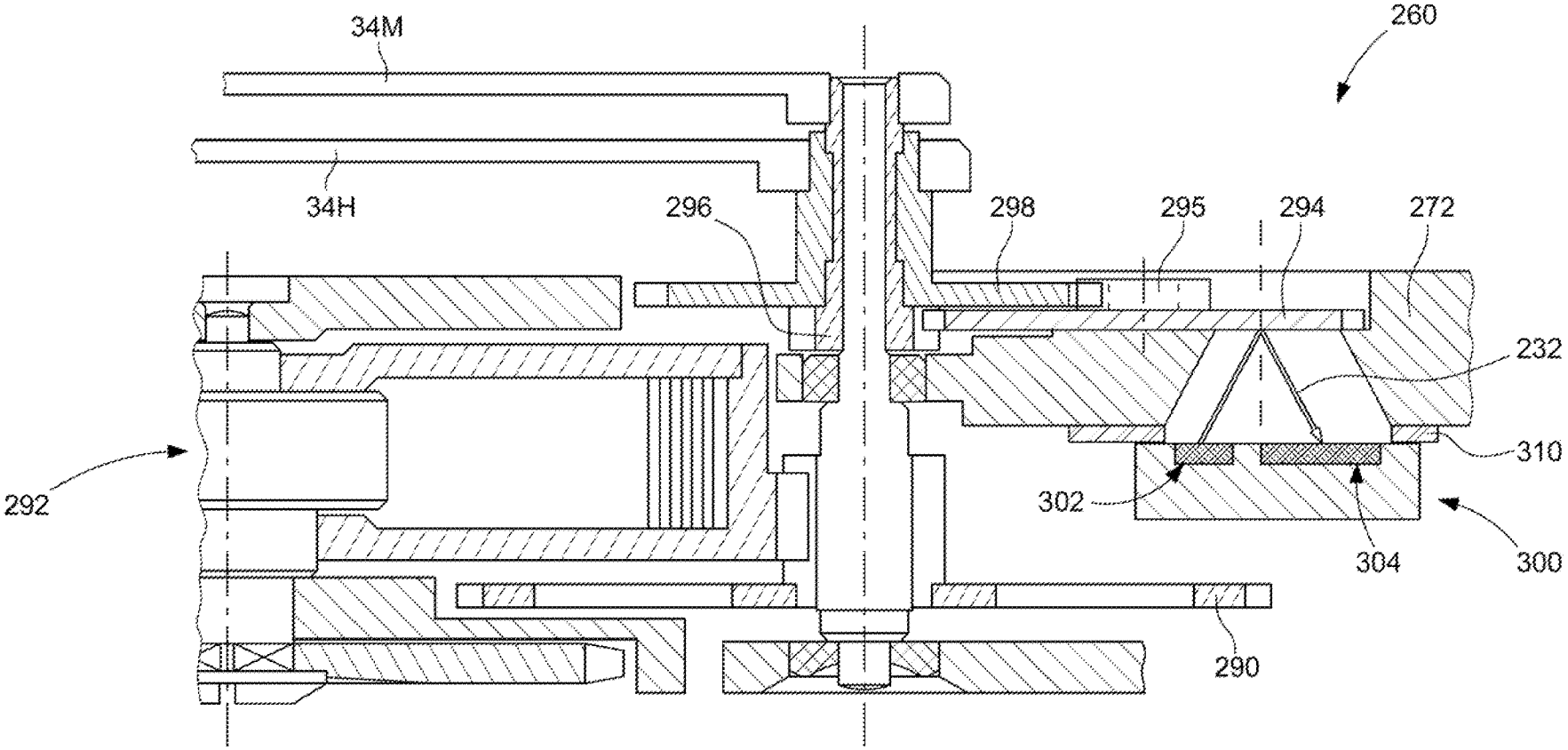
FIG. 22 is a second partial cross-section made through the timepiece in FIG. 20, in relation to a second unit for detecting the passage of the minutes hand through a corresponding reference time position.
Figure 23:
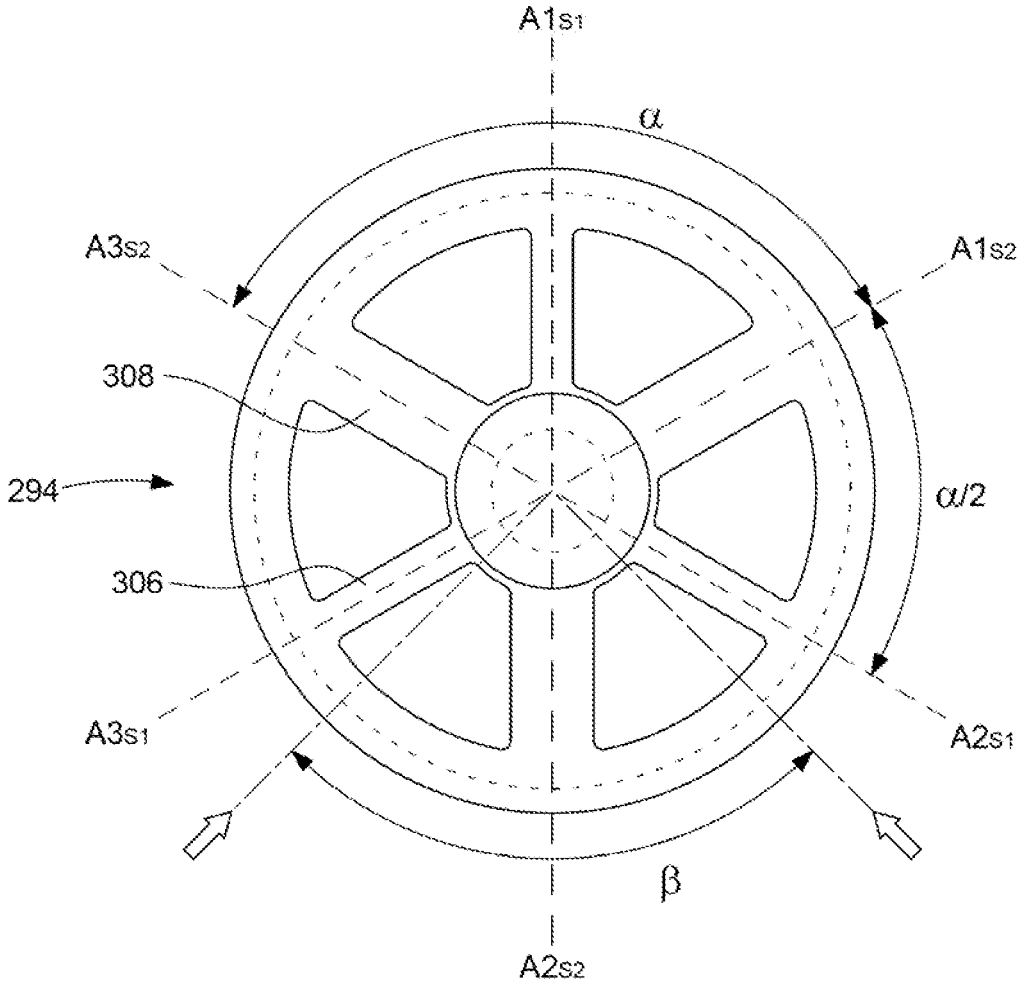
FIG. 23 is a top view of the motion-work of the mechanical movement forming the timepiece in FIG. 22.
Figure 24:
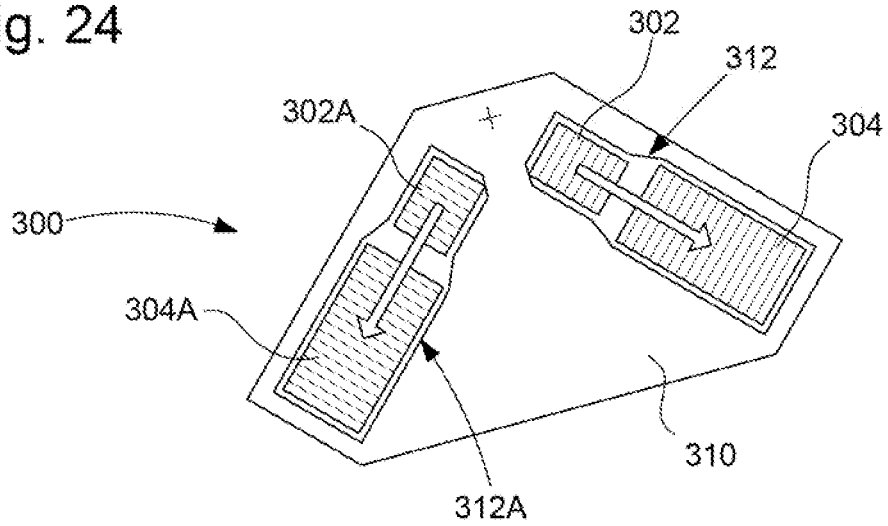
FIG. 24 is a top view of the second unit of the detection device of the timepiece in FIG. 22.

FIG. 22 to 24 show an advantageous system for detecting the passage of the minutes indicator through at least one reference time position of the display of the timepiece 260. This detection device is formed by an optical detection module 300, comprising two detection units, and a detection wheel which is arranged in a specific manner for the intended detection. Each detection unit is similar to any optical detection unit described within the scope of the first embodiment. Again, it should be noted that a detection unit of another type can be provided, in particular of the capacitive, magnetic or inductive type. The minute wheel has a gear ratio R=1/3 with the cannon-pinion driving it. There is thus a reduction ratio between the driving cannon-pinion and the driven minute wheel. FIG. 22 also shows the barrel 292 which drives the centre wheel 290. In another alternative embodiment, the detection device only comprises a single detection unit.

Since the minutes hand 34M is borne by a cannon-pinion 296 which generally has only one central cylinder forming the axis thereof and a pinion having a small diameter, the indirect detection of the passage of the minutes hand through at least one given reference time position is thus advantageously provided by way of a detection of at least one reference axis, from among at least a series of given reference axes which respectively define a series of predetermined periodic angular positions, of the minute wheel 294, which is driven in rotation by the cannon-pinion 296. This minute wheel forms a motion-work, the pinion 295 whereof meshes with the hours wheel 298 provided with a cylindrical arbor bearing the hours hand 34H. It is arranged in a recess in the plate 272. The plate supports, on the upper side, the minute wheel and supports, on the lower side, the optical detection module 300, which is thus arranged beneath the minute wheel. The plate has two through-openings which are respectively made above the two detection units to allow the light beam 232 to pass between each thereof and the minute wheel, more specifically the region in which the arms 306, 308 of this minute wheel extend. Each detection unit has a light source 302, 302A and a photodetector 304, 304A. The two optical detection units are arranged on a joint support 310 which has two openings 312, 312A respectively aligned with the two detection units.

In general, the detection device comprises at least one detection unit associated with the minutes indicator and arranged so as to detect at least a first series of R given periodic angular positions of the minute wheel, which are defined by a first series of R respective reference axes $A1_{S1}$, $A2_{S1}$ and $A3_{S1}$. Two adjacent angular positions of this first series have, therebetween, a central angle $\alpha$ equal to 360°/R where R is said gear ratio ($\alpha$=360°/3=120° with the gear ratio selected in the alternative embodiment described). In the alternative embodiment described, the detection module is further arranged such that it can also detect a second series of R given periodic angular positions of the minute wheel which are defined by a second series of R respective reference axes $A1_{S2}$, $A2_{S2}$ and $A3_{S2}$ which are different from the reference axes of the first series. Two adjacent angular positions of the second series have therebetween a central angle of the same value as the angle $\alpha$, i.e. equal to 360°/R=120°. Advantageously, if there are S series of R periodic angular positions, these S series are offset in pairs by an angle equal to 360°/(R S). In the alternative embodiment shown, this angular offset angle is equal to 360°/3·2=$\alpha$/2=60°.

Each series of periodic angular positions is associated with a respective plurality of R specific elements or specific recesses of the minute wheel. In the alternative embodiment shown, there are a plurality of arms of the minute wheel, the first series of reference axes being respectively defined by three arms 306 having a first width and the second series of reference axes being respectively defined by three arms 308 having a second width that is different from the first width. Each reference axis is detected in a similar manner to the detection of the reference axis AR and a moment of passage of the minutes hand through any of these reference axes is also determined in a similar manner to the determination of the moment of passage of the seconds hand through the reference axis AR.

In a general alternative embodiment, the minute wheel is configured such that each angular position of the first series has the same first signature for the correction device, such that the electronic correction circuit can associate the same first reference time position with the minutes indicator upon the detection of any angular position/of any reference axis of the first series, and such that each angular position of the second series has the same second signature, which is different from the first signature, for the correction device, such that the electronic correction circuit can associate the same second reference time position, which is different from the first reference time position, with the minutes indicator upon the detection of any angular position/of any reference axis of the second series. Thus, the electronic correction circuit can determine a second moment of passage $T_{Y0}$ of the minutes indicator through a reference time position Y0 (any of the two reference time positions provided for in the alternative embodiment described) in an unequivocal manner.

In another general alternative embodiment, the detection device comprises K detection units, K being an integer greater than one, and the number of series of periodic angular positions of the minute wheel is an integer S greater than zero, each series of periodic angular positions being associated with a respective plurality of R specific elements or specific recesses of the minute wheel. The K detection units are arranged such that they can each detect the S pluralities of R specific elements or specific recesses of the minute wheel. Any two of the K detection units are angularly offset by a separation angle, for which the remainder of the integer division by an angle equal to 360°/(R·S) is not zero. Preferably, the remainder of the integer division is substantially equal to 360°/(R·S·K). For the alternative embodiment shown, 360°/(3·2·2)=360°/12=30° for the preferred remainder. The separation angle $\beta$ between the two radial detection directions defined by the arrangement of the two detection units has a value $\beta$=90°. The remainder of the integer division of p by an angle of 360°/(R·S)=360°/(3·2)=60° gives a value of 30°, which corresponds to the aforementioned preferred case.

Finally, it can be seen that the number of reference time positions of the minutes indicator 34M that can be detected by the correction device with the second embodiment of the detection device is equal to S·K. In the alternative embodiment shown, this number is equal to 2·2=4. These four reference time positions are offset in pairs by 15 minutes (corresponding to an angle of 90°), which is equivalent to the advantageous alternative embodiment shown for the first embodiment of the detection device.

The invention claimed is:

1. A timepiece (2; 112; 170; 260) comprising:

a display (12) displaying an actual time, which is formed by a set of indicators comprising an indicator relating to a given time unit of the actual time and indicating the corresponding current time unit;

a mechanical movement (4; 4A; 92) comprising a mechanism (10) for driving the display and a mechanical resonator (14; 14A) which is coupled to the drive mechanism such that the oscillation thereof times the running of this drive mechanism; and a device (6; 132) for correcting the actual time indicated by the display;

wherein the device for correcting the actual time displayed comprises:

a detection device (30) arranged to allow for the detection, in a direct or indirect manner, of the passage of said indicator of the display through at least one reference time position of this display which relates to said time unit of the actual time;

an electronic correction circuit (40); and a braking device (22; 22A; 22A, 106; 22B, 114; 24C, 26C; 174) for braking the mechanical resonator;

wherein the electronic correction circuit comprises:

a control unit (48; 48A; 48B) arranged to control the detection device such that this detection device carries out, during a detection phase, a plurality of successive measurements and provides a plurality of corresponding measurement values, a processing unit (46) arranged such that it can receive, from the detection device, said plurality of measurement values and process same, and an internal time base (42) comprising a clock circuit (44) and generating a reference actual time at least formed by a reference current time unit corresponding to said current time unit of the actual time displayed; wherein the electronic correction circuit is arranged and the duration of the detection phase is provided to allow the detection device to detect, when the drive mechanism is running and timed by the oscillating mechanical resonator, at least a passage of said indicator through any reference time position from said at least one reference time position; wherein the electronic correction circuit is arranged such that it can determine at least one moment at which said indicator passes through said any reference time position on the basis of at least one measurement value from said plurality of measurement values and one corresponding moment of measurement, which is determined by the internal time base and formed by at least a corresponding value of said reference current time unit; wherein the electronic correction circuit is further arranged such that it can determine a time error of said indicator, by comparing said at least one moment of passage with said reference time position, and an overall time error ($T_{Err}$) for said set of indicators of the display as a function of at least said time error of said indicator; and wherein the control unit is arranged such that it can control the braking device as a function of said overall time error, the braking device being arranged such that it can act, during a correction period, on the mechanical resonator, as a function of said overall time error, to vary the running of the drive mechanism of the display so as to correct at least part of this overall time error.

2. The timepiece according to claim 1, wherein the control unit (48; 48A; 48B) and/or the processing unit (46) is/are connected to the internal time base (42) so as to be able to save in memory said reference actual time at at least one given moment of the detection phase; wherein the electronic correction circuit (40) is arranged such that it can determine, during the detection phase, at least a first moment of measurement and a second moment of measurement respectively corresponding to at least a first measurement and a second measurement from among said plurality of successive measurements, these first and second moments of measurement being determined by the internal time base, the first moment of measurement being formed by at least a corresponding first value of said reference current time unit and the second moment of measurement being formed by at least a second value of this reference current time unit; and wherein the electronic correction circuit is arranged such that it can subsequently calculate, as a function of said at least a first moment of measurement and a second moment of measurement and of the corresponding measurement values, a third moment which determines said moment of passage of said indicator through said reference time position.

3. The timepiece according to claim 1, wherein said display (12) comprises an hours indicator (34H) giving the current hour, a minutes indicator (34M) giving the current minute and a seconds indicator (34S; 262) giving the current second of the actual time displayed; wherein said reference actual time generated by the internal time base is formed by at least a reference current second and a reference current minute; wherein the detection device (30) is arranged such that it can detect the passage of the seconds indicator through at least a first reference time position of the display and the passage of the minutes indicator through at least a second reference time position of this display; wherein the electronic correction circuit (40) is arranged and the duration of the detection phase is provided to allow the detection device to detect, during this detection phase, when said drive mechanism (10) is running and timed by the oscillating mechanical resonator (14), at least a passage of the seconds indicator through any first reference time position from said at least one first reference time position and at least a passage of the minutes indicator through any second reference time position from said at least one second reference time position; wherein the electronic correction circuit (40) is arranged such that it can determine, in conjunction with the internal time base (42) and on the basis of measurement values from said plurality of measurement values, at least one first moment of passage of the seconds indicator through said any first reference time position, this first moment of passage being formed at least by a corresponding value of said reference current second, and at least one second moment of passage of the minutes indicator through said any second reference time position, this second moment of passage being formed at least by a corresponding value of said reference current minute; and wherein the electronic correction circuit (40) is arranged such that it can determine a first time error for said seconds indicator (34S; 262), by comparing said at least one first moment of passage with said first reference time position, and a second time error for said minutes indicator (34M) by comparing said at least one second moment of passage with said second reference time position; the electronic correction circuit being further arranged such that it can determine said overall time error ($T_{Err}$) for the display (12) as a function of said first time error and of said second time error.

4. The timepiece according to claim 3, wherein, during the detection phase, the detection device (30) is activated so as to carry out said plurality of successive measurements at at least one measurement frequency determined by said clock circuit (44) of the internal time base (42), said measurement frequency being variable, the clock circuit providing a periodic digital signal at the measurement frequency directly to the detection device or indirectly to this detection device via the control unit (48; 48A; 48B); and wherein the correction device (6; 132) is arranged such that it can detect the passage of the seconds indicator (34S; 262) through said at least one first reference time position with a first measurement frequency $FS_{Mes}$ and the passage of the minutes indicator (34M) through said at least one second reference time position with a second measurement frequency $FM_{Mes}$ that is less than the first measurement frequency.

5. The timepiece according to claim 4, wherein the first measurement frequency $FS_{Mes}$ is provided such that it is less than three times a setpoint frequency for said mechanical resonator and greater than or equal to 1 Hz, i.e. $1\ Hz <= FS_{Mes} < 3 \cdot F0c$, whereas the second measurement frequency $FM_{Mes}$ is provided such that it is less than or equal to ⅛ Hz ($FM_{Mes} <= ⅛\ Hz$).

6. The timepiece according to claim 4, wherein said first measurement frequency $FS_{Mes}$ has a value that is different from double the setpoint frequency F0c divided by a positive integer N, i.e. $FS_{Mes} \neq 2 \cdot F0c/N$.

7. The timepiece according to claim 3, wherein at least the minutes indicator, from among said set of indicators, is of the analogue type, this minutes indicator giving the current minute as a positive integer and a fractional part; wherein the timepiece further comprises a hand-setting device which is arranged to momentarily break the kinematic link between the minutes indicator and the seconds indicator to set manually the minutes indicator; and wherein the electronic correction circuit is arranged such that it can determine said overall time error ($T_{Err}$) for said display also as a function of at least one predefined correction criterion for the seconds indicator and/or the minutes indicator.

8. The timepiece according to claim 7, wherein said overall time error is determined so as to substantially correct the first time error for the seconds indicator during said correction period.

9. The timepiece according to claim 8, wherein said overall time error is determined such that the minutes indicator has, at the end of said correction period, for the case whereby this minutes indicator thus has a time difference corresponding to a loss, at most a maximum loss which is selected in a range of values of said fractional part of the current minute displayed.

10. The timepiece according to claim 1, wherein, during the detection phase, the detection device (30) is activated so as to carry out said plurality of successive measurements at at least one measurement frequency determined by said clock circuit (44) of the internal time base (42), this clock circuit providing a periodic digital signal at the measurement frequency directly to the detection device or indirectly to this detection device via the control unit (48; 48A; 48B).

11. The timepiece according to claim 1, wherein the device (6; 132) for correcting the actual time displayed comprises a sensor (192) associated with said mechanical resonator (14A) and arranged such that it can detect the passages of the oscillating mechanical resonator through the neutral position thereof, corresponding to the position of minimum potential energy thereof; and wherein, during the detection phase, said detection device (30) is activated and controlled by said control unit (48; 48A; 48B) associated with the internal time base (42) to carry out said plurality of successive measurements, each following the detection of a passage of the mechanical resonator through the neutral position thereof and after a certain time difference from this detection.

12. The timepiece according to claim 11, wherein said time difference lies in the range T0c/8 to 3·T0c/8, where T0c is the setpoint period equal to the inverse of the setpoint frequency.

13. The timepiece according to claim 1, wherein the detection device (30) is arranged in the timepiece such that it can directly detect said passage of said indicator of the display through said at least one reference time position, this indicator being arranged such that it can be detected by the detection device.

14. The timepiece according to claim 13, wherein the detection device (30) is of the optical type and comprises at least one light source (228), each capable of emitting a light beam, and at least one photodetector (227), each capable of detecting the light emitted by a light source from said at least one light source, said indicator having a reflecting surface (RS1, RS2) which passes through the one or more light beams emitted by said at least one light source during passages of this indicator through said at least one reference time position, the detection device and the reflecting surface being configured such that this reflecting surface can reflect, upon a passage of said indicator through any reference time position from said at least one reference time position, the incident light, provided by a light source from said at least one light source, at least partially in the direction of a respective photodetector from said at least one photodetector.

15. The timepiece according to claim 14, wherein said reflecting surface is formed by a bottom surface of said indicator, said at least one light source and said at least one photodetector being supported by a dial (32) of the timepiece or housed at least partially in the dial, or situated beneath the dial which is thus arranged to allow the one or more light beams to pass therethrough.

16. The timepiece according to claim 14, wherein the light emitted by said at least one light source is not visible to the human eye.

17. The timepiece according to claim 1, wherein the detection device is arranged in the timepiece such that it can indirectly detect said passage of said indicator of the display through said at least one reference time position, the detection device being arranged such that it can detect at least one predetermined respective angular position of a wheel (264) integral with the indicator or a detection wheel (294), forming the drive mechanism or complementing same, which drives or which is driven by the wheel integral with the indicator; and wherein the detection wheel (294), where appropriate, is selected or configured to have a rotational speed that is less than that of a rotating element (296) of said drive mechanism which is integral with said indicator and a gear ratio R with said rotating element that is equal to a positive integer or the inverse thereof depending on whether the detection wheel is respectively driving or driven.

18. The timepiece according to claim 17, wherein said indicator is a seconds indicator (262), wherein said wheel integral with the indicator is a seconds wheel (264), the detection device comprising a detection unit (274) associated with the seconds indicator and arranged such that it can detect a predetermined angular position of the seconds wheel.

19. The timepiece according to claim 17, wherein said indicator is a minutes indicator (34M), wherein said detection wheel is a minute wheel (294) which is driven in rotation by a cannon-pinion (296) forming the rotating element integral with the minutes indicator; and wherein the detection device comprises at least one detection unit (302, 304) associated with the minutes indicator and arranged to detect at least a first series of R given periodic angular positions of the minute wheel, two adjacent angular positions of this first series having a central angle equal to 360°/R therebetween.

20. The timepiece according to claim 19, wherein said detection unit (302, 304) is arranged such that it can further detect a second series of R given periodic angular positions of the minute wheel (294), which are different from the angular positions of the first series, two adjacent angular positions of the second series having a central angle equal to 360°/R therebetween; and wherein the minute wheel is configured such that each angular position of the first series has the same first signature for the correction device (6; 132), such that the electronic correction circuit (40) can associate the same first reference time position with the minutes indicator upon the detection of any angular position of the first series, and such that each angular position of the second series has the same second signature, which is different from the first signature, for the correction device, such that this electronic correction circuit can associate the same second reference time position, which is different from the first reference time position, with the minutes indicator upon the detection of any angular position of the second series.

21. The timepiece according to claim 19, wherein the detection device comprises K detection units (302, 304; 302A, 304A), K being an integer greater than one, and the number of series of periodic angular positions of the minute wheel (294) is an integer S greater than zero, each series of periodic angular positions being associated with a respective plurality of R specific elements or specific recesses of the minute wheel, the K detection units being arranged such that they can each detect the S pluralities of R specific elements or specific recesses of the minute wheel; and wherein any two of the K detection units are angularly offset by a separation angle, for which the remainder of the integer division by an angle equal to 360°/(R·S) is not zero, the number of reference time positions of the minutes indicator capable of being detected by the correction device being equal to S·K.

22. The timepiece according to claim 21, wherein S series of periodic angular positions are offset in pairs by an angle equal to 360°/(R·S) and said remainder of the integer division is substantially equal to 360°/(R·S·K).

23. The timepiece according to claim 19, wherein it comprises a plate (272) which supports, on the upper side, the minute wheel (294) and which bears the detection unit, which is arranged beneath the minute wheel.

24. The timepiece according to claim 18, wherein each detection unit is of the optical type and comprises a light source (302, 302A) and a photodetector (304, 304A) radially aligned with one another.

25. The timepiece according to claim 1, wherein the correction device (6; 132) is arranged such that it can be periodically activated, in an automatic manner, to carry out a correction cycle during which the detection device is activated for a said detection phase, so as to allow the electronic correction circuit (40) to determine a said overall time error, and the braking device is then activated to correct, during a said correction period, at least a large part of this overall time error.

26. The timepiece according to claim 1, wherein it further comprises a control member capable of being actuated by a user of the timepiece, this control member and the correction device being arranged to allow a user to activate the correction device so that this correction device carries out a correction cycle during which the detection device is activated for a said detection phase, so as to determine a said overall time error, and the braking device is activated to subsequently correct, during a said correction period, at least a large part of this overall time error.

27. The timepiece according to claim 26, wherein said control member is formed by a crown associated with a control stem which also act to manually set the display to the actual time.

28. The timepiece according to claim 1, wherein the correction device (6) further comprises a wireless communication unit (50), which is arranged such that it can communicate with an external system capable of providing the precise actual time, the correction device being arranged such that it can synchronise the reference actual time to a precise actual time, formed by current time units of the precise actual time corresponding to those of the reference actual time, during a synchronisation phase wherein the communication unit is activated so as to receive the precise actual time from the external system.

29. The timepiece according to claim 28, wherein said communication unit (50) is periodically and automatically activated to synchronise the reference actual time to said precise actual time during a said synchronisation phase.

30. The timepiece according to claim 28, wherein it comprises a control member for synchronising the reference actual time to said precise actual time, this control member being capable of being actuated by a user of the timepiece, the control member for synchronising the reference actual time to said precise actual time and the correction device being arranged to allow a user to activate the correction device so that this correction device synchronises the reference actual time to said precise actual time during a said synchronisation phase.

31. The timepiece according to claim 30, wherein said member for synchronising the reference actual time to said precise actual time is formed by a crown associated with a control stem which also act to manually set the display to the actual time.

32. The timepiece according to claim 1, wherein it comprises a device (144; 192) for determining the passage of said oscillating mechanical resonator through at least one specific position, the device for determining this specific position of the mechanical resonator allowing said control unit to determine a specific moment at which the oscillating mechanical resonator is located in the specific position; and wherein the control unit is arranged such that a first activation of the braking device occurring at the start of the correction period, to produce a first interaction between this braking device and the mechanical resonator, is initiated as a function of said specific moment.

33. The timepiece according to claim 32, wherein the horological movement comprises an escapement associated with the mechanical resonator, wherein the braking device comprises an actuator (174) provided with a stop member (184) for stopping the oscillating mechanical resonator, the stop member being capable of being actuated between a position of non-interaction with the mechanical resonator and a position of interaction wherein this stop member forms an abutment for a projecting part (190) of the oscillating mechanical resonator, the projecting part being arranged to abut against the stop member when the latter is in the position of interaction thereof, the stop member in the position of interaction thereof and the projecting part defining a stop position ($\theta_B$) for the oscillating mechanical resonator which is different from the neutral position thereof, corresponding to the minimum potential energy state of the mechanical resonator, and less than a minimum amplitude of the oscillating mechanical resonator in the usable operating range thereof, said stop position further being provided such that the oscillating mechanical resonator is brought to a halt by the stop member outside a coupling zone ($\theta_{ZI}$) of the escapement with the oscillating mechanical resonator; and wherein the circuit for determining said specific position of the oscillating mechanical resonator and said control unit are arranged such that they can activate the actuator, when said overall time error determined by the electronic correction circuit corresponds to a loss in the actual time displayed that is to be corrected, such that this actuator actuates the stop member thereof so that the projecting part (190) of the oscillating mechanical resonator comes to abut against this stop member (184) in a plurality of half-alternations of the oscillating mechanical resonator each of which follow the passage thereof through said neutral position, so as to prematurely end each of these half-alternations without blocking the mechanical resonator, the number of half-alternations of said plurality of half-alternations or a duration of the correction period during which the stop member is held in the position of interaction thereof being determined by said loss to be corrected.

34. The timepiece according to claim 33, wherein the device for determining at least one specific position of the oscillating mechanical resonator comprises a detector (192) for detecting the position and direction of motion of the mechanical resonator, this detector and the mechanical resonator being arranged to allow the passage of the oscillating mechanical resonator through said specific position ('0') in each period of the oscillation thereof to be detected and to allow the electronic correction circuit (196) to determine the direction of motion of the oscillating mechanical resonator in the alternation during which the passage of the oscillating mechanical resonator through the specific position is detected, and wherein the electronic correction circuit is arranged such that it can at least partially correct said loss, such that it can control the actuator (174) so that this actuator actuates the stop member thereof from the position of non-interaction thereof into the position of interaction thereof when the oscillating mechanical resonator is situated on the neutral position side relative to said stop position, and so that the actuator subsequently holds the stop member in this position of interaction for a determined duration that is sufficient for the projecting part of the oscillating mechanical resonator to abut at least once against the stop member.

35. The timepiece according to claim 34, wherein said actuator (174) is of the bistable type and is arranged such that it can remain in the position of non-interaction and in the position of interaction without maintaining a power supply to this actuator; and wherein the electronic correction circuit and the actuator are arranged such that, to at least partially correct said loss, the stop member (184) is maintained in the position of interaction thereof, after the stop member is actuated from the position of non-interaction thereof to the position of interaction thereof when the oscillating mechanical resonator is located on the neutral position side relative to said stop position, until the end of said correction period during which the projecting part (190) of the oscillating mechanical resonator periodically abuts several times against the stop member.

36. The timepiece according to claim 34, wherein said control unit comprises a measuring circuit which is associated with said detector for detecting the position and the direction of motion of the mechanical resonator, this measuring circuit comprising a clock circuit (42), providing a clock signal at a determined frequency (F0c/2), and a comparator circuit (200) allowing a time drift of the oscillating mechanical resonator relative to the setpoint frequency thereof to be measured, the measuring circuit being arranged such that it can measure a time interval corresponding to a time drift of the mechanical resonator from the start of the correction period, the control unit being arranged to end the correction period as soon as said time interval is greater than or equal to said overall time error previously determined by the electronic correction circuit.

37. The timepiece according to claim 1, wherein the braking device is formed by an electromechanical actuator (22A; 22B), which is arranged such that it can apply braking pulses to the mechanical resonator, and the control unit comprises a device for generating at least one frequency (62) which is arranged such that it can generate a first periodic digital signal ($S_{FS}$) at a frequency $F_{SUP}$; wherein the control unit (48A, 48B) is arranged to provide the braking device, when said overall time error previously determined by the electronic correction circuit corresponds to a displayed time loss that is to be corrected, with a first control signal ($S_{C1}$, $S_{Act}$ ($S_{FS}$)) derived from the first periodic digital signal, during a first correction period, to activate the braking device such that this braking device generates a first series of periodic braking pulses that are applied to the mechanical resonator at said frequency $F_{SUP}$, the duration of the first correction period and thus the number of periodic braking pulses in said first series being determined by said loss to be corrected; and wherein the frequency $F_{SUP}$ is provided and the braking device is arranged such that said first series of periodic braking pulses at the frequency $F_{SUP}$ can, during said first correction period, result in a first synchronous phase wherein the oscillation of the mechanical resonator (14) is synchronised to a correction frequency $FS_{Cor}$ which is greater than a setpoint frequency F0c provided for the mechanical resonator.

38. The timepiece according to claim 37, wherein said device for generating at least one frequency is a frequency generator device (62, 142) which is arranged such that it can further generate a second periodic digital signal ($S_{FI}$) at a frequency $F_{INF}$; wherein the control unit (48B) is arranged such that it can provide the braking device, when said overall time error previously determined by the electronic correction circuit corresponds to a displayed time gain that is to be corrected, with a second control signal ($S_{Act}$ ($S_{FI}$)) derived from the second periodic digital signal, during a second correction period, to activate the braking device such that this braking device generates a second series of periodic braking pulses that are applied to the mechanical resonator at said frequency $F_{INF}$, the duration of the second correction period and thus the number of periodic braking pulses in said second series being determined by said gain to be corrected; and in that the frequency $F_{INF}$ is provided and the braking device is arranged such that said second series of periodic braking pulses at the frequency $F_{INF}$ can, during said second correction period, result in a second synchronous phase wherein the oscillation of the mechanical resonator is synchronised to a correction frequency $FI_{Cor}$ which is less than the setpoint frequency F0c provided for the mechanical resonator.

39. The timepiece according to claim 37, wherein the horological movement comprises an escapement associated with the mechanical resonator, wherein said frequency $F_{SUP}$ and the duration of the braking pulses of the first series of periodic braking pulses are selected such that, during said first synchronous phase, each of the braking pulses of said first series occurs outside a coupling zone ($\theta_{ZI}$) of the oscillating mechanical resonator with the escapement.

40. The timepiece according to claim 38, wherein the horological movement comprises an escapement associated with the mechanical resonator, wherein said frequency $F_{INF}$ and the duration of the braking pulses of the second series of periodic braking pulses are selected such that, during said second synchronous phase, each of the braking pulses of said second series occurs outside a coupling zone ($\theta_{ZI}$) of the oscillating mechanical resonator with the escapement.

41. The timepiece according to claim 37, wherein the device for generating at least one frequency is a frequency generator device (62, 142, 144) which is arranged such that it can further generate a third periodic digital signal ($S_{F0c}$) at the setpoint frequency F0c for the mechanical resonator; in that the control unit is arranged such that it can provide the braking device with a third control signal ($S_{Act}$ ($S_{F0c}$)) derived from the third periodic digital signal, during a preliminary period preceding the correction period, to activate the braking device such that this braking device generates a preliminary series of periodic braking pulses which are applied to the mechanical resonator at the setpoint frequency F0c, the duration of these braking pulses and the braking force applied to the oscillating mechanical resonator during the preliminary series of periodic braking pulses being provided such that none of these braking pulses can bring the oscillating mechanical resonator to a halt inside a coupling zone ($\theta_{ZI}$) of the oscillating mechanical resonator with the escapement; the control unit being arranged such that the duration of the preliminary period and the braking force applied to the oscillating mechanical resonator during the preliminary series of periodic braking pulses allow, at least at the end of the preliminary period, a preliminary synchronous phase to be produced, wherein the oscillation of the mechanical resonator is synchronised to the setpoint frequency F0c; and in that the control unit is arranged such that the initiation of a first braking pulse of the first series of periodic braking pulses, during said correction period, occurs after a time interval determined relative to a moment at which the last braking pulse of the preliminary period was initiated, the moment at which said first braking pulse is initiated and the braking force applied to the oscillating mechanical resonator during said first series of periodic braking pulses being provided such that said first synchronous phase at said correction frequency $FS_{Cor}$ starts instantly at said first braking pulse or a second braking pulse.

42. The timepiece according to claim 1, wherein it comprises a device (22; 106; 114; 174) for blocking the mechanical resonator; and in that the control unit is arranged such that it can provide the blocking device, when said overall time error previously determined by the electronic correction circuit corresponds to a displayed time gain that is to be corrected, with a fourth control signal which activates the blocking device such that this blocking device blocks said oscillation of the mechanical resonator during said correction period which is determined by said gain to be corrected, in order to stop the running of said drive mechanism during this correction period.

43. The timepiece according to claim 42, wherein said correction period has a duration that is substantially equal to said gain to be corrected.

44. The timepiece according to claim 42, wherein the blocking device is formed by a device (114) that is separate from said braking device and comprises a bistable lever (115), the first stable position of this bistable lever corresponding to a position of non-interaction with the mechanical resonator and the second stable position thereof corresponding to a position for halting and blocking the mechanical resonator.

45. The timepiece according to claim 42, wherein the blocking device (106) forms a lock for the mechanical resonator, a part (107) of this blocking device being inserted into a cavity (108), arranged in a circular element (100) of the balance forming the mechanical resonator, when the blocking device is activated to block this mechanical resonator during the period for correcting a given gain.

* * * * *